US011957991B2

(12) United States Patent
Fink et al.

(10) Patent No.: US 11,957,991 B2
(45) Date of Patent: Apr. 16, 2024

(54) BALLOON TOY

(71) Applicant: MOOSE CREATIVE MANAGEMENT PTY LIMITED, Cheltenham (AU)

(72) Inventors: Steven Fink, Cheltenham (AU); Miguel Rusch, Cheltenham (AU); Dean Del Giudice, Cheltenham (AU); Michael G. Hoeting, Cincinnati, OH (US); Alex D. Dieterle, Mason, OH (US)

(73) Assignee: MOOSE CREATIVE MANAGEMENT PTY LIMITED, Cheltenham (AU)

( * ) Notice: Subject to any disclaimer, the term of this patent is extended or adjusted under 35 U.S.C. 154(b) by 226 days.

(21) Appl. No.: 17/191,472

(22) Filed: Mar. 3, 2021

(65) Prior Publication Data

US 2021/0275932 A1 Sep. 9, 2021

Related U.S. Application Data

(60) Provisional application No. 62/986,484, filed on Mar. 6, 2020.

(51) Int. Cl.

| | |
|---|---|
| ***A63H 13/02*** | (2006.01) |
| ***A63H 3/00*** | (2006.01) |
| ***A63H 3/28*** | (2006.01) |
| ***A63H 3/46*** | (2006.01) |
| ***A63H 27/10*** | (2006.01) |
| ***A63H 29/22*** | (2006.01) |
| ***A63H 31/08*** | (2006.01) |

(52) U.S. Cl.

CPC ..... *A63H 13/02* (2013.01); *A63H 3/006* (2013.01); *A63H 3/28* (2013.01); *A63H 3/46* (2013.01); *A63H 27/10* (2013.01); *A63H 29/22* (2013.01); *A63H 31/08* (2013.01); *A63H 2027/1033* (2013.01); *A63H 2027/1058* (2013.01); *A63H 2027/1075* (2013.01); *A63H 2027/1083* (2013.01); *A63H 2200/00* (2013.01)

(58) Field of Classification Search

CPC . A63H 13/02; A63H 3/28; A63H 3/46; A63H 29/22; A63H 31/08; A63H 2200/00

USPC ..... 446/226, 296, 297, 298, 300, 302, 325, 446/330, 333, 352, 353, 356, 376

See application file for complete search history.

(56) References Cited

U.S. PATENT DOCUMENTS

| | | | | |
|---|---|---|---|---|
| 3,132,864 A * | 5/1964 | Glass | ..... | A63F 7/305 273/127 R |
| 3,178,853 A * | 4/1965 | Greenwood | ..... | A63H 11/20 446/356 |
| 3,195,270 A * | 7/1965 | Glass | ..... | A63H 13/02 446/270 |

(Continued)

FOREIGN PATENT DOCUMENTS

| | | |
|---|---|---|
| CN | 105903201 A | 5/2018 |
| CN | 207680057 U | 8/2018 |

*Primary Examiner* — Joseph B Baldori

(74) *Attorney, Agent, or Firm* — KNOBBE MARTENS OLSON & BEAR LLP

(57) ABSTRACT

An interactive toy is shown and described. The toy can be in the shape of a balloon animal, such as a dog, and react in a predetermined manner to user input or stimulus. More specifically, the balloon animal responds and reacts to the user input provided to specific locations on the balloon animal and/or to placement of an object in proximity to or in contact with the balloon animal.

18 Claims, 63 Drawing Sheets

(56) References Cited

U.S. PATENT DOCUMENTS 3,475,853 A * 11/1969 Adler ..... A63H 3/46 446/330
3,559,336 A * 2/1971 Nozaki ..... A63H 13/00 446/484
3,740,893 A 6/1973 Shinoda
4,217,726 A * 8/1980 Flicker ..... A63H 3/52 446/361
4,245,515 A * 1/1981 Iwaya ..... A63H 11/20 74/25
4,810,226 A * 3/1989 Takahashi ..... A63H 11/20 446/420
4,820,232 A * 4/1989 Takahashi ..... A63H 3/28 446/298
5,141,464 A * 8/1992 Stern ..... A63H 13/02 446/353
6,022,263 A * 2/2000 Liu ..... A63H 3/20 446/379
6,273,782 B1 * 8/2001 Chan ..... A63H 11/00 446/377
6,439,951 B1 * 8/2002 Kawakita ..... H01R 13/62 446/376
6,462,498 B1 * 10/2002 Filo ..... A63H 11/20 446/355
6,547,631 B1 * 4/2003 Randall ..... A63H 13/04 446/298
6,620,024 B2 9/2003 Choi
6,645,036 B1 * 11/2003 Lund ..... A63H 11/18 446/298
6,652,353 B1 * 11/2003 Lund ..... A63H 11/20 446/330
6,672,934 B2 * 1/2004 Hornsby ..... A63H 11/20 446/454
6,682,390 B2 1/2004 Saito
6,695,672 B1 2/2004 Rehkemper
6,695,673 B1 * 2/2004 Stadbauer ..... A63H 3/24 446/337
6,705,917 B2 * 3/2004 Filo ..... A63H 11/20 446/379
6,736,694 B2 * 5/2004 Hornsby ..... A63H 11/20 446/357
6,746,301 B1 * 6/2004 Lund ..... A63H 11/06 446/322
6,843,703 B1 * 1/2005 Laconis ..... A63H 13/02 446/376
7,115,014 B2 * 10/2006 McGrath ..... A63H 13/02 446/483
7,118,443 B2 * 10/2006 Marine ..... A63H 3/28 446/175
7,207,859 B1 * 4/2007 Laconis ..... A63H 13/005 446/376
7,442,107 B1 * 10/2008 Ueda ..... A63H 11/20 446/175
7,695,341 B1 * 4/2010 Maddocks ..... A63H 13/02 446/353
7,731,559 B1 * 6/2010 Maddocks ..... A63H 13/02 446/295
7,901,265 B1 * 3/2011 Cameron ..... A63H 3/46 446/376
8,057,275 B2 * 11/2011 Cameron ..... A63H 13/02 446/376
8,414,350 B2 * 4/2013 Rehkemper ..... A63H 11/20 446/376
8,483,873 B2 7/2013 Wong
11,468,891 B2 * 10/2022 Sawata ..... G10L 15/22
2001/0049248 A1 * 12/2001 Choi ..... A63H 30/04 446/298
2003/0045203 A1 * 3/2003 Sabe ..... G06N 3/008 446/356
2007/0123142 A1 * 5/2007 Maddocks ..... A63H 13/02 446/377
2017/0021284 A1 * 1/2017 Murison ..... A63H 29/22
2018/0154269 A1 * 6/2018 Quick, III ..... A63H 3/14
2019/0176046 A1 * 6/2019 Sutton ..... H03K 17/9625
2019/0209932 A1 7/2019 Schwartz
2020/0246982 A1 * 8/2020 Ishibashi ..... B25J 19/005
2020/0330891 A1 * 10/2020 Tada ..... A63H 31/08
2020/0371525 A1 * 11/2020 Mizukami ..... G05D 1/0221
2021/0001077 A1 * 1/2021 Stevens ..... B25J 13/003
2021/0031378 A1 * 2/2021 Koyama ..... B25J 11/003
2021/0197393 A1 * 7/2021 Mizukami ..... A63H 11/18
2022/0001547 A1 * 1/2022 Shimoe ..... B25J 11/0005
2022/0097230 A1 * 3/2022 Kawabe ..... B25J 13/088

* cited by examiner

BALLOON TOY

CROSS-REFERENCE TO RELATED APPLICATION

This application claims benefit under 35 U.S.C. 119(e) to U.S. Provisional Patent App. No. 62/986,484, filed Mar. 6, 2020, the entire disclosure of which is hereby incorporated by reference herein in its entirety. Any and all priority claims identified in the Application Data Sheet, or any corrections thereto, are hereby incorporated by reference under 37 CFR 1.57.

BACKGROUND

Field

An interactive toy is described. The toy can be in the shape of a balloon animal, such as a dog, a balloon insect, such as a cricket, a balloon figurine, or any other desirable shape for a toy. The toy reacts in a predetermined manner to user input or stimulus or audio input/s. More specifically, the balloon toy responds and reacts to the user input provided to specific locations on the balloon toy, audio input/s, and/or to placement of an object in proximity to or in contact with the balloon toy.

SUMMARY

An aspect is an interactive toy comprising a body, one or more sensors disposed within the body and configured to receive input from a user, one or more electric motor disposed in the body and configured to convert electrical energy into at least rotational energy, a plurality of limbs, each limb coupled to the body via a joint, each joint configured to adopt a plurality of positions relative to the body depending at least in part on the input from the sensor, and a gearbox disposed in the body and driven by the electric motor, the gearbox providing output to the plurality of limbs.

Further aspects include, wherein the plurality of positions include a standing position, a sitting position, a feeding position, a farting position, a peeing position, and/or a flat position.

Further aspects include, wherein the one or more sensors comprises a microphone, and wherein the input is audible input.

Further aspects include, wherein the audible input has a sound level, and wherein the interactive toy adopts a position of the plurality of positions based on the sound level.

Further aspects include, wherein the audible input has a frequency, and wherein the interactive toy adopts a position of the plurality of positions based on the frequency.

Further aspects include, wherein the one or more sensors comprises a tilt switch, and wherein the input is yaw, pitch, or roll of the body caused by the user.

Further aspects comprise a head coupled to the body, wherein the one or more sensors comprises a capacitive sensor, wherein the capacitive sensor is disposed in the head, and wherein the input is contact with the capacitive sensor.

Further aspects include, wherein the head further comprises ears, the capacitive sensor being disposed in the ears.

Further aspects include, wherein the one or more sensors comprises a capacitive sensor, the capacitive sensor being disposed on an underside of the body, and wherein the input is contact with the capacitive sensor.

Further aspects include, wherein the head further comprises a snout, and wherein the one or more sensors comprises a hall sensor, and wherein the input is presence of an accessory relative to the hall sensor.

Further aspects include, wherein the accessory is a feeding bowl, and wherein the feeding bowl comprises a magnet, the presence being of the magnet.

Further aspects include, wherein the interactive toy is configured to lower the snout and then raise the snout when the hall sensor is triggered by the magnet.

Further aspects include, wherein the one or more sensors further comprises a push/pull switch controlling a valve, and wherein the input is pressurized gas from an accessory.

Further aspects include, wherein the plurality of positions includes a standing position, and wherein the interactive toy moves to the standing position in response to the pressurized gas.

Further aspects include, wherein the one or more sensors further comprises a push/pull switch, the push/pull switch being disposed in the snout, and wherein the input is changing a position of the push/pull switch.

Further aspects include, wherein the plurality of positions includes a standing position, and wherein the interactive toy moves to the standing position in response to activation of the push/pull switch.

Further aspects include, wherein the plurality of positions includes a flat position, and wherein the interactive toy moves to the flat position in response to activation of the push/pull switch.

Further aspects include, wherein the one or more sensors comprises a jiggle switch, the jiggle switch being disposed in the body, and wherein the input is shaking one of the plurality of limbs.

Further aspects comprise a light, the light being configured to emit light when the interactive toy is in the peeing position.

Further aspects include, wherein the peeing position is when a rear of the body is dropped below a front of the body.

Further aspects comprise a speaker, the speaker being configured to emit a sound based at least in part on a position of the plurality of positions.

Further aspects include, wherein the sound is a fart, and wherein the position is a farting position.

Further aspects include, wherein the farting position is when a front of the body is dropped below a rear of the body.

Further aspects include, wherein the gearbox comprises a position sensor configured to detect a position of the plurality of limbs.

Further aspects include, wherein the position sensor is a digital encoder.

Further aspects include, wherein the position sensor is a potentiometer.

Further aspects include, wherein one or more of the joints comprises PVC.

Further aspects include, further comprising a tail coupled to the body, at least a portion of the tail being inflatable by a gas.

Further aspects comprise a valve, the valve being in flow communication with the tail.

Further aspects comprise a hollow tube defining a flow passage, the gas being configured to flow between the valve and the tail via the flow passage.

Further aspects include, wherein the tail comprises an outlet port, and wherein the inflatable portion of the tail is configured to attach to the outlet port.

Further aspects include, wherein each limb comprises an outer shell disposed about a leg frame, an end of the leg frame being coupled to the joint.

Further aspects comprise one or more electronic components.

Further aspects comprise a PCB, wherein the one or more electronic components are support by the PCB.

Further aspects include, wherein the body has the appearance of a balloon toy.

Further aspects include, wherein the balloon toy is an animal.

Further aspects include, wherein the animal is a dog.

Further aspects include, wherein the balloon toy is a giraffe.

Further aspects comprise a clutch disposed between the one or more electric motor and the gearbox, the clutch transferring the rotational power from the one or more electric motor to the gearbox.

An aspect is an interactive toy comprising a body having a torso, a head, front legs, and rear legs, the head being coupled to the torso, each leg of the front legs and the rear legs being coupled to the torso via a joint, each joint configured to adopt a plurality of positions relative to the torso, one or more tilt sensors configured to determine a position of the body, one or more sensors configured to receive input from a user, a first electric motor and a second electric motor disposed in the torso and configured to convert electrical energy into at least rotational energy, a front gearbox disposed in the torso and driven by the first electric motor, the front gearbox providing output to the front legs, a rear gearbox disposed in the torso and driven by the second electric motor, the rear gearbox providing output to the rear legs, and a processor configured to control at least the front and rear gearboxes to move the legs between the plurality of positions based on the position determined by the one or more tilt sensors and the user input received by the one or more sensors.

An aspect is an interactive toy comprising a body having a torso, a head, front legs, and rear legs, the head being coupled to the torso, each leg of the front legs and the rear legs being coupled to the torso via a joint, each joint configured to adopt a plurality of positions relative to the torso, a first switch to activate a deflate play pattern, the deflate play pattern causing the body to move from a standing position to a lying position, a second switch to activate an inflate play pattern, the inflate play pattern causing the body to move from the lying position to the standing position, and a processor and a memory storing instructions that when executed by the processor in response to a signal from the first switch and the second switch causes the toy to perform a plurality of play patterns including the deflate and inflate play patterns.

BRIEF DESCRIPTION OF THE DRAWINGS

Various embodiments are depicted in the accompanying drawings for illustrative purposes and should in no way be interpreted as limiting the scope of the embodiments. In addition, various features of different disclosed embodiments can be combined to form additional embodiments, which are part of this disclosure.

DETAILED DESCRIPTION

Figure 9:
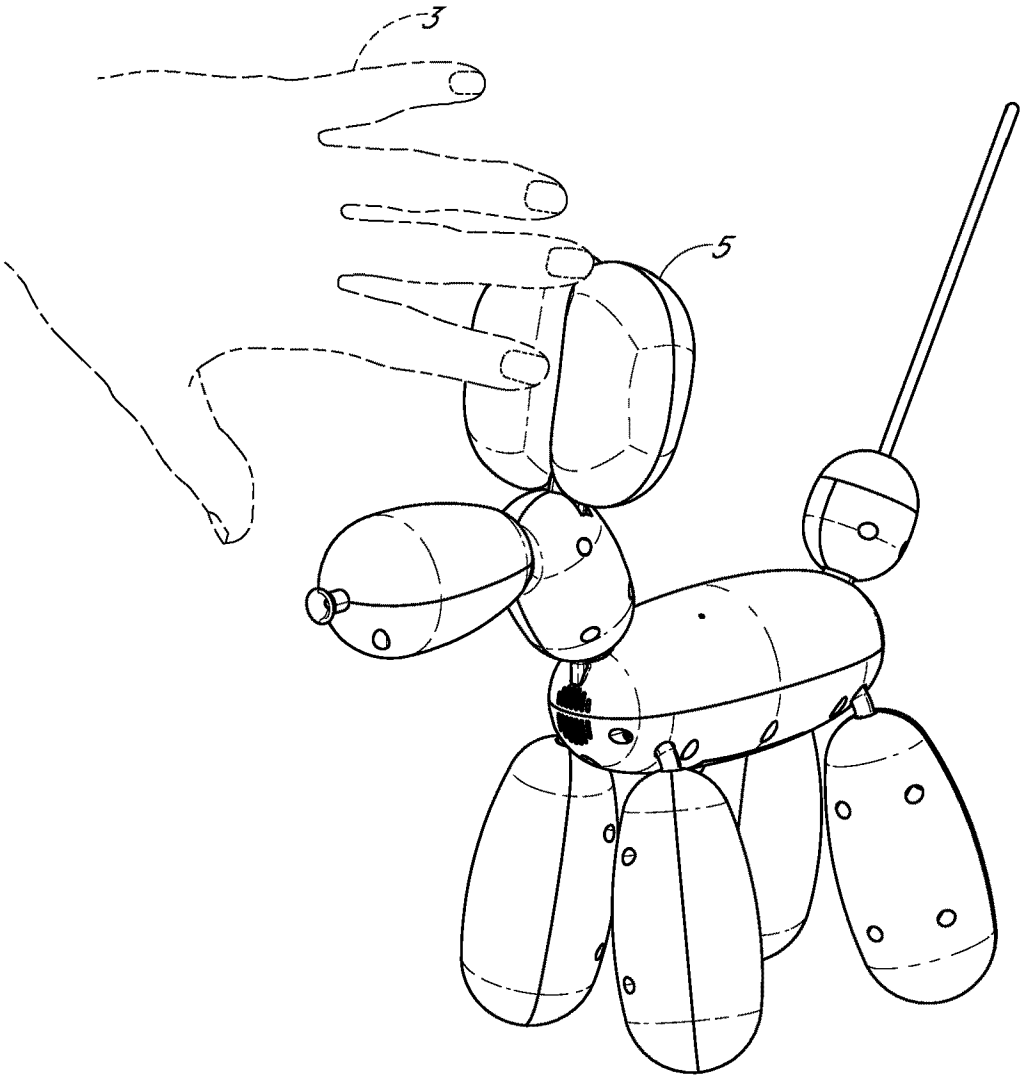
FIG. 9 is a front perspective view similar to FIG. 8 except input in the form of a user's hand is provided to the ears of the toy.
Figure 8:
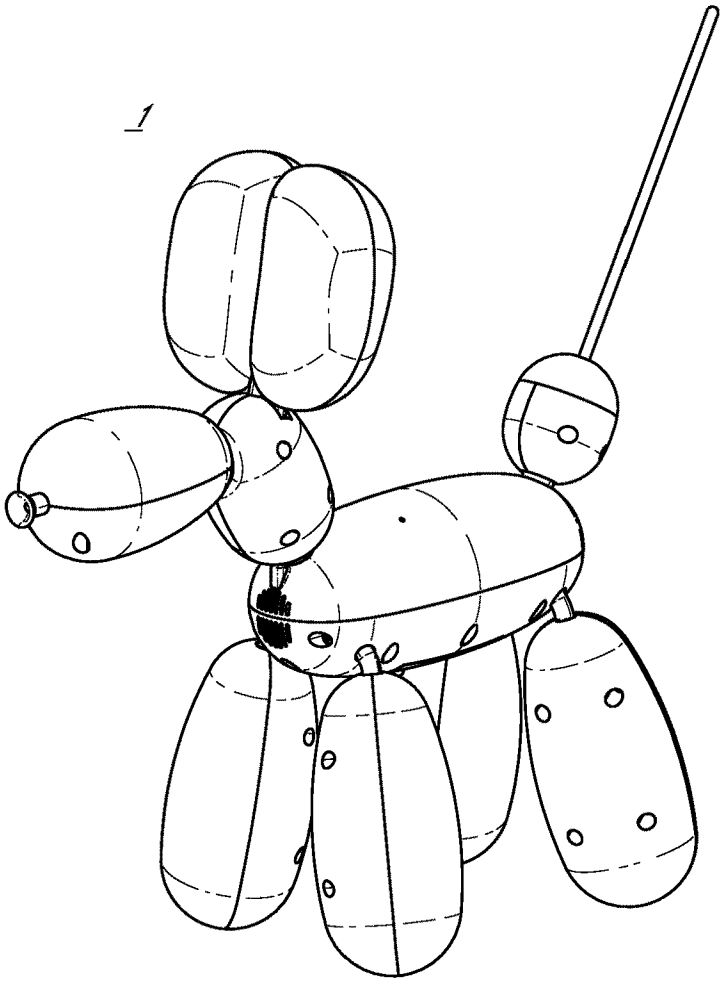
FIG. 8 is a front perspective view of the toy from FIG. 1.
Figure 11:
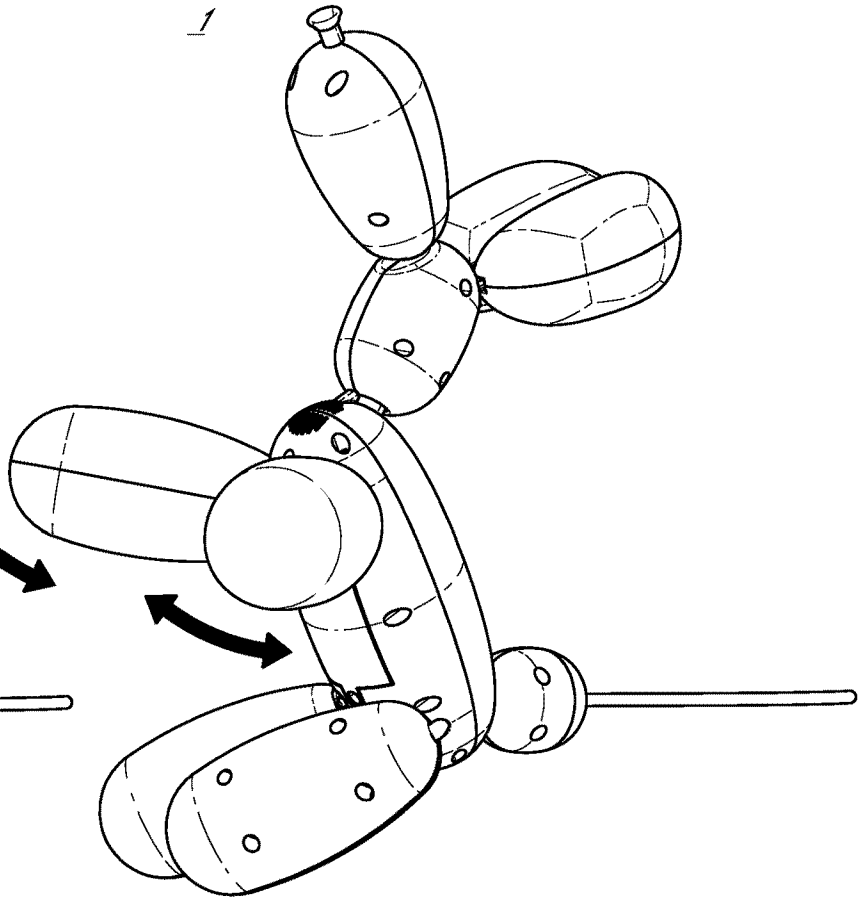
FIG. 11 is a front perspective view similar to FIG. 10 except the toy has moved in a second predetermined manner after moving in the first predetermined manner.
Figure 10:
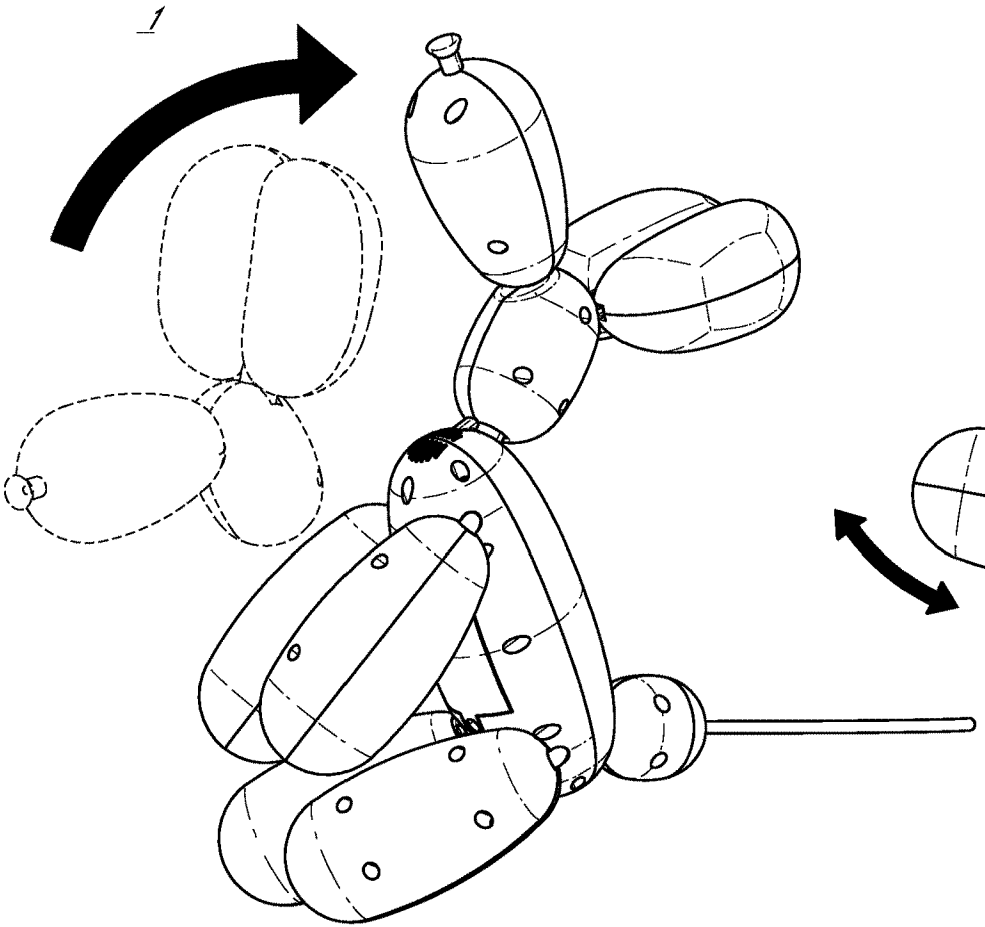
FIG. 10 is a front perspective view similar to FIG. 9 except the toy has moved in a first predetermined manner in response to the input illustrated in FIG. 9.

FIGS. 1 through 8 are views of the toy or model 1 according to a preferred embodiment of the present invention. FIG. 9 is a front perspective view similar to FIG. 8 except input in the form of a user's hand 3 is provided to the ears 5 of the toy 1. FIG. 10 is a front perspective view similar to FIG. 9 except the toy 1 has moved in a first predetermined manner in response to the input illustrated in FIG. 9. FIG. 11 is a front perspective view similar to FIG. 10 except the toy 1 has moved in a second predetermined manner after moving in the first predetermined manner.

Figure 12A:
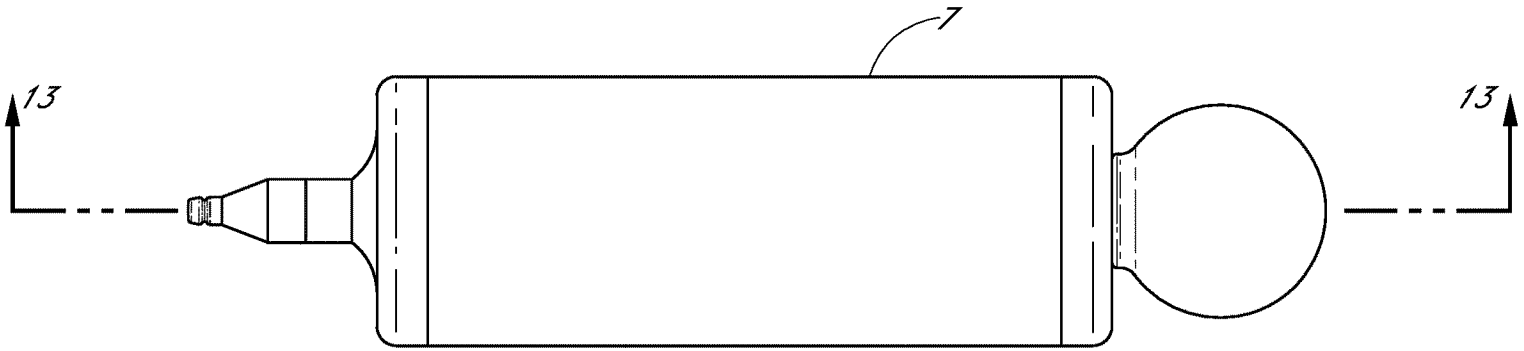
FIGS. 12A-C illustrate an accessory that can be used to provide input to the toy.
Figure 12B:
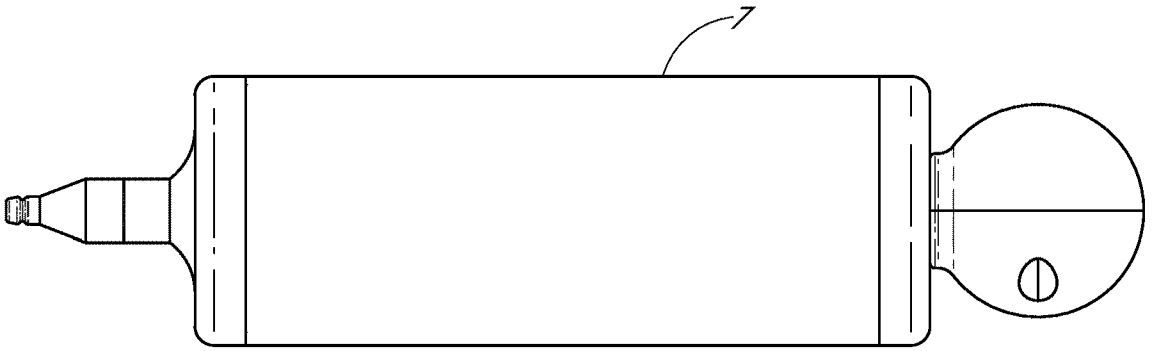
Figure 12C:
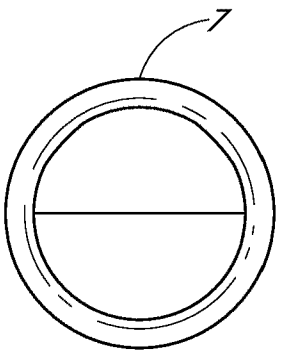
Figure 13:
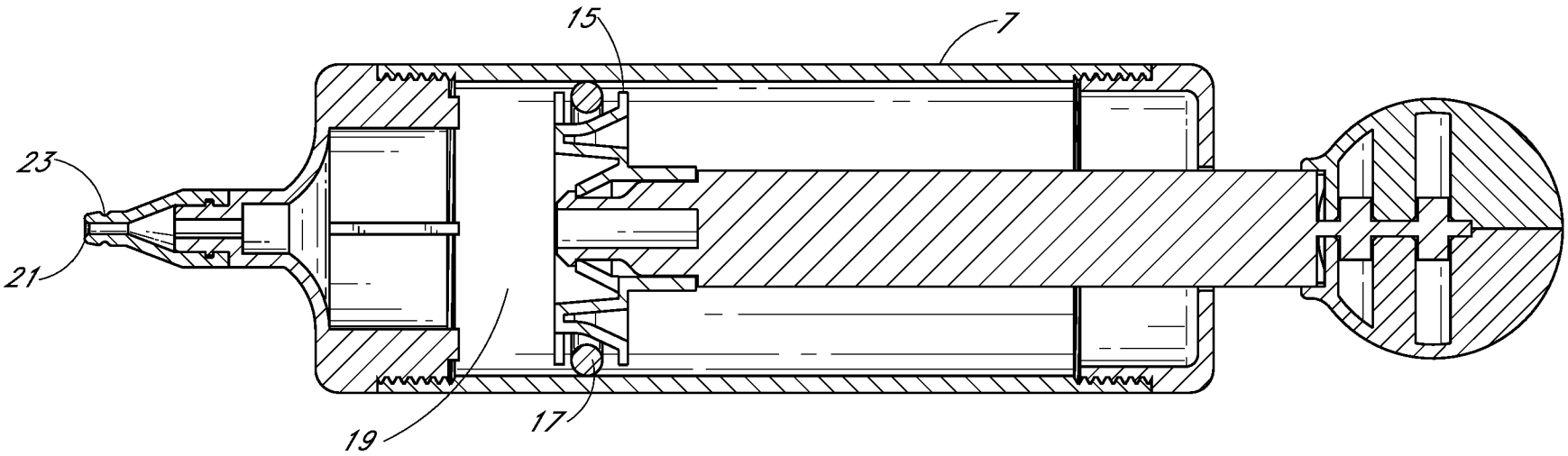
FIG. 13 is a cross-section though the accessory of FIG. 12A.

FIGS. 12A-12C illustrate an accessory 7 that can be used to provide input to the toy 1. FIG. 13 is a cross-section though the accessory 7 of FIG. 12A. In certain embodiments, the accessory 7 is an air pump. The air pump provides a way for the user to manually inflate a balloon tail 9. In certain embodiments, pressing the nozzle 11 of the toy 1 into the mouth 13 will cause the item to 'electronically' inflate with animation/sound effects. In certain embodiments, the valving is provided by a shuttle 15 and an O-ring 17 that is forced outwards on an in-stroke to seal the chamber 19 and pass air through the tip 21. In certain embodiments, the pump tip 21 is PVC and a small detent 23 allows it to be positively connected to the dog's mouth 13, allowing two hands to be used to activate the pump.

Figure 1:
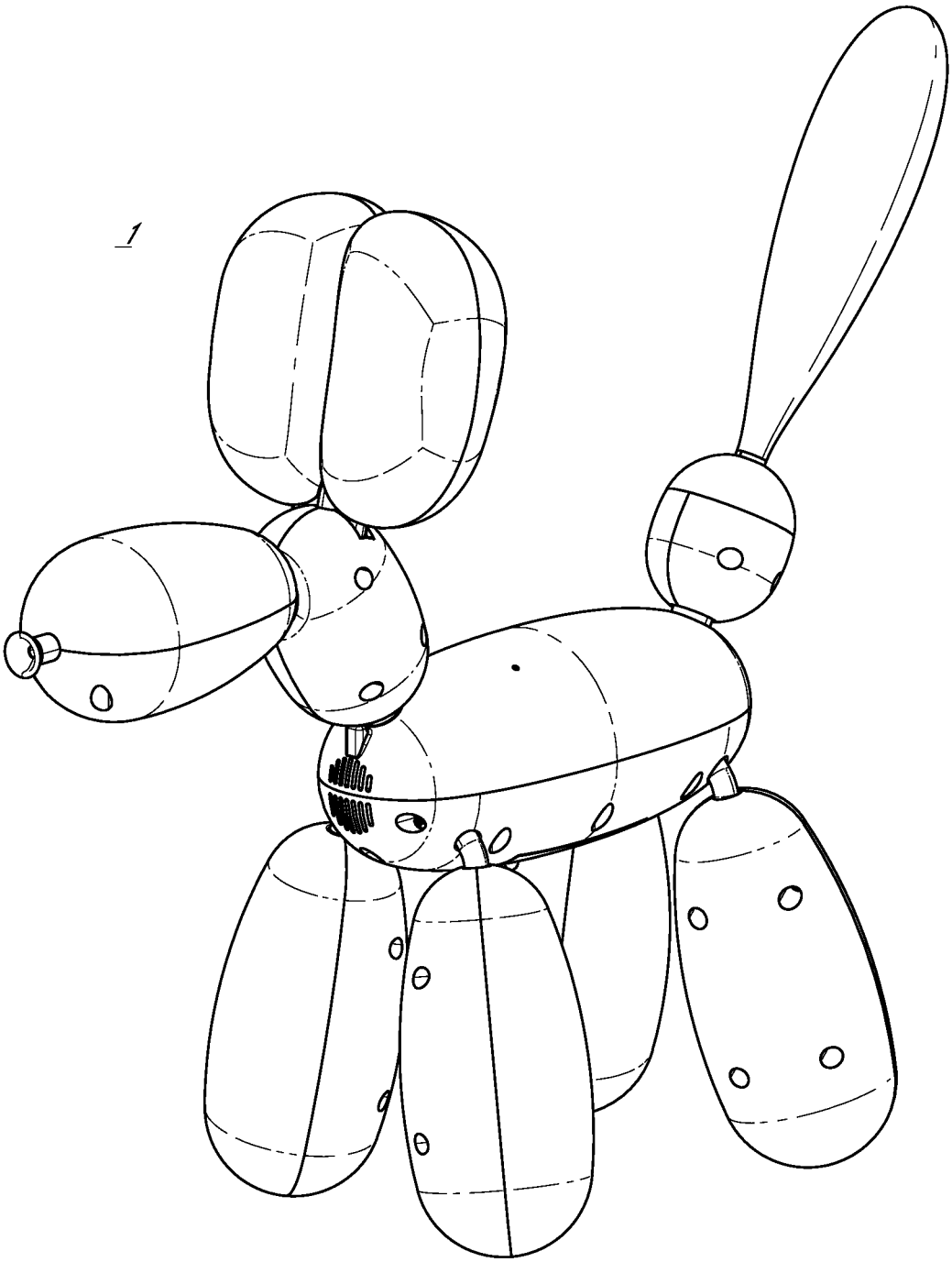
FIG. 1 is a front perspective view of the toy according to a first embodiment of the present invention.
Figure 2:
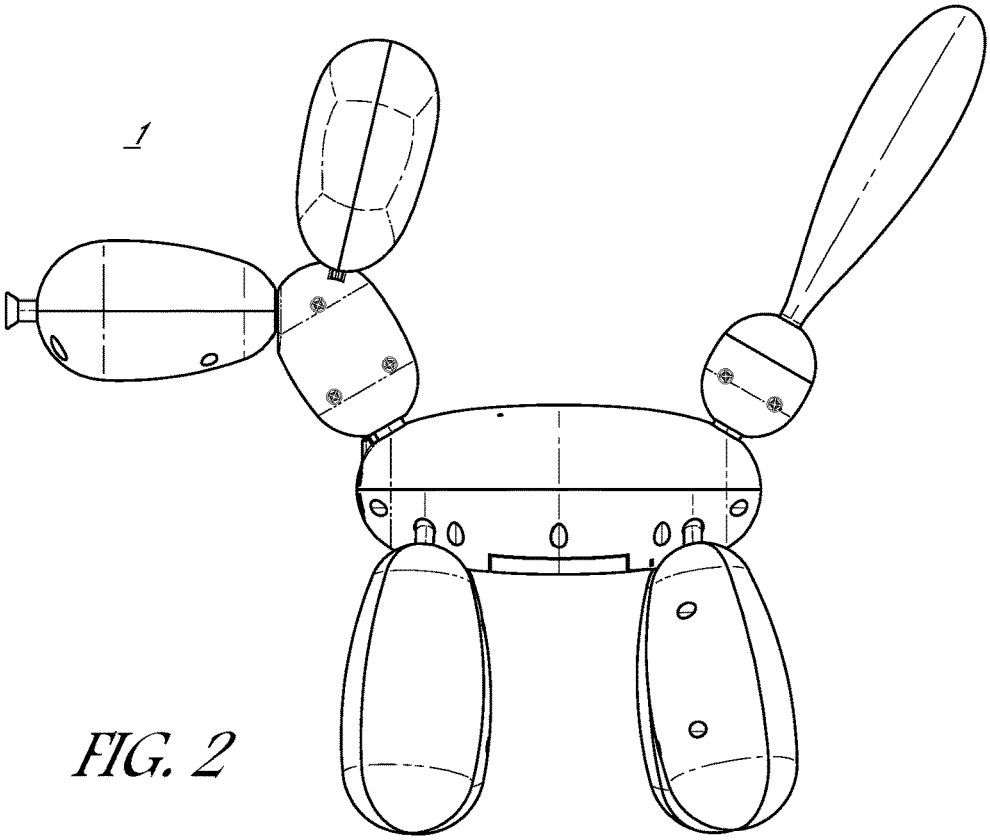
FIG. 2 is a side view of the toy in FIG. 1.
Figure 3:
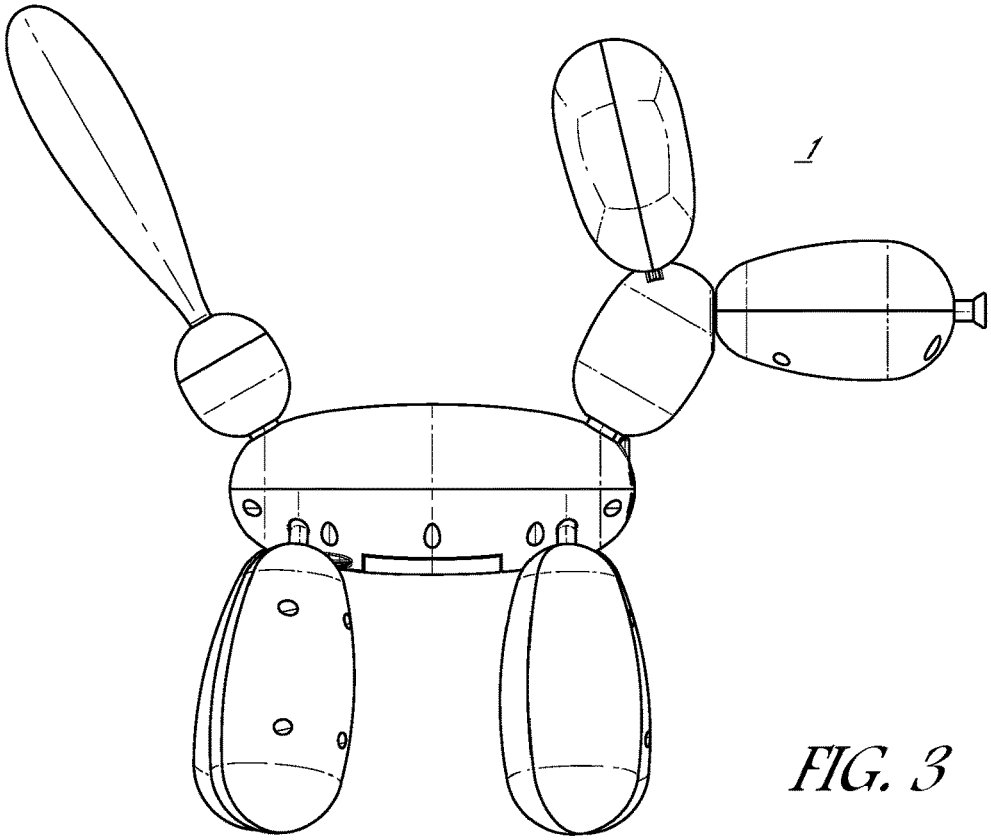
FIG. 3 is a side view of the toy opposite to the side view in FIG. 2.
Figure 5:
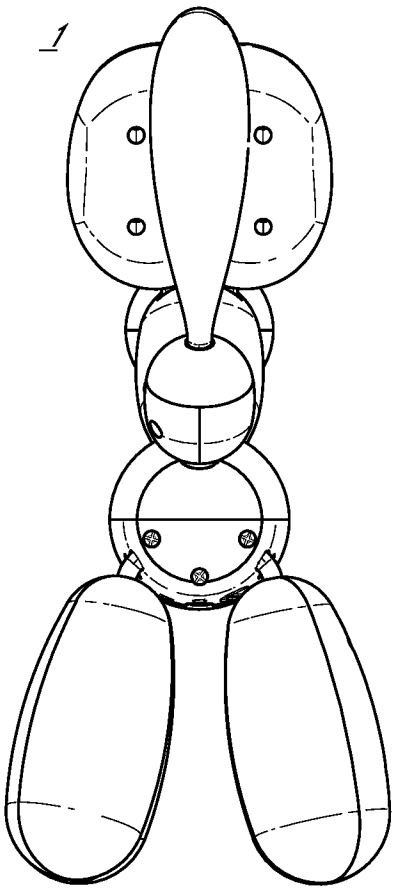
FIG. 5 is a rear plan view of the toy from FIG. 1.
Figure 4:
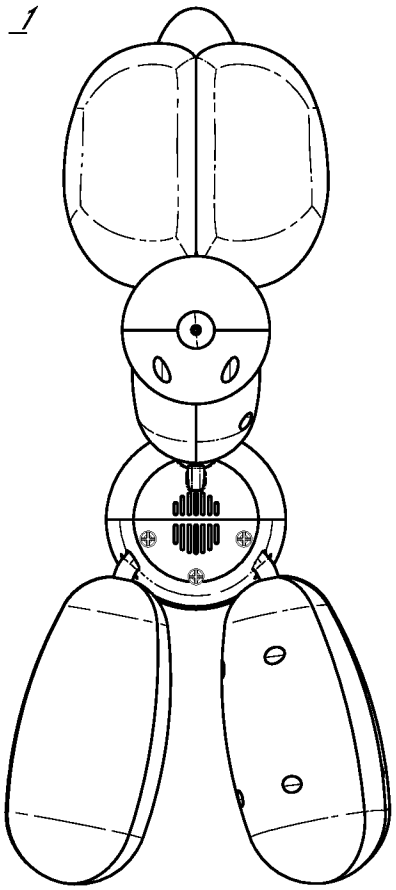
FIG. 4 is a front plan view of the toy from FIG. 1.
Figure 7:
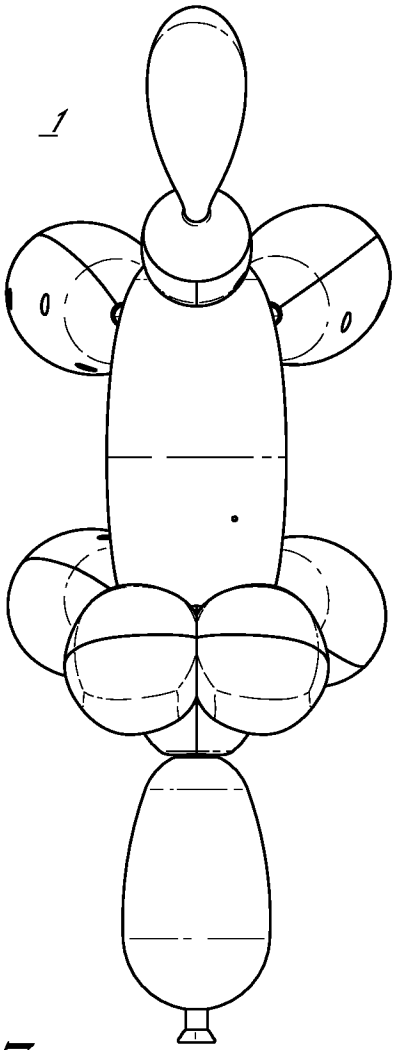
FIG. 7 is a top plan view of the toy from FIG. 1.
Figure 6:
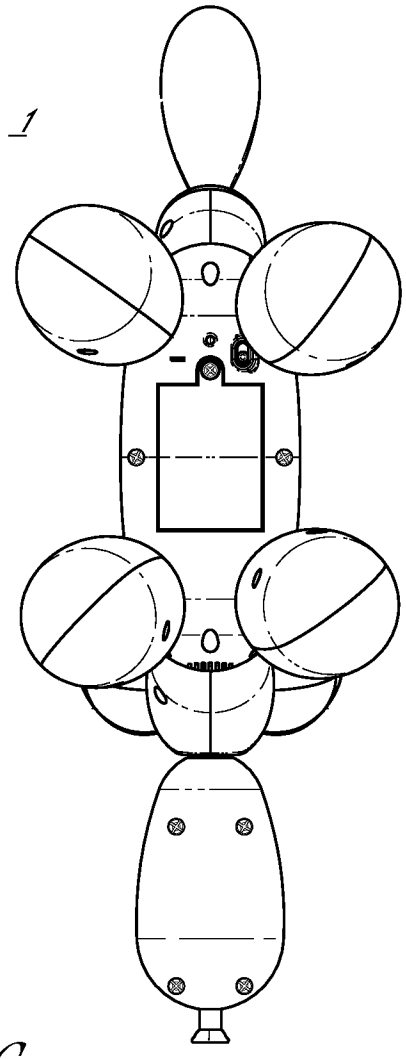
FIG. 6 is a bottom plan view of the toy from FIG. 1.
Figure 14A:
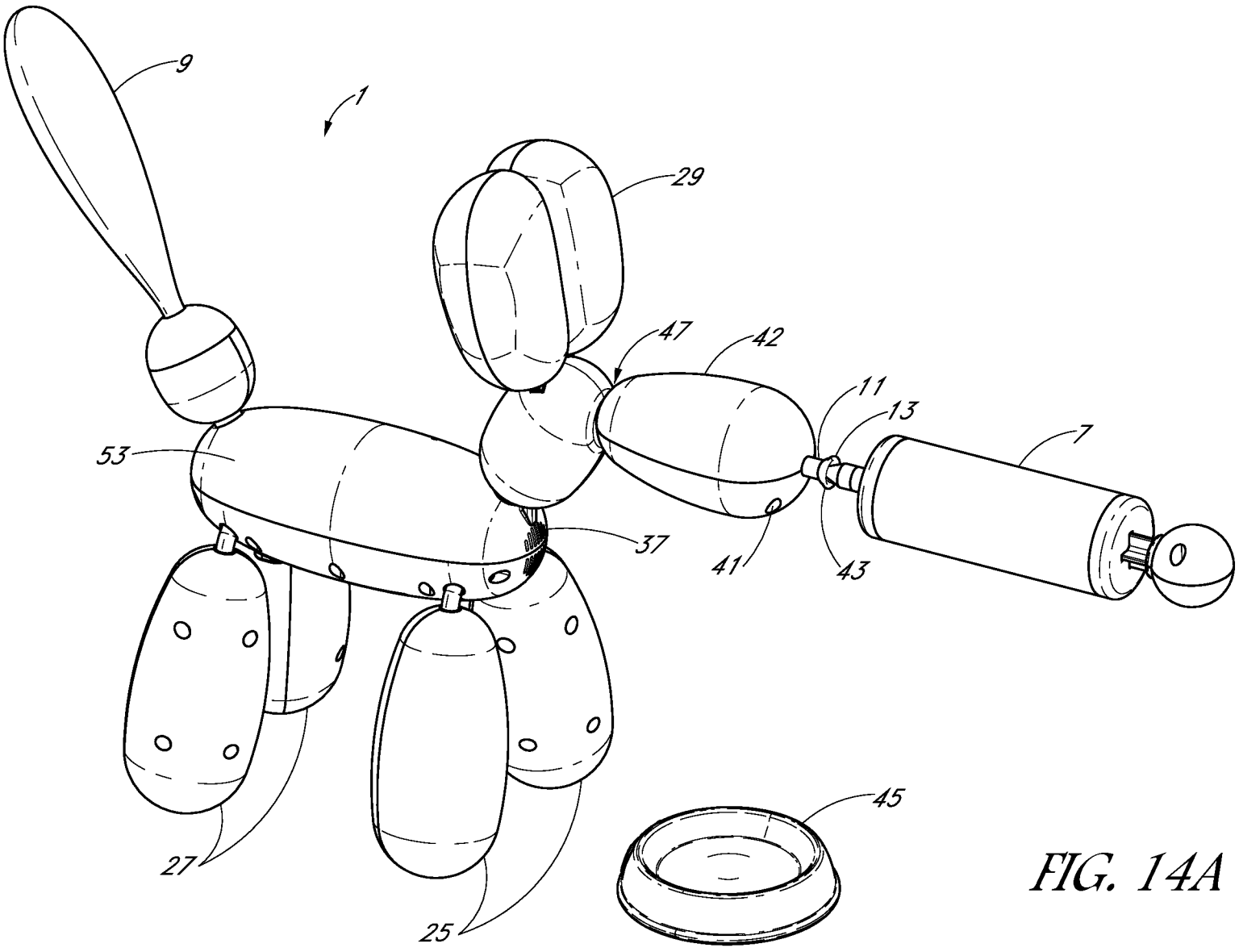
FIG. 14A is an exemplary overview of the toy of FIG. 1 with accessories.

FIG. 14A is an exemplary overview of the toy 1 of FIG. 1 with accessories.

Figure 14B:
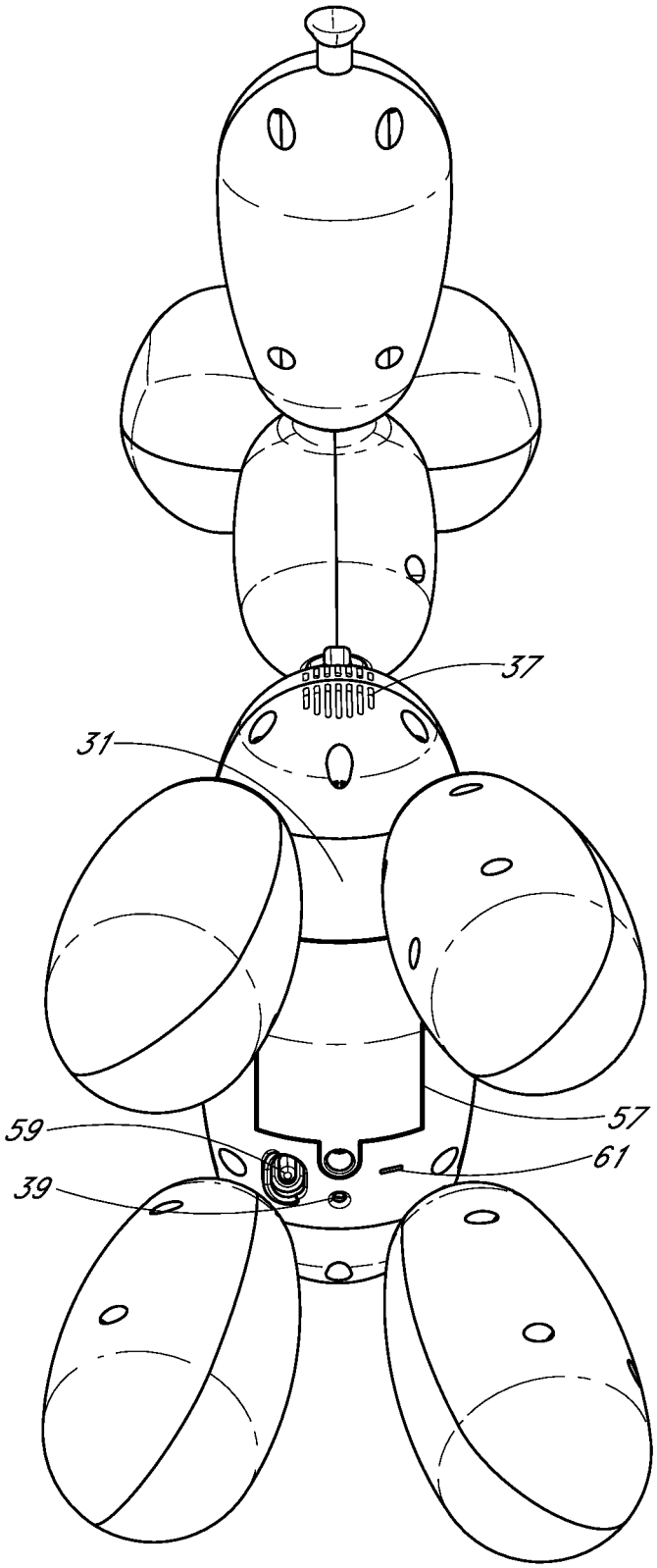
FIG. 14B is an exemplary bottom perspective view of the toy of FIG. 14A.

FIG. 14B is an exemplary bottom perspective view of the toy 1 of FIG. 14A. In certain embodiments, functions include one or more of 1) front and rear legs 25, 27 animate (Front and rear are independent, Left x Right can be locked together) to create numerous motions; 2) user can pet on the ears 29 and tummy 31 using a cap sensor 33, 35, respectively; 3) sound effects are played from the speaker 37; 4) the mouth 13 can be pulled to deflate the model 1 (electronically and the physical balloon 9); 5) the mouth 13 can be pushed in to inflate the model 1, when the pump is inserted and activated the physical balloon 9 can be inflated; 6) the dog 1 can simulate peeing by emitting a light 39, such as a yellow LED; and 7) a hall sensor 41 in the snout 42 can detect the presence of the feeding bowl 45 and start a feeding sequence. In certain embodiments, the toy 1 comprises a push/pull switch 43. In certain embodiments, the toy 1 comprises one or more flexible joints 47. In certain embodiments, all of the joints 47 are flexible except for the leg joints. In certain embodiments, the toy 1 comprises a microphone 49 (see FIG. 20). In certain embodiments, the toy 1 comprises a jiggle switch 51 (see FIG. 19). In certain embodiments, the toy 1 comprises one or more tilt switches 53. In certain embodiments, the feeding bowl 45 comprises a magnet 55. In certain embodiments, the toy 1 comprises a battery box 57. In certain embodiments, the toy 1 is powered by three AAA batteries. In certain embodiments, the toy 1 is powered by four AA batteries. In certain embodiments, the toy 1 comprises an on/off switch 59. In certain embodiments, the toy 1 comprises a slot 61 configured for a pull tab. Removal of the pull tab from the slot 61 triggers an unboxing experience of the toy 1.

Figure 15A:
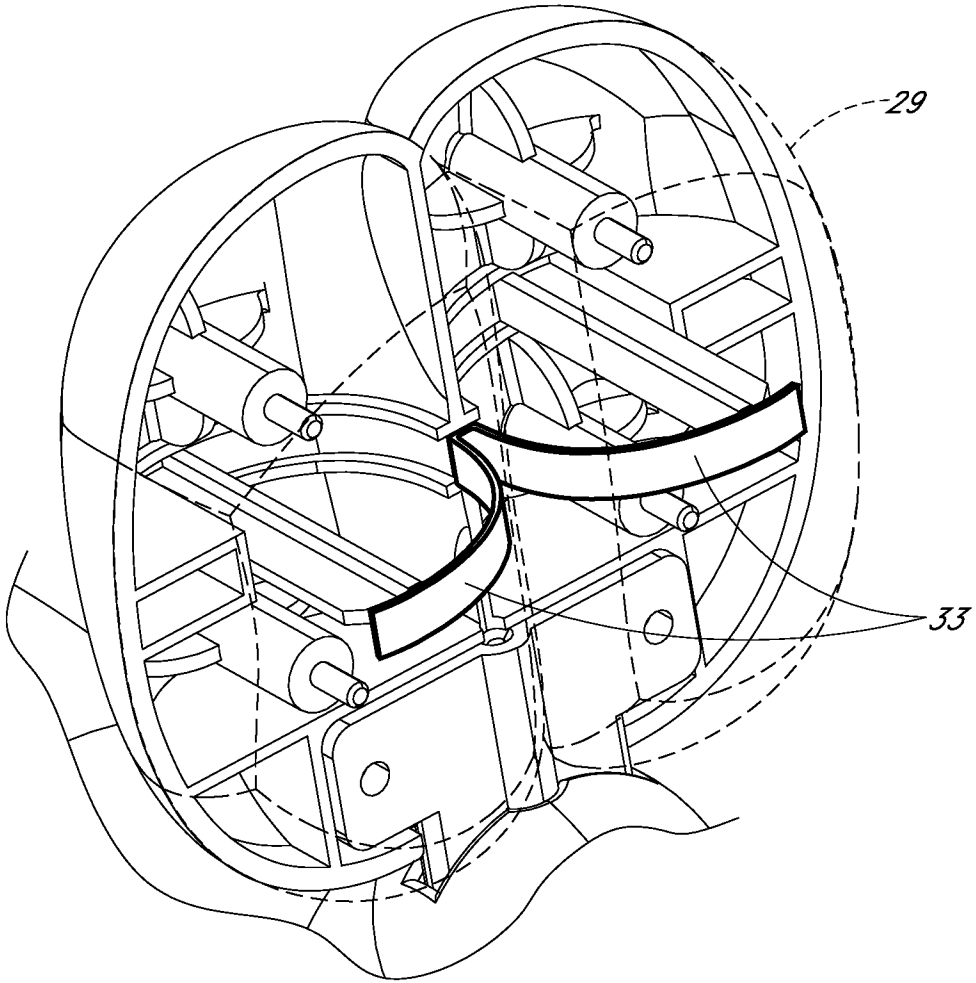
FIGS. 15A and 15B are views of portions of the toy from FIG. 14A.
Figure 15B:
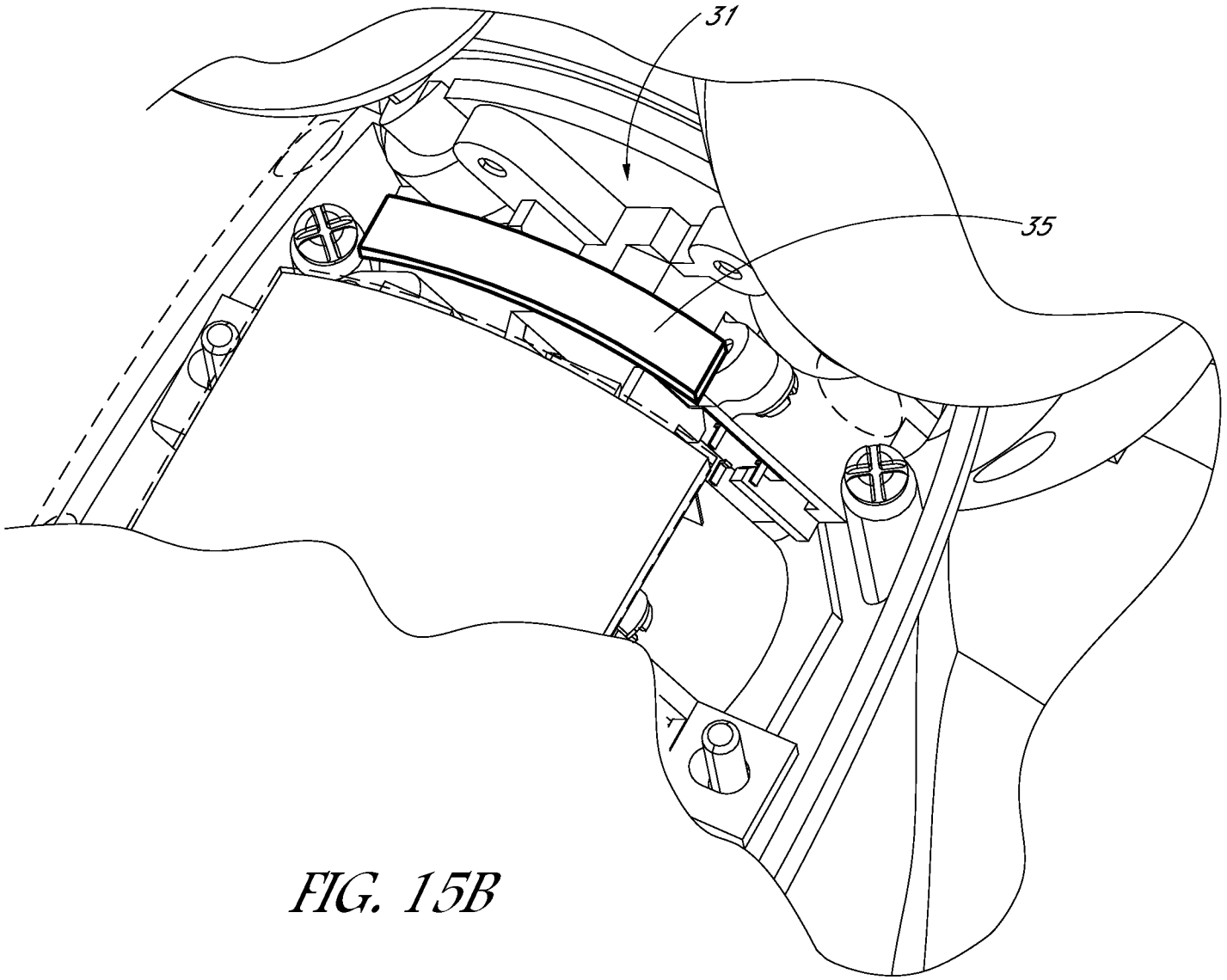

FIGS. 15A and 15B are views of portions of the toy 1 from FIG. 14A showing touch sensors 33, 35. Head patting can include use of a metal plate 33 behind the front surface of the ears 29 to detect hand patting. Example action: sitting. Tummy 31 scratching can include a metal plate 35 under the surface of the lower main shell to allow the user to simulate 'scratching' the dog's tummy 31. Example action: tickle.

Figure 16A:
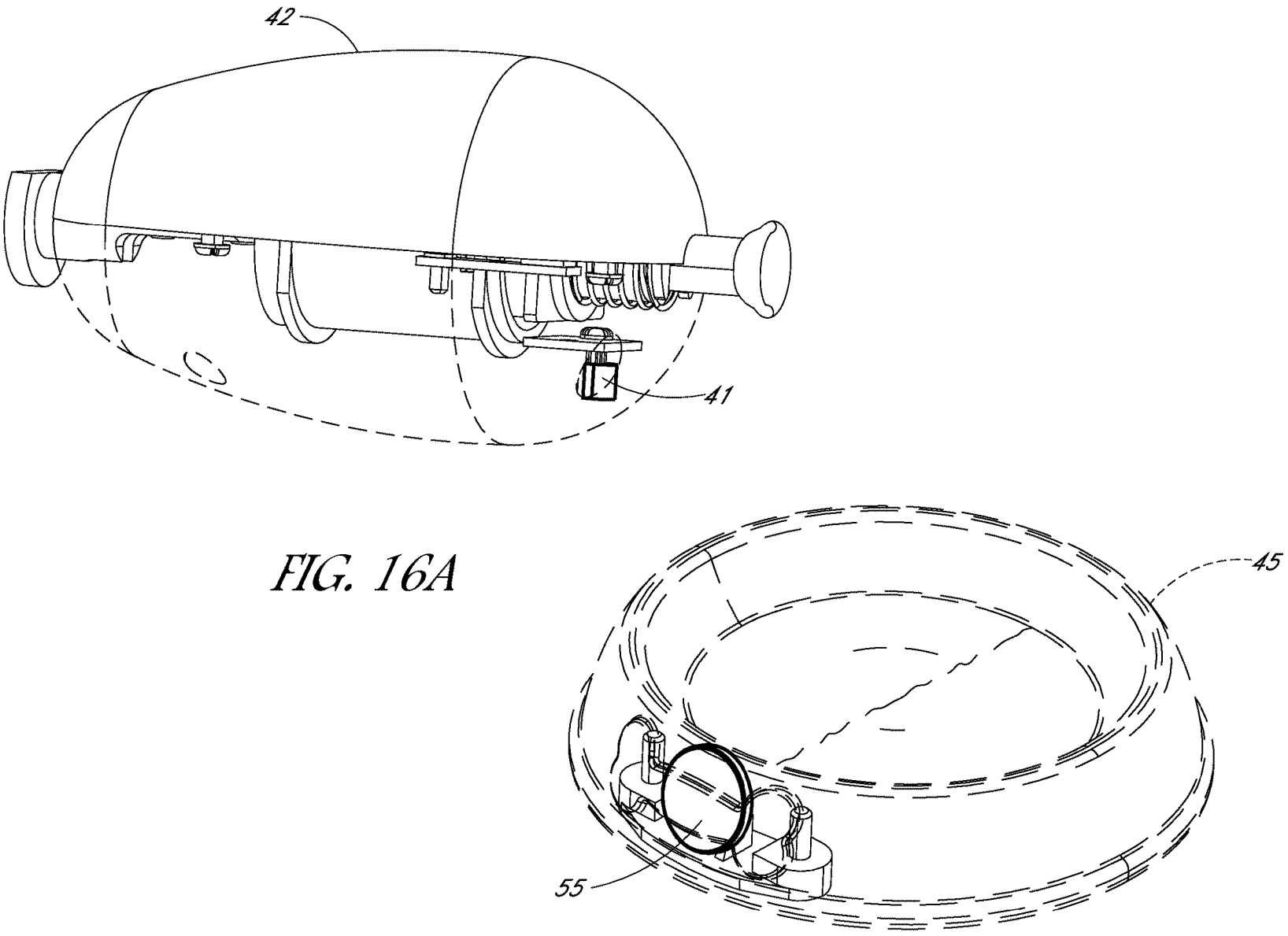
FIGS. 16A and 16B are views of a feeding play pattern performed by the toy of FIG. 14A.
Figure 16B:
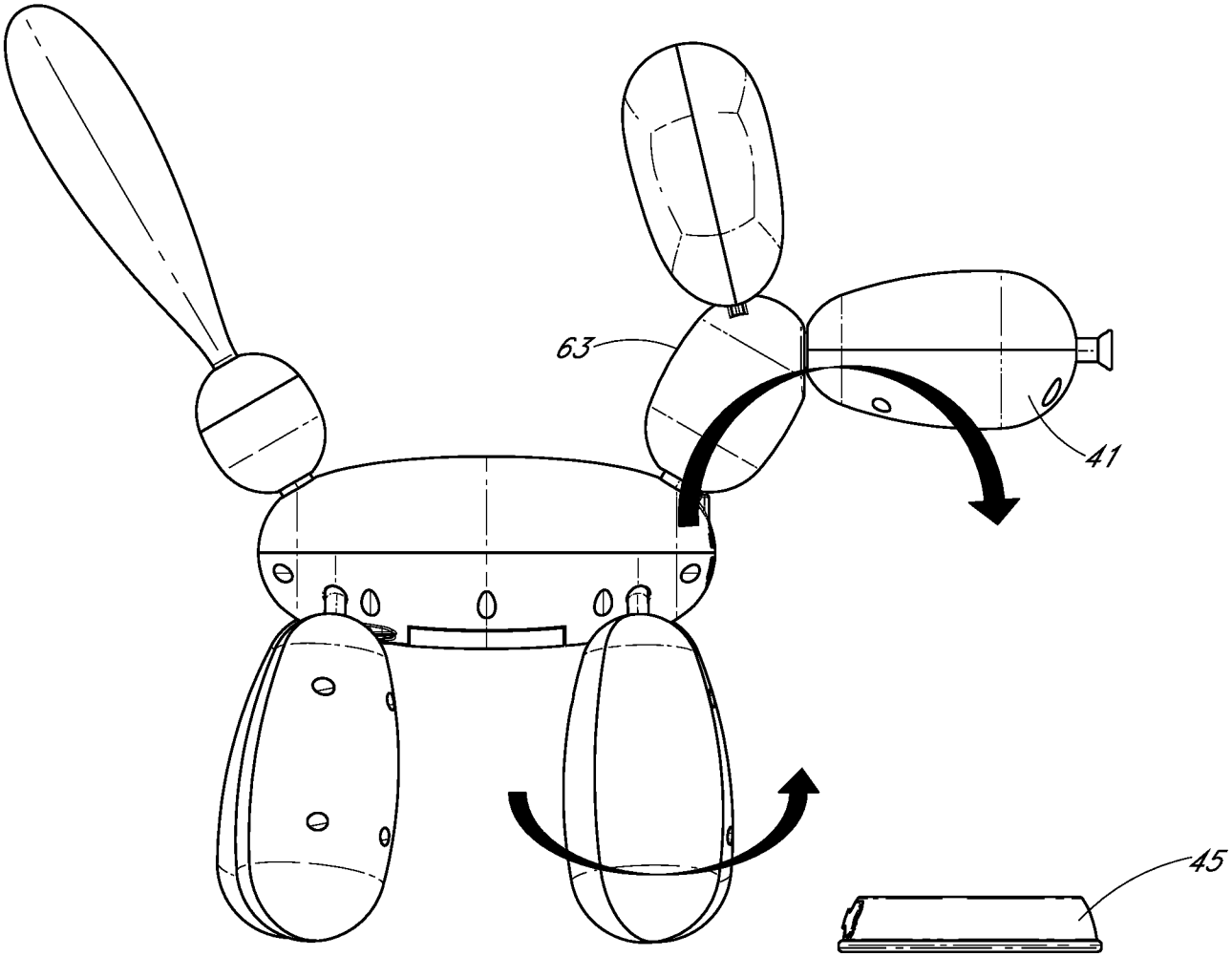

FIGS. 16A and 16B are views of a feeding play pattern performed by the toy 1 of FIG. 14A. In certain embodiments, the user can start the feeding action by holding the bowl 45 accessory up to the dog's mouth 13 (aligned with bone symbol on bowl 45). In certain embodiments, a magnet 55 in the bowl 45 is detected by a hall sensor 41 in the toy 1. In certain embodiments, after the user initiates the feeding sequence, they can place the feeding bowl 45 on the ground. In certain embodiments, the front leg 25 will animate (A) causing the head 63 to dip into the feeding bowl (B) 45 and raise back up.

Figure 17A:
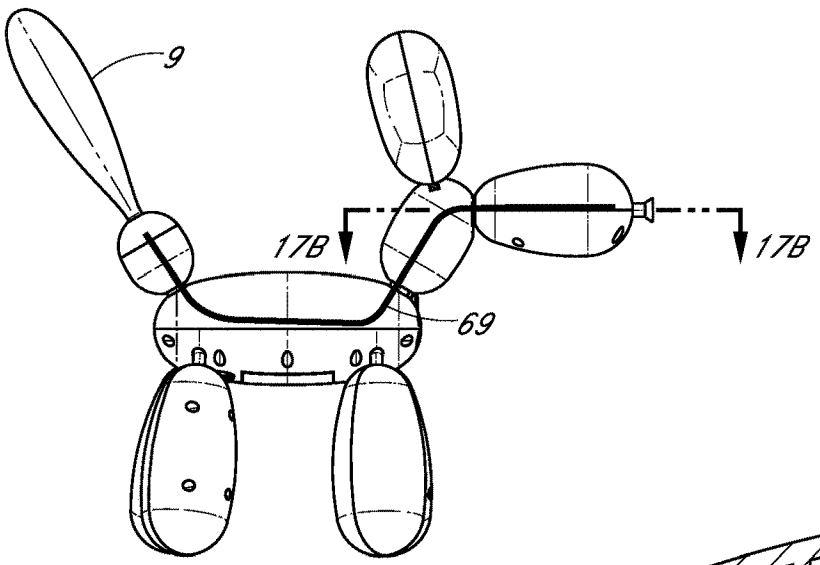
FIGS. 17A and 17B are views of an inflating play pattern performed by the toy of FIG. 14A.
Figure 17B:
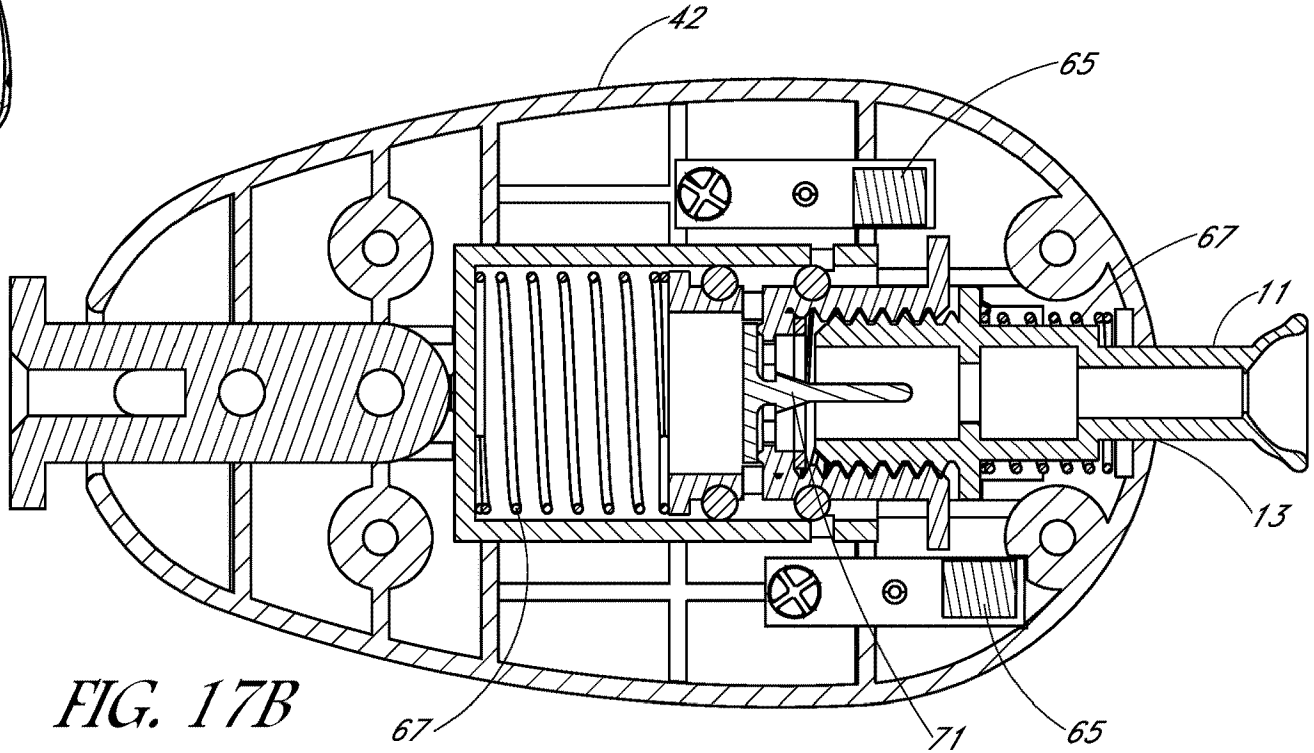

FIGS. 17A and 17B are views of an inflating play pattern performed by the toy 1 of FIG. 14A. In certain embodiments, when the nozzle 11 is pressed in by the user (either with the pump tip or finger) the movement is detected by a micro switch 65. Two opposing springs 67 hold the nozzle 11 in a central position. After detecting this action, the animation and sound effects replicate the item being 'pumped up', moving from a flat position to a standing position. In certain embodiments, when the pump is inserted into the nozzle 11 the user can inflate the balloon 9 attached to the tail. There can be a continuous tube 69 running from the mouth valve assembly to the balloon adapter. A check valve 71 in the valve assembly can prevent air from escaping from the balloon 9 after inflation.

Figure 18A:
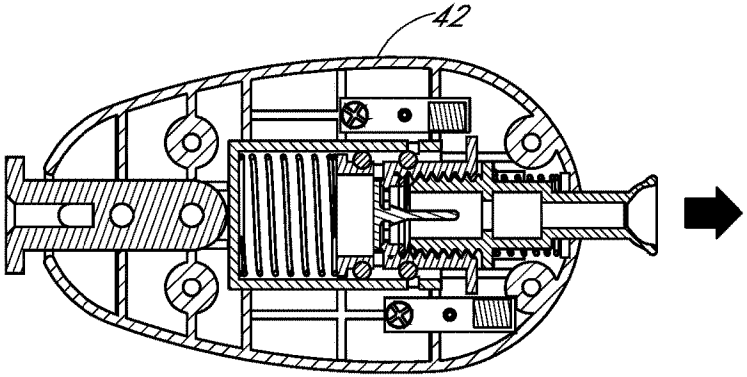
FIGS. 18A and 18B are views of a deflating play pattern performed by the toy of FIG. 14A.
Figure 18B:
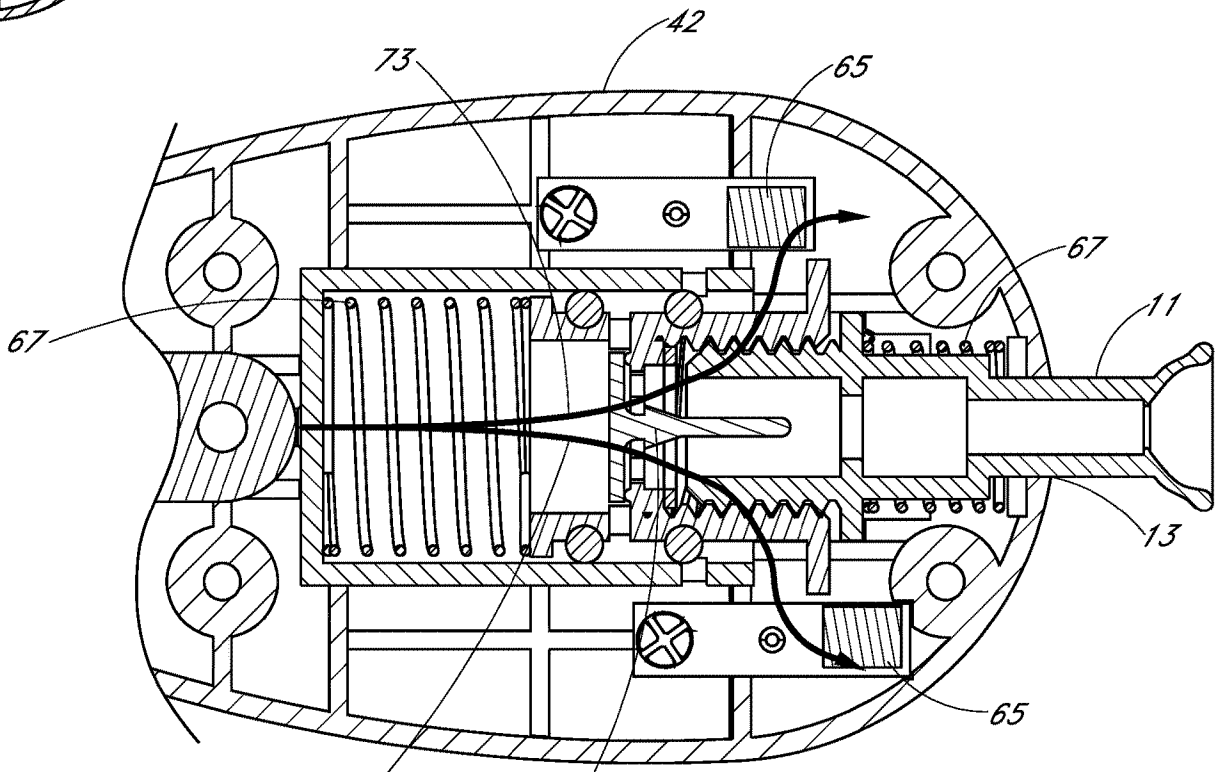

FIGS. 18A and 18B are views of a deflating play pattern performed by the toy 1 of FIG. 14A. In certain embodiments, when the nozzle 11 is pulled outwards, the movement is detected by a micro switch 65. After detecting this action, the animation and sound effects replicate the item being 'deflated', moving from a standing position to a flat position. In certain embodiments, when the nozzle 11 is pulled out an air escape port 73 is opened, allowing air to escape from the balloon 9.

Figure 19:
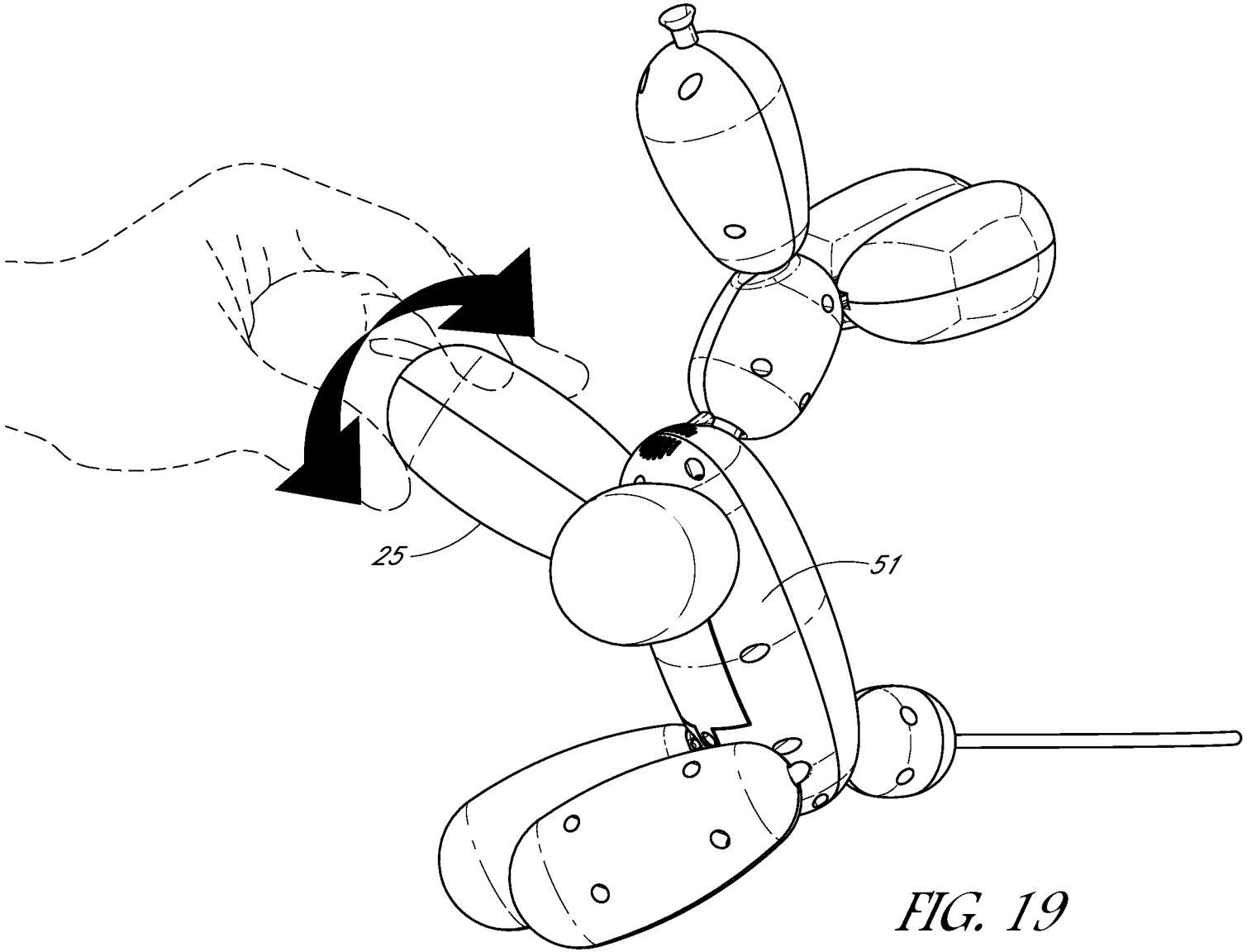
FIG. 19 is a view of a paw shake play pattern performed by the toy of FIG. 14A.

FIG. 19 is a view of a paw shake play pattern performed by the toy 1 of FIG. 14A. In certain embodiments, while in the sitting position, the user can 'shake' the dog's paw 25. This is detected by a jiggle switch 51 in the main body. The jiggle switch 51 is only active during this part of the play pattern, so as not to cause false trigger events. After detecting this an animation and sound effects can occur.

Figure 20:
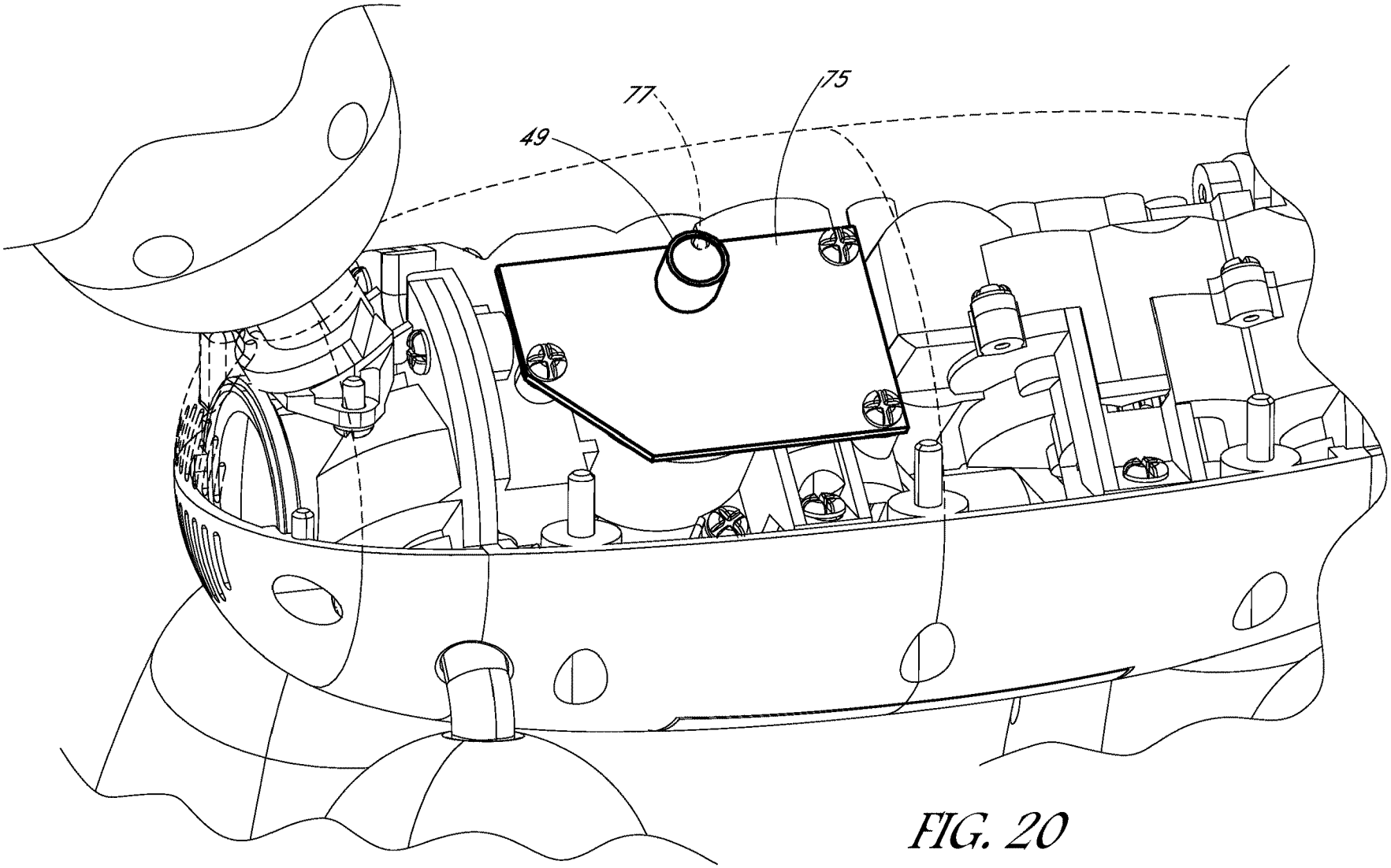
FIG. 20 is a view of a microphone play pattern performed by the toy of FIG. 14A.

FIG. 20 is a view of a microphone play pattern performed by the toy 1 of FIG. 14A. In certain embodiments, a microphone 49 is mounted on the main PCB 75. Sound travels from a small hole 77 in the main housing above the microphone 49. The dog 1 can react in various ways to sounds detected by this microphone 49.

Figure 21A:
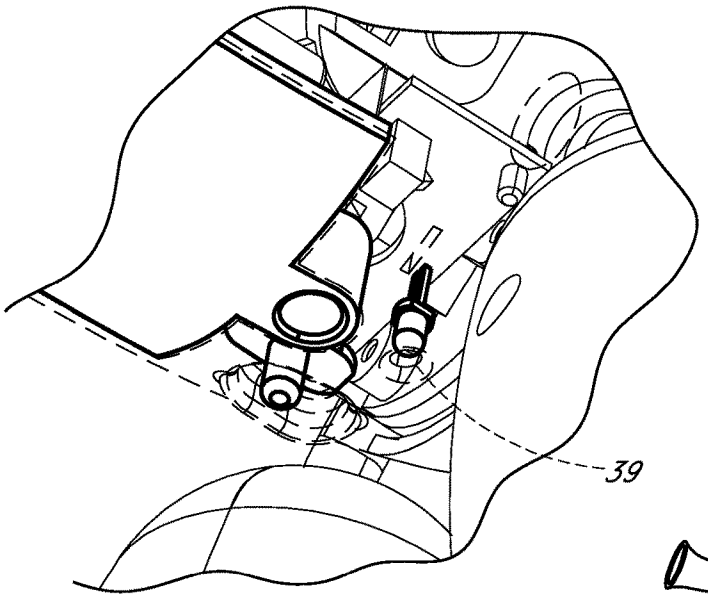
FIGS. 21A-21C are views of a pee/fart play pattern performed by the toy of FIG. 14A.
Figure 21B:
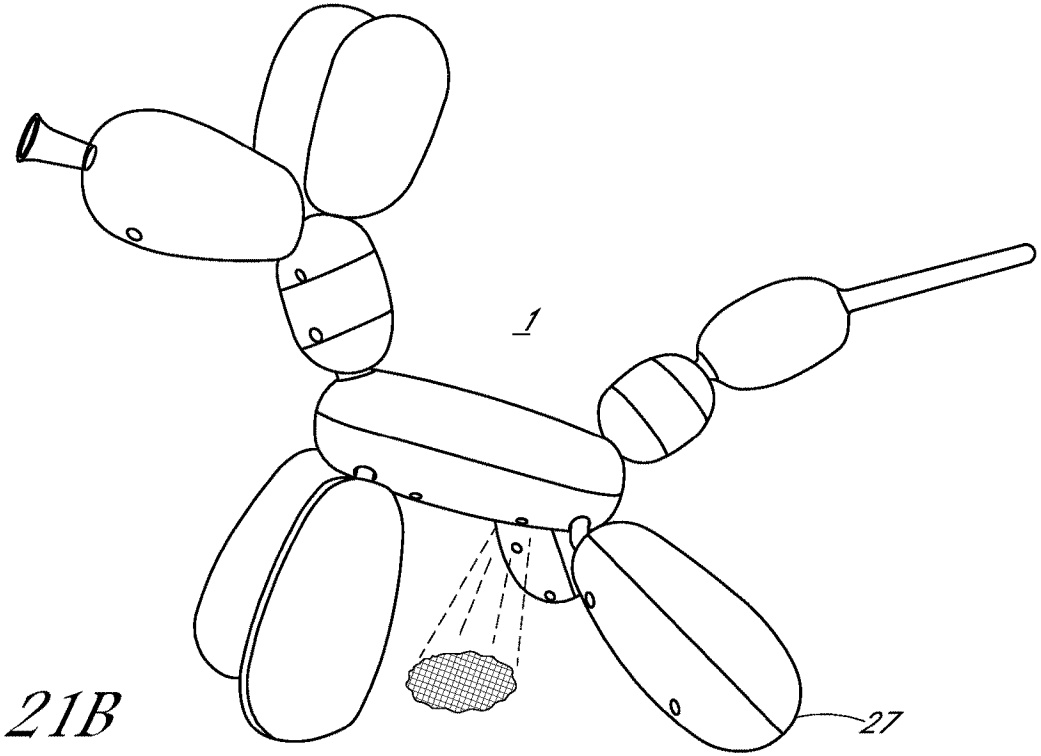
Figure 21C:
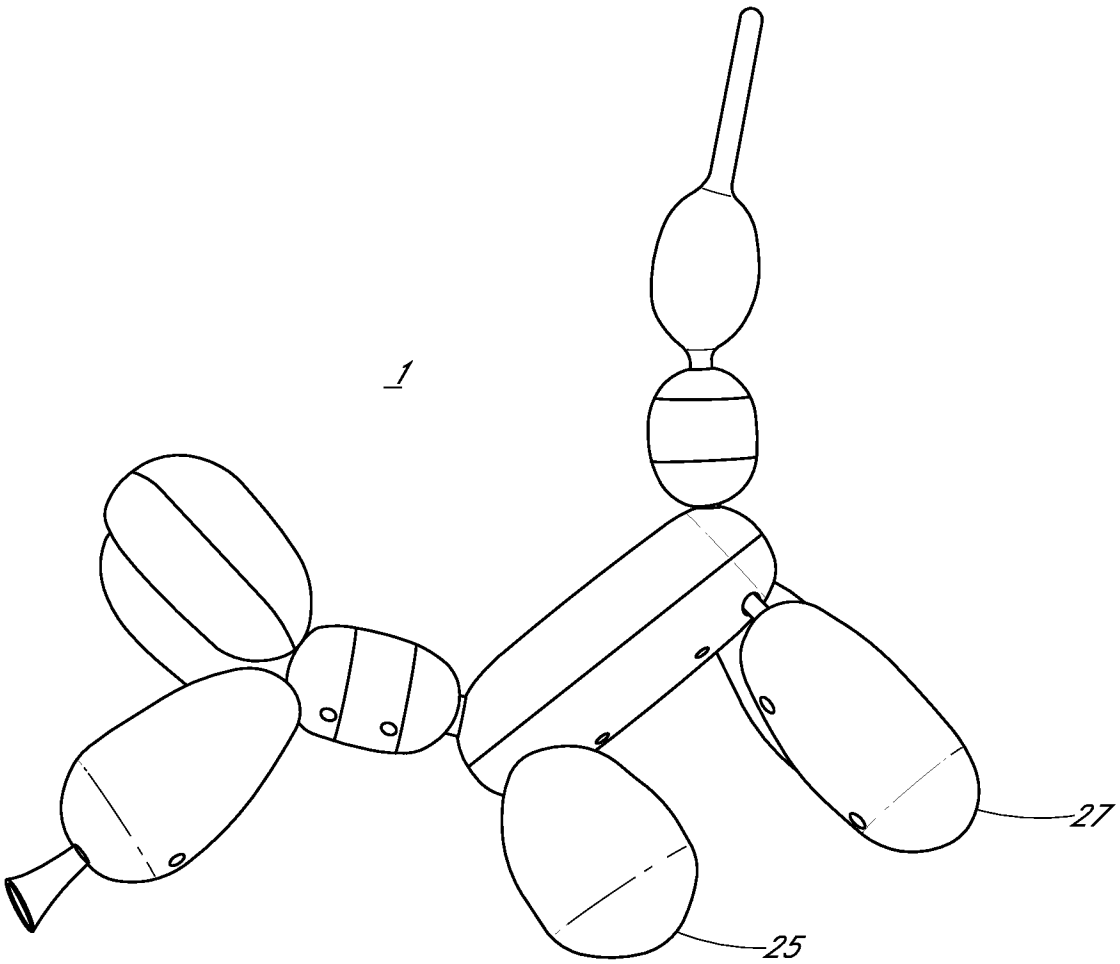

FIGS. 21A-21C are views of a pee/fart play pattern performed by the toy 1 of FIG. 14A. In certain embodiments, after feeding the dog 1 will either pee (FIG. 21B) or fart (FIG. 21C). Prior to peeing the dog 1 can 'wimper' and scoot about. During peeing the rear legs 27 rotate to drop his rear and a light 39, for example a yellow LED, illuminates with matching sound effects to simulate peeing. In certain embodiments, after feeding the dog 1 will either pee or fart. When the dog 1 is to fart, it drops its front end by rotating the front legs 25 and makes a farting sound. Afterwards it falls over before standing up again.

Figure 22A:
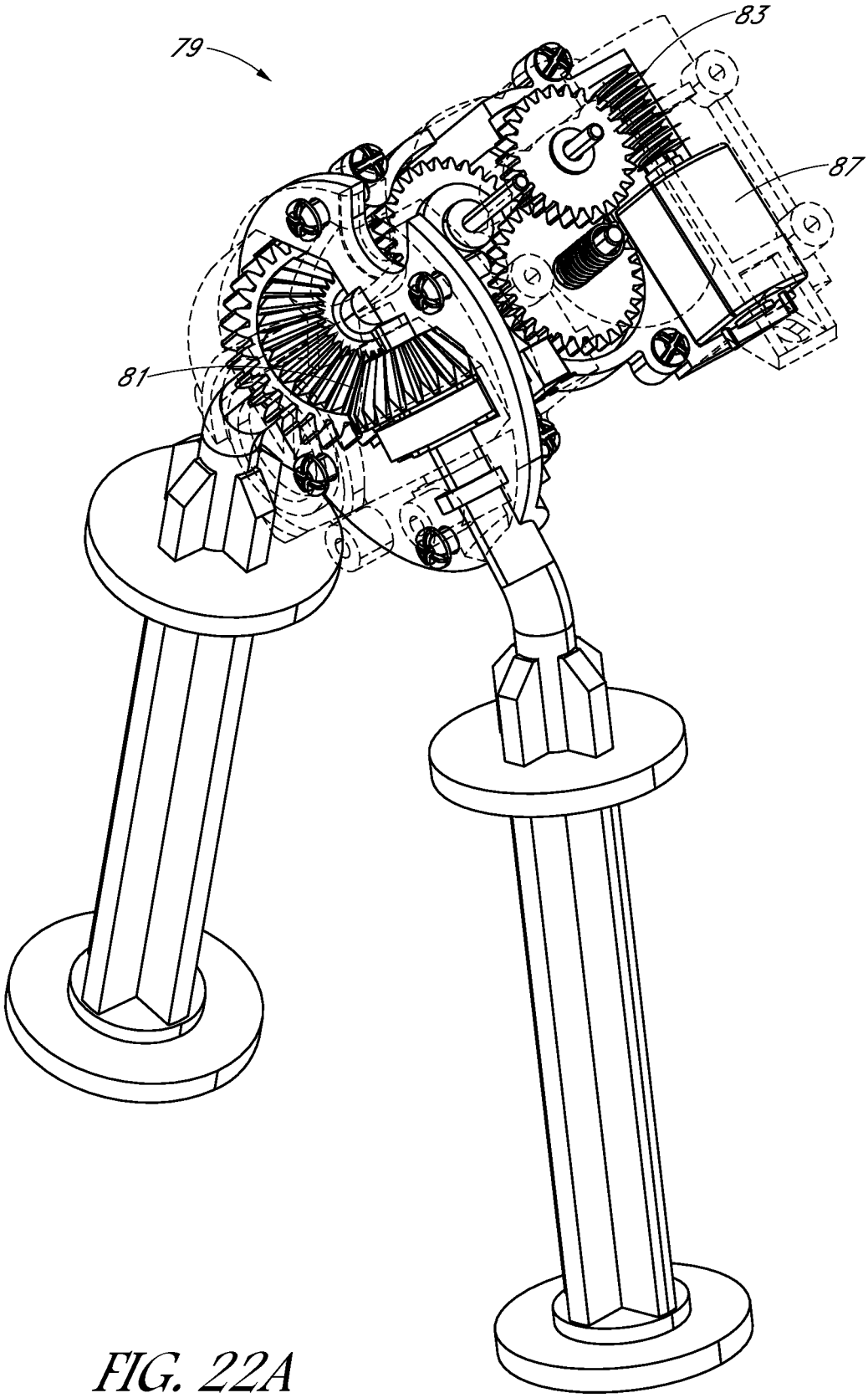
FIGS. 22A and 22B are views of a gearbox of the toy of FIG. 14A.
Figure 22B:
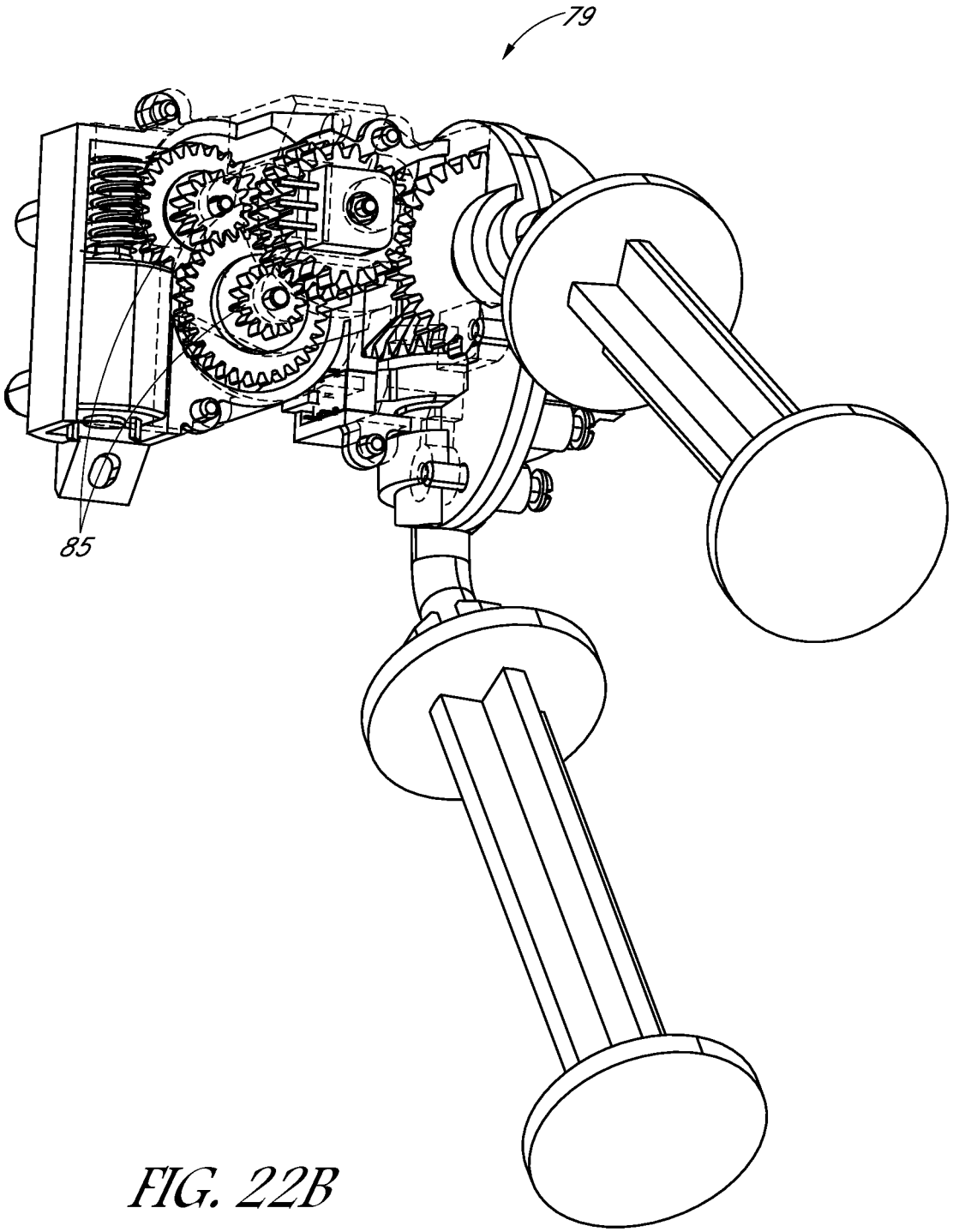

FIGS. 22A and 22B are views of a gearbox 79 of the toy 1 of FIG. 14A. In certain embodiments, the gearbox 79 is designed to be sub assembled and modular. Two identical gearbox 79 assemblies make up each dog assembly. The two legs 25, 27 can be permanently linked via a large bevel gear 81. A ratio is achieved through a combination of worm 83 and spur 85 gears. A clutch exists between the motor 87 and output and can prevent damage to the gears and allow abuse play. The gearbox 79 can be made up of two shell halves that are aligned with the drive axis of one leg 25, 27. Two end plates support the leg pivots and attach to the gearbox main halves. PCB mounts, end cap screw bosses and speaker mounts can be incorporated into the gearbox 79. The position sensor(s) can work directly on the output, so are not impacted by the clutch being activated.

Figure 23B:
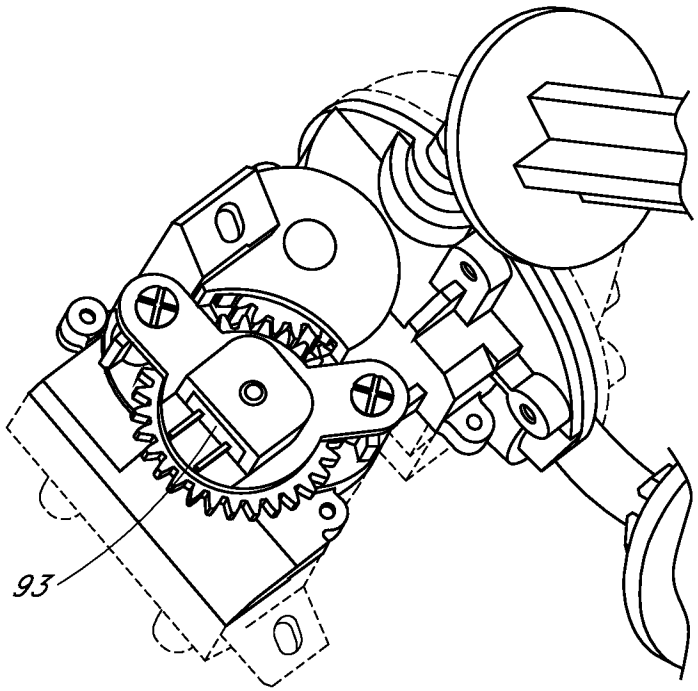
FIGS. 23A and 23B are views of gearbox sensors that can be used with the gearbox of FIGS. 22A and 22B.
Figure 23A:
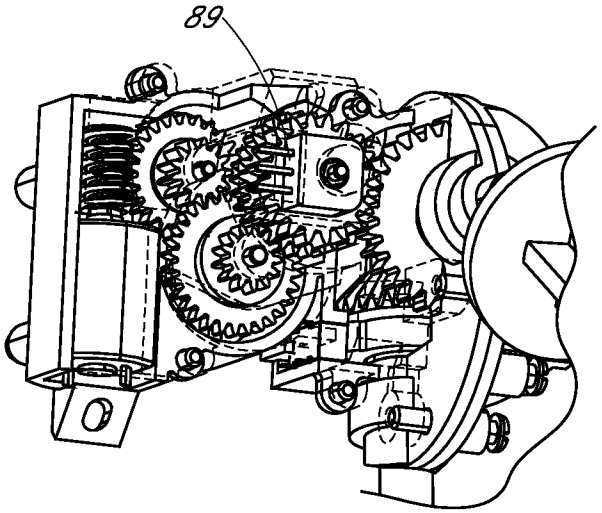

FIGS. 23A and 23B are views of gearbox sensors that can be used with the gearbox 79 of FIGS. 22A and 22B. Exemplary methods for detection of the position of each leg pair 25, 27 include 1) digital encoder 89 with home switch 91; and 2) continuous rotation potentiometer 93. For example, the encoder method can use a standard mechanical encoder 89. In certain embodiments, the encoder 89 is absolute and is geared to the output of the leg 25, 27 with a 1:1 relationship. In certain embodiments, the toy 1 includes a separate 'home' switch 91 to address component and build tolerances. The system can home each time it is switched ON. For example, the potentiometer method can use a continuous rotation potentiometer 93. A voltage can be read to determine the current position.

Figure 24B:
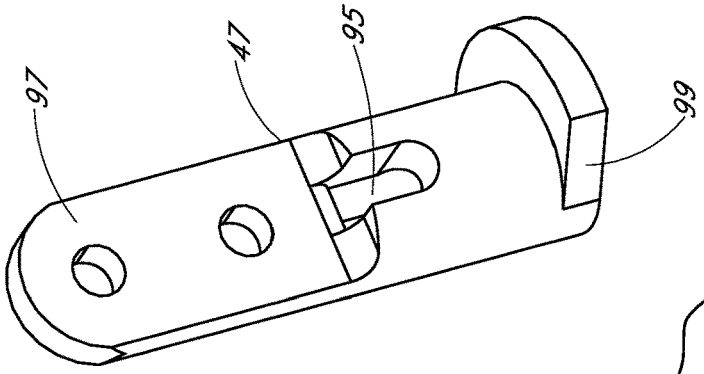
FIGS. 24A and 24B are views of a limb joint of the toy of FIG. 14A.
Figure 24A:
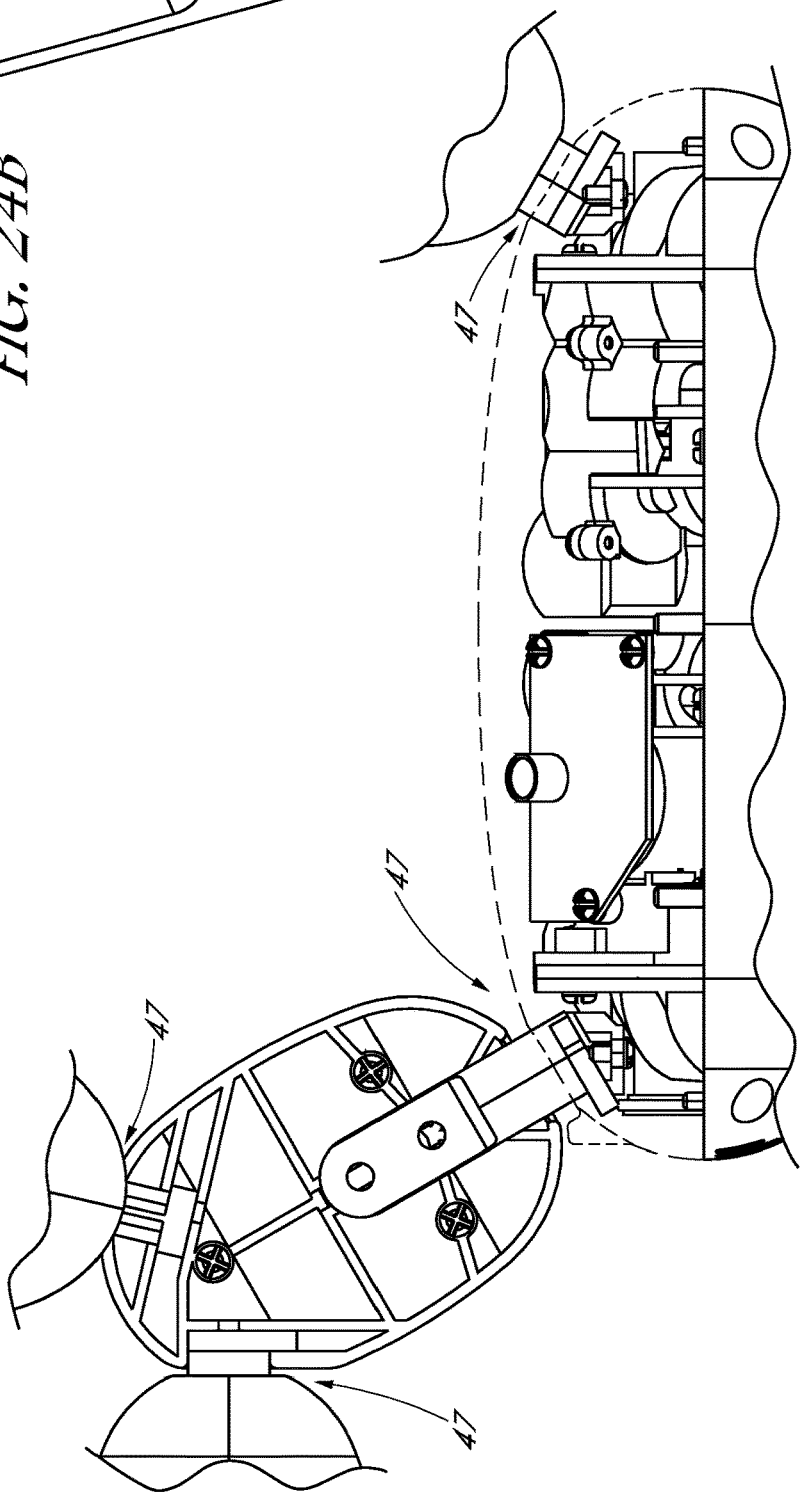

FIGS. 24A and 24B are views of a limb joint 47 of the toy 1 of FIG. 14A. In certain embodiments, the limbs are attached with flexible joints 47 molded from PVC. The joints 47 can be springy allowing bounce with the animation movements. The wall thickness can be designed to prevent accidental damage. The joints 47 include a pass through passage 95 to allow the air hose and wires to travel through the item. In certain embodiments, the limb joint 47 comprises a clamp point 97. In certain embodiments, the limb joint 47 comprises a rotation control 99.

Figure 25:
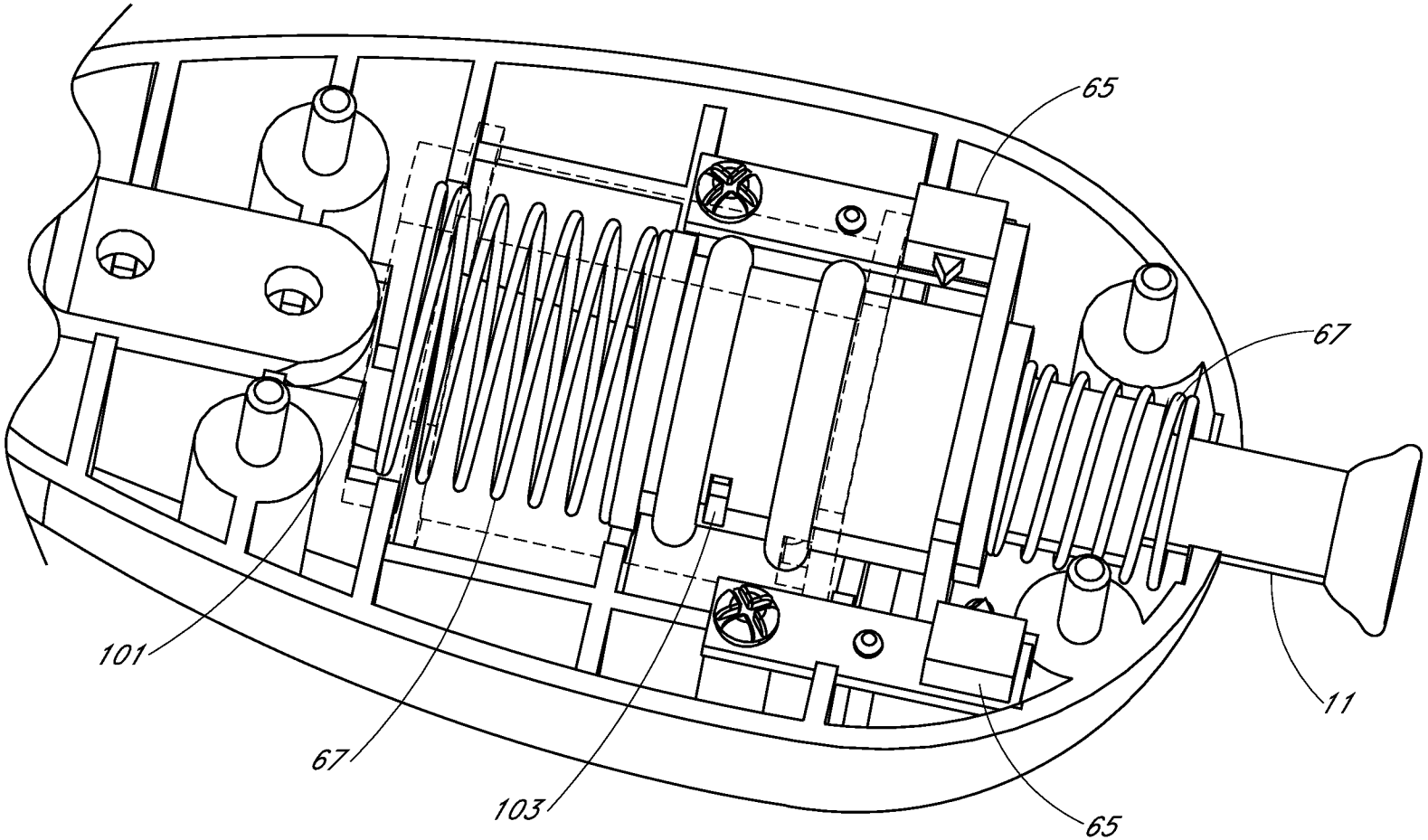
FIG. 25 is a view of a valve assembly of the toy of FIG. 14A.

FIG. 25 is a view of a valve assembly of the toy of FIG. 14A. In certain embodiments, the valve assembly performs one or more of the following functions 1) allow the nozzle 11 to move without the internal hose 101 moving/changing length; 2) provide detection for the position of the nozzle 11; 3) centers the nozzle 11 position (static position); 4) provide check valve 71 to keep air in the balloon tail 9; and/or 5) provides manual deflation port 103 to allow deflation of the tail balloon 9.

Figure 26B:
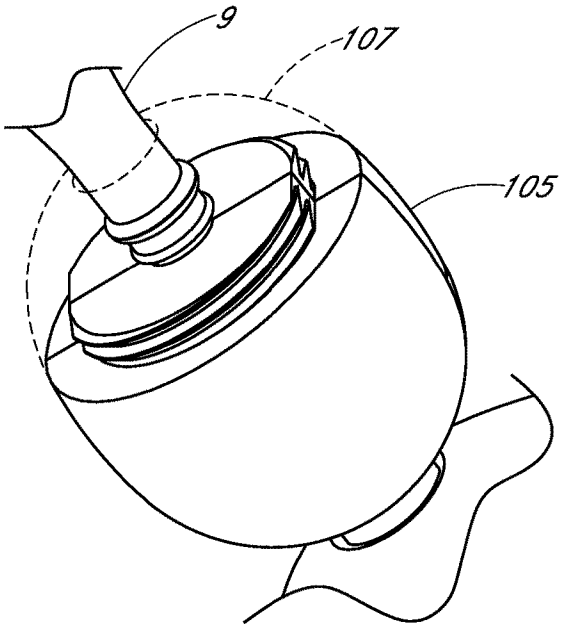
FIGS. 26A and 26B are views of a balloon assembly of the toy of FIG. 14A.
Figure 26A:
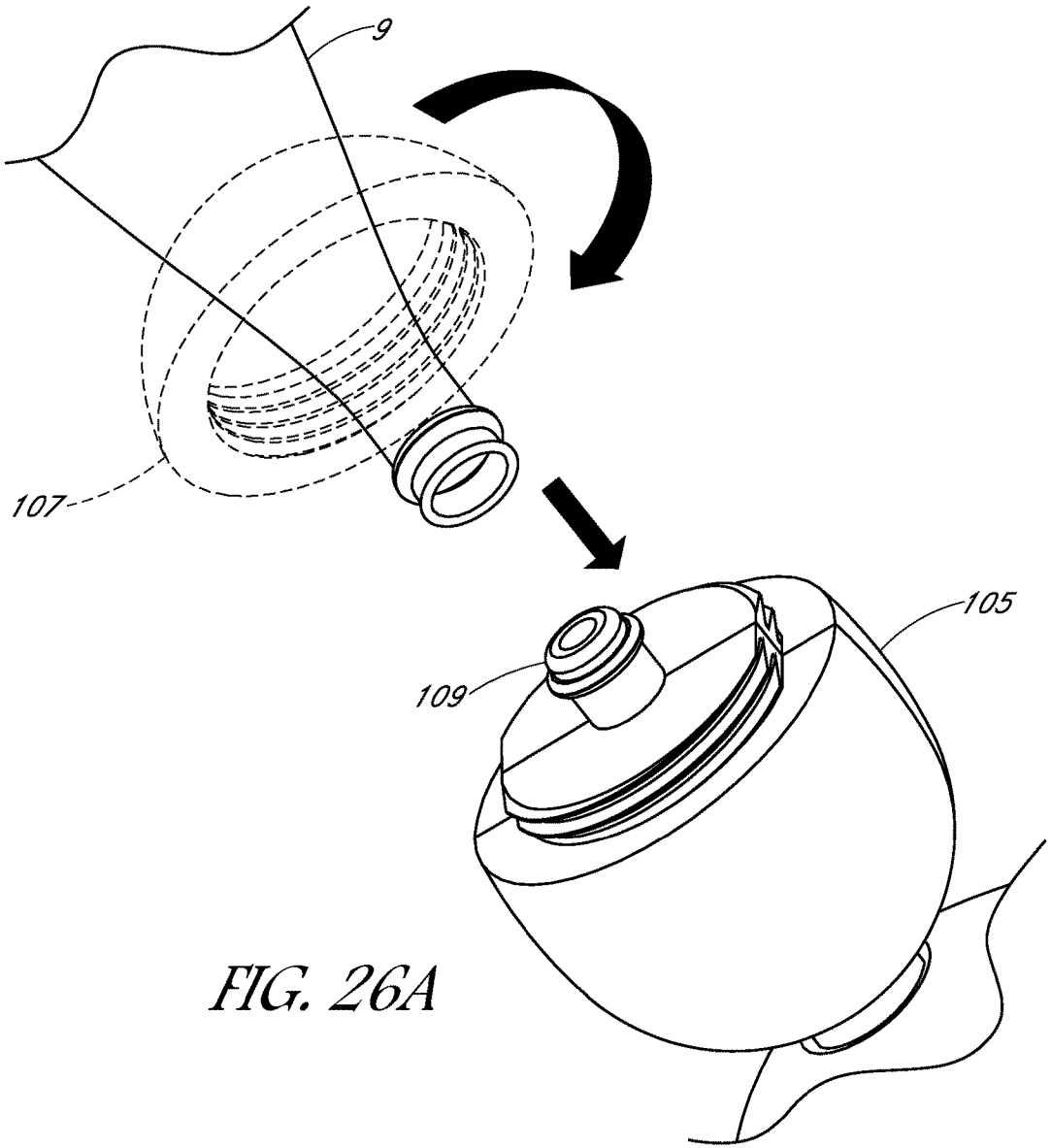

FIGS. 26A and 26B are views of a balloon assembly of the toy 1 of FIG. 14A. In certain embodiments, the balloon 9 is attached to the tail 105 by first slipping the end of the balloon 9 through the hole in the cap 107 and then placing the end over the outlet port 109. Following this the cap 107 can be screwed into place. The cap 107 ensures that the balloon 9 does not slip off the outlet port 109 under inflation pressure.

Figure 27:
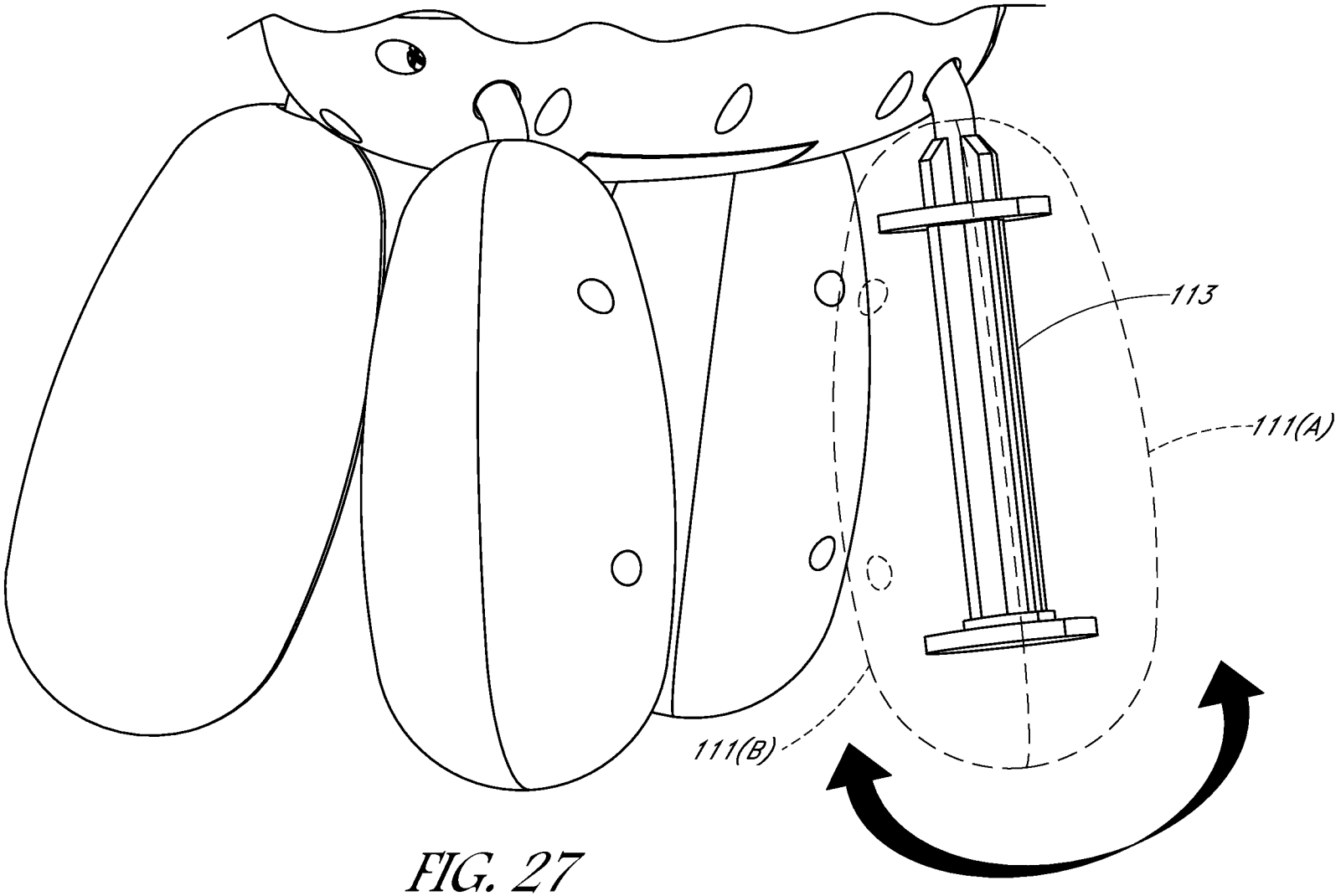
FIG. 27 is a view of a leg shell of the toy of FIG. 14A.

FIG. 27 is a view of a leg shell 111(A), (B) of the toy 1 of FIG. 14A. In certain embodiments, the leg shells 111(A), (B) are made of two parts that clamp around a thinner leg frame 113. In certain embodiments, there is no positional control and the legs 25, 27 are able to freely rotate around the inner frame.

Figure 28:
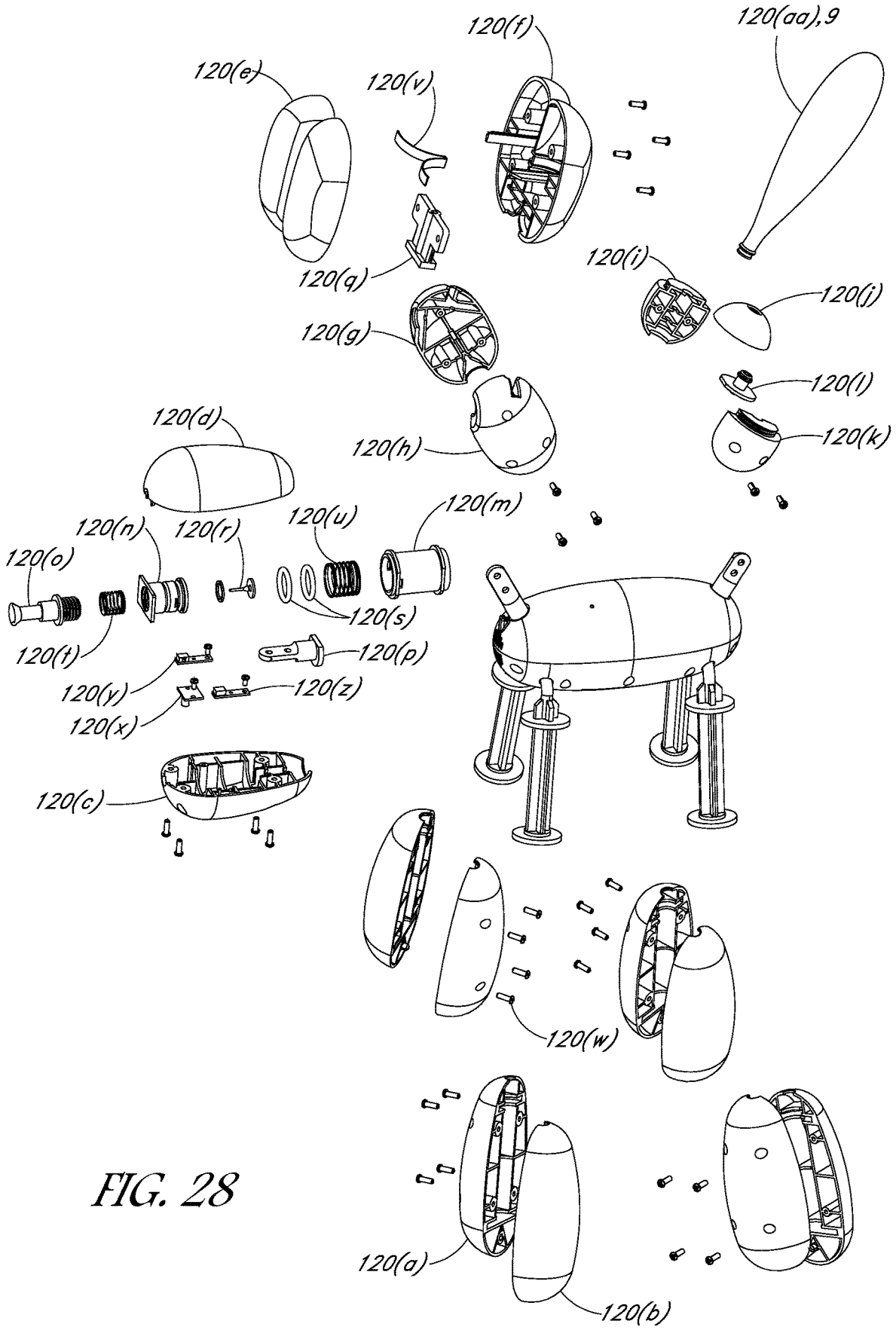
FIG. 28 is an exploded view of a first portion of the toy of FIG. 14A.

FIG. 28 is an exploded view of a first portion of the toy 1 of FIG. 14A. The illustrated embodiment comprises Leg Shell A 120(*a*), Leg Shell B 120(*b*), Snout Lower Shell 120(*c*), Snout Upper Shell 120(*d*), Ears Front Shell 120(*e*), Ears Rear Shell 120(*f*), Neck Shell A 120(*g*), Neck Shell B 120(*h*), Tail Shell A 120(*i*), Tail Tip Shell 120(*j*), Tail Shell B 120(*k*), Balloon Adapter 120(*l*), Valve Body 120(*m*), Valve Plunger 120(*n*), Mouth 120(*o*), 13, Snout Joint 120(*p*), Ear Joint 120(*q*), Check Valve 120(*r*), O-Ring 120(*s*), Spring A 120(*t*), Spring B 120(*u*), Cap Strip 120(*v*), Tapping Screw 120(*w*), Hall Sensor PCBA 120(*x*), Limit Switch PCBA 120(*y*), Limit Switch PCBA 120(*z*), and Balloon 120(*aa*). Of course, the first portion can include more or less than the components illustrated in FIG. 28.

Figure 29:
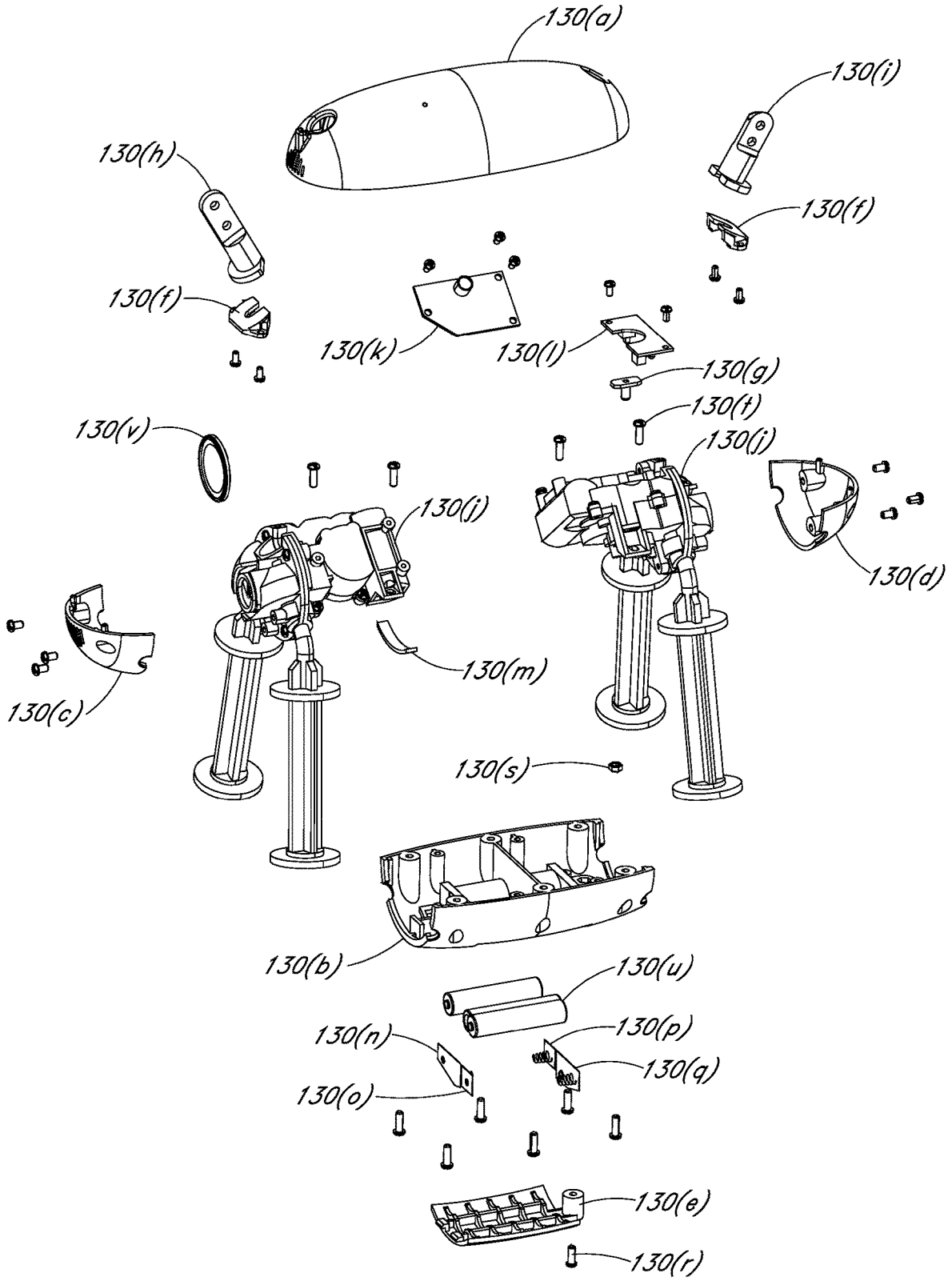
FIG. 29 is an exploded view of a second portion of the toy of FIG. 14A.

FIG. 29 is an exploded view of a second portion of the toy 1 of FIG. 14A. The illustrated embodiment comprises Upper Main Shell 130(*a*), Lower Main Shell 130(*b*), Front Lower Cap 130(*c*), Rear Lower Cap 130(*d*), Battery Door 130(*e*), Joint Retainer 130(*f*), Switch Cap 130(*g*), Neck Joint 130(*h*), Tail Joint 130(*i*), Inner Tube (Not Shown), Gearbox Sub Assy 130(*j*), Main PCBA 130(*k*), Switch PCBA 130(*l*), Cap Sensor Strip 130(*m*), Batt Term+/−130(*n*), Batt Term Pos 130(*o*), Batt Term Neg 130(*p*), Batt Term+/−130(*q*), Batt Door Screw 130(*r*), Batt Door Nut 130(*s*), Tapping Screw 130(*t*), Batt AAA 130(*u*), and Speaker 29 mm Metal 130(*v*).

Of course, the second portion can include more or less than the components illustrated in FIG. 29.

Figure 30:
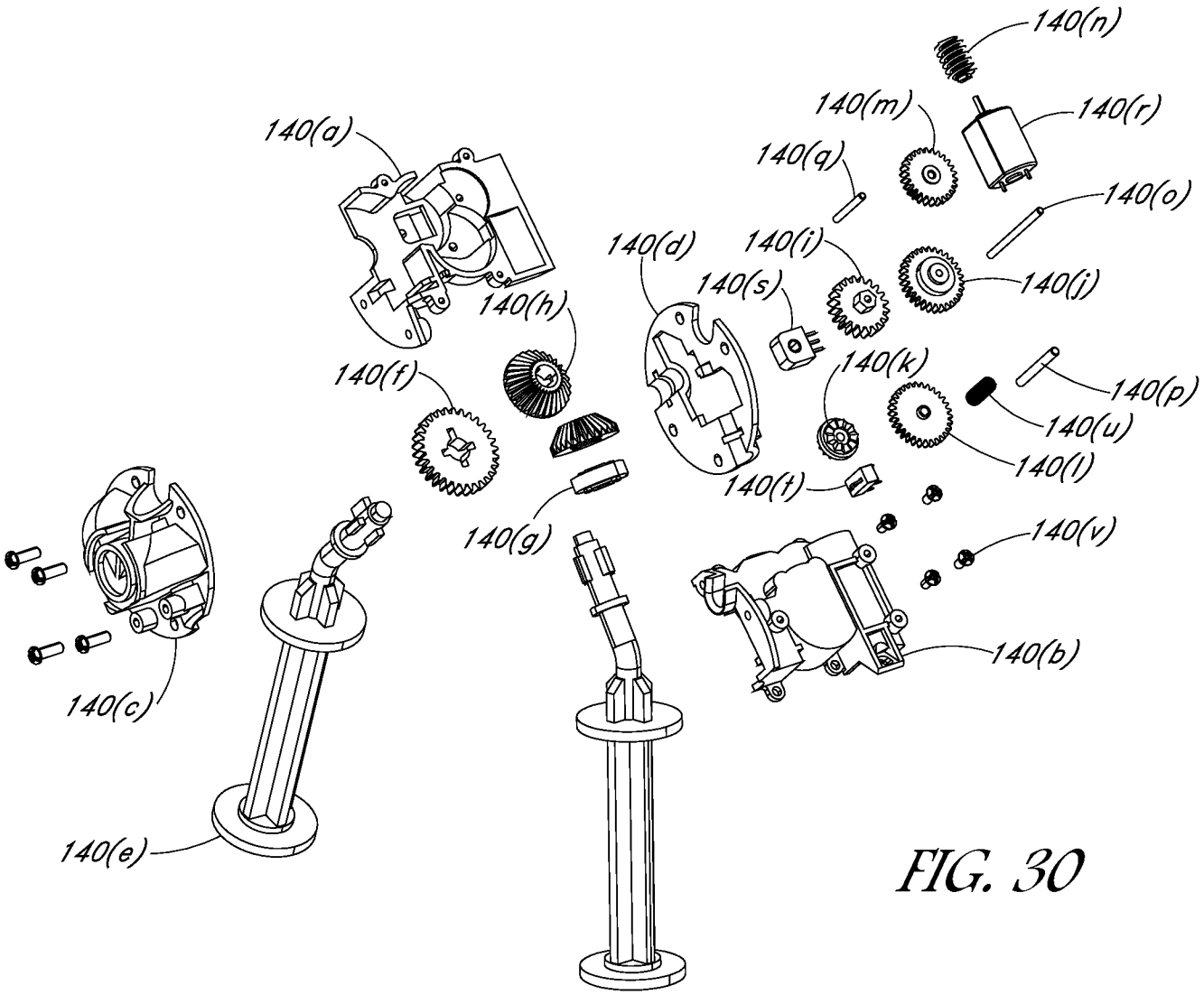
FIG. 30 is an exploded view of a third portion of the toy of FIG. 14A.

FIG. 30 is an exploded view of a third portion of the toy 1 of FIG. 14A. The illustrated embodiment comprises Main Housing A 140(*a*), Main Housing B 140(*b*), Bearing Support A 140(*c*), Bearing Support B 140(*d*), Leg Frames 140(*e*), Gear A 140(*f*), Home CAM 140(*g*), Gear B 140(*h*), Gear C 140(*i*), Gear D 140(*j*), Gear E 140(*k*), Gear F 140(*l*), Gear G 140(*m*), Gear H 140(*n*), Shaft A 140(*o*), Shaft B 140(*p*), Shaft C 140(*q*), Motor 140(*r*), Encoder 140(*s*), Micro Switch 140(*t*), Spring 140(*u*), and Tapping Screw 140(*v*). Of course, the third portion can include more or less than the components illustrated in FIG. 30.

Figure 31:
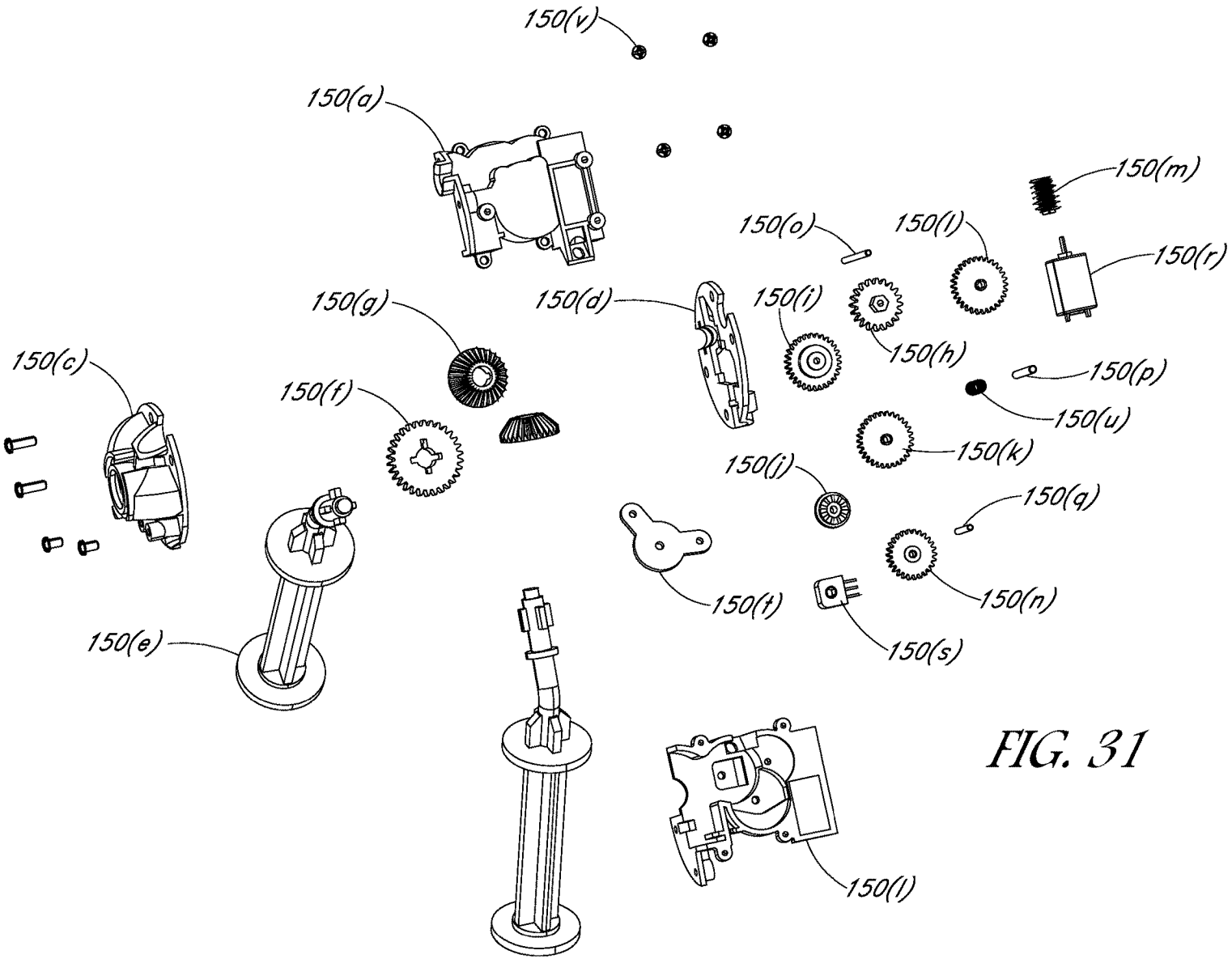
FIG. 31 is an exploded view of a fourth portion of the toy of FIG. 14A.

FIG. 31 is an exploded view of a fourth portion of the toy 1 of FIG. 14A.

The illustrated embodiment comprises Main Housing A 150(*a*), Main Housing B 150(*b*), Bearing Support A 150(*c*), Bearing Support B 150(*d*), Leg Frames 150(*e*), Gear A 150(*f*), Gear B 150(*g*), Gear C 150(*h*), Gear D 150(*i*), Gear E 150(*j*), Gear F 150(*k*), Gear G 150(*l*), Gear H 150(*m*), Gear I 150(*n*), Shaft A 150(*o*), Shaft B 150(*p*), Shaft C 150(*q*), Motor 150(*r*), Rotary Potentiometer 150(*s*), Pot Frame 150(*t*), Spring 150(*u*), and Tapping Screws 150(*v*). Of course, the fourth portion can include more or less than the components illustrated in FIG. 31.

Figure 32A:
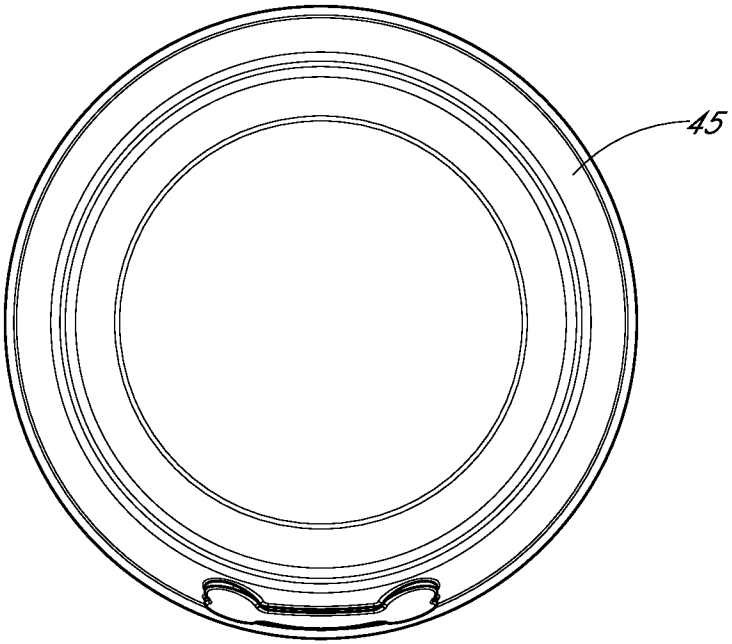
FIGS. 32A-32C are views of a feeding bowl for use with the toy of FIG. 14A.
Figure 32B:
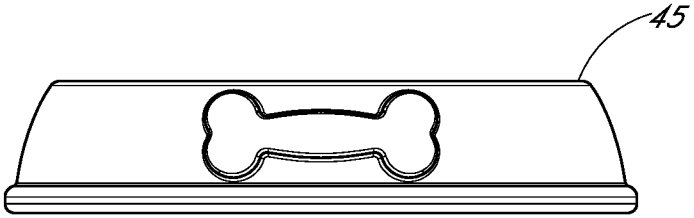
Figure 32C:
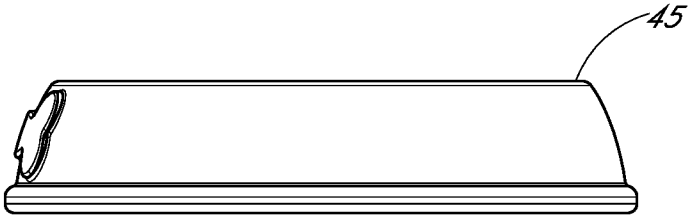
Figure 33:
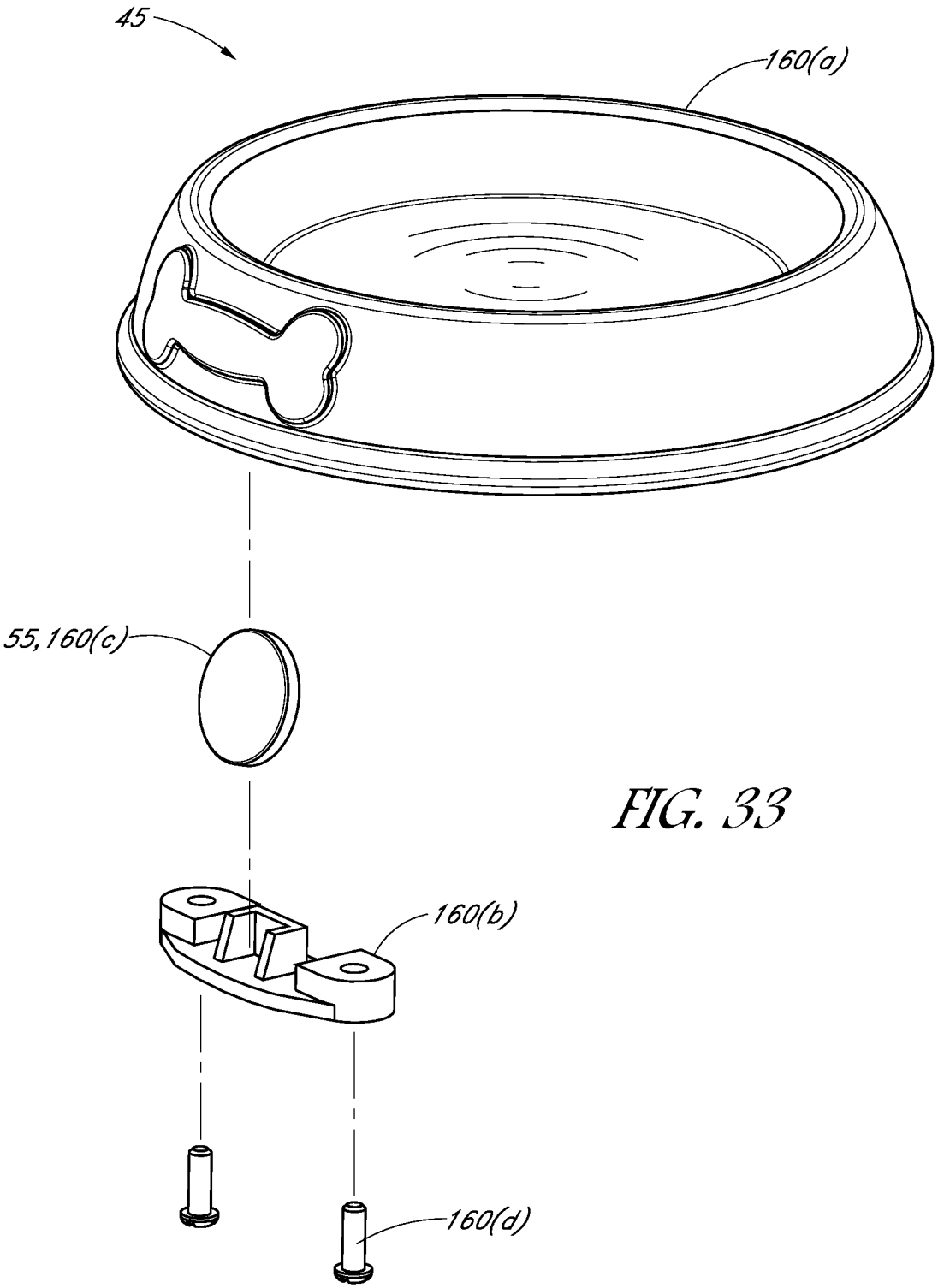
FIG. 33 are exploded views of the feeding bowl from FIG. 32A.

FIGS. 32A-32C are views of a feeding bowl 45 for use with the toy 1 of FIG. 14A. FIG. 33 is an exploded view of the feeding bowl 45 from FIG. 32A. The illustrated embodiment comprises Bowl 45, 160(*a*), Magnet Cover 160(*b*), Magnet 55, 160(*c*), and Tapping Screws 160(*d*). Of course, the feeding bowl 45 can include more or less than the components illustrated in FIGS. 32A-32C.

Figure 34:
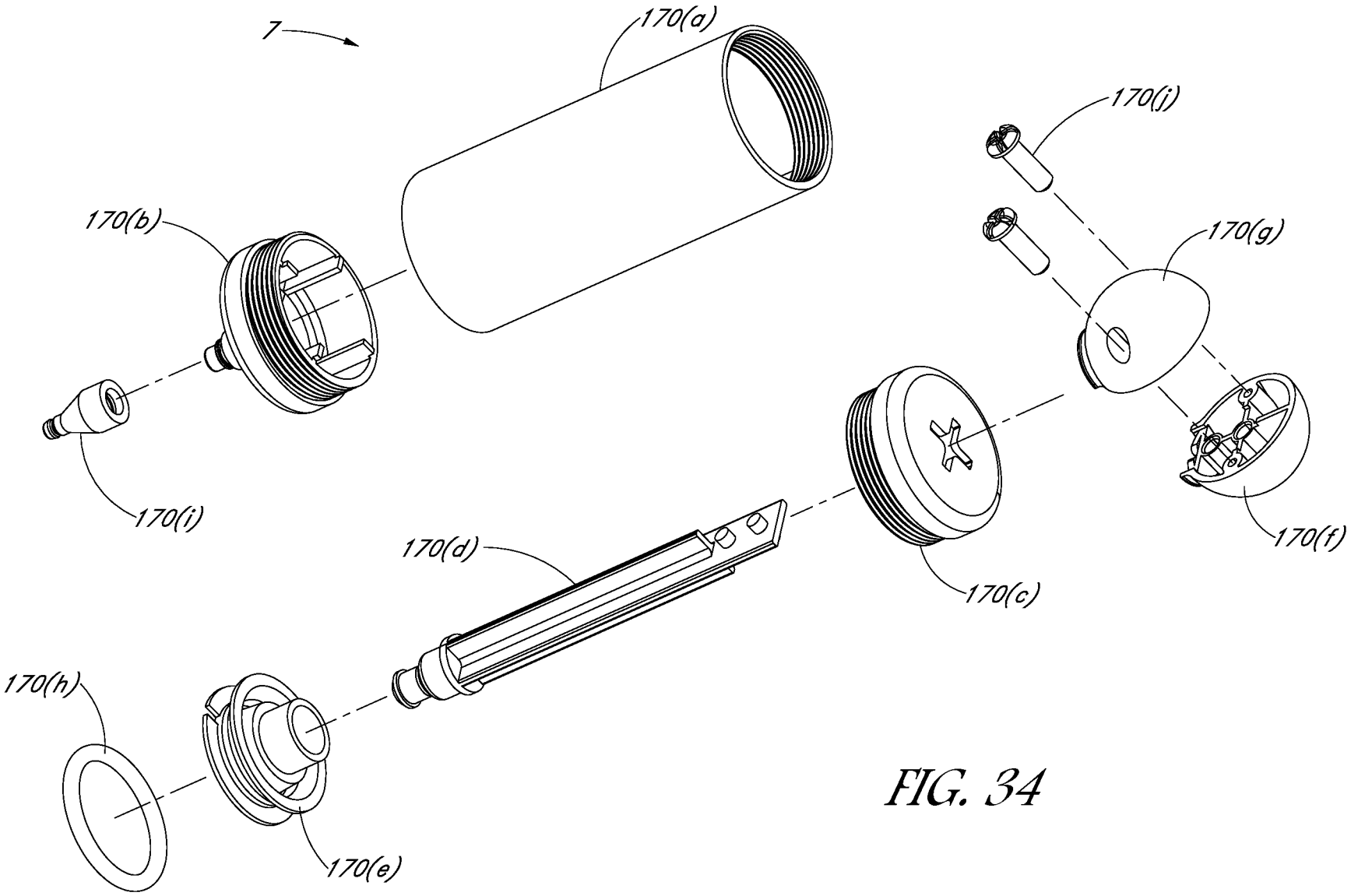
FIG. 34 is an exploded view of the accessory from FIG. 12A.

FIG. 34 is an exploded view of the accessory 7 from FIG. 12A. The illustrated embodiment comprises Pump Body 170(*a*), Nozzle Cap 170(*b*), End Cap 170(*c*), Plunger Rod 170(*d*), Plunger End 170(*e*), Handle A 170(*f*), Handle B 170(*g*), O-ring 170(*h*), Nozzle Tip 170(*i*), and Screw 170(*j*). Of course, the accessory 7 can include more or less than the components illustrated in FIG. 34.

Methods of Operation

In certain embodiments, the accessories 7 for the toy 1 include one or more of a pump/food, feeding bowl 45, and balloons 9. The balloons 9 can be replaced by unscrewing a tip of the tail.

In certain embodiments, the features/inputs of the toy 1 include petting the head. In certain embodiments, petting the head causes the toy 1 to alternate between a sitting position and an inflating position (for example, stands up from any position).

In certain embodiments, the features/inputs of the toy 1 include shaking the front limbs 25. In certain embodiments, this feature is only active when the toy 1 is in a sitting position.

In certain embodiments, the features/inputs of the toy 1 include pulling its nose 11. In certain embodiments, pulling the nose 11 causes the toy 1 to deflate (for example, face plants, then rolls on to his side—legs together).

In certain embodiments, the features/inputs of the toy 1 include placing the pump into the mouth 13 causes the toy 1 to inflate (for example, rolls back and stands).

In certain embodiments, the features/inputs of the toy 1 include using the pump to inflate the balloon 9 portion of the tail.

In certain embodiments, the features/inputs of the toy 1 includes bowl feeding. For example, bowl feeding can include holding the feeding bowl 45 to the mouth 13 and then placing the feeding bowl 45 on a table. The toy 1 will then eat from the feeding bowl 45 (for example, bobs head up and down to bowl).

In certain embodiments, the features/inputs of the toy 1 include after feeding to randomly select one of peeing (spreads legs and yellow LED light shines on table) and farting (deflates by face planting, then rolling on to the side of the toy with legs apart).

In certain embodiments, the features/inputs of the toy 1 include when the toy 1 is lying down to cry for the user to tickle the belly 31 or pick up the toy 1. In certain embodiments, the features/inputs of the toy 1 include to tickle the toy's stomach 31 causing the toy to shake its limbs 25, 27. In certain embodiments, this feature is only active when the toy 1 is lying down.

In certain embodiments, the features/inputs of the toy 1 include use of a microphone 49. The toy 1 reacts when the user makes sounds. For example, the toy 1 can bark back at you in response to the user making the sound.

In certain embodiments, the features/inputs of the toy 1 include a springy tail.

In certain embodiments, the features/inputs of the toy 1 include a tilt sensor 53 configured to determine when the toy 1 is upright or lying down.

In certain embodiments, the features/inputs of the toy include when there is no input. For example, when the user leaves the toy 1 alone the toy 1 will periodically perform random animations to get the user's attention. For example, if the user does not interact with the toy 1 for a long time, the toy 1 will eventually deflate.

In certain embodiments, the features/inputs of the toy 1 include an unboxing experience. For example, the unboxing experience can include taking the toy 1 out of its box to cause a pull tab to automatically activate the limbs 25, 27 to move to a splay position. If the user places the toy 1 on the ground when the toy 1 is in a deflated state, the toy 1 does not interact with the user. Once inflated, the toy 1 stands up and now becomes your interactive pet.

In certain embodiments, the features/inputs of the toy 1 includes a sound producing accessory. Exemplary sound producing accessories include a clicker, a squeaker, and a whistle. Of course, the sound producing accessory is not limited to the devices listed and further includes other devices known to a person having ordinary skill in the art. In certain embodiments, the sound producing device works with the microphone 49 to cause the toy 1 to move to a predetermined position. In certain embodiments, one sound causes the toy 1 to sit. Two repetitive sounds cause the toy 1 to roll over or beg. Three repetitive sounds cause the toy 1 to play dead. These positions are only exemplary.

In certain embodiments, the toy 1 detects a frequency of the sound created by the sound producing accessory. For example, in certain embodiments, the microphone 49 detects the sound. In certain embodiments, the toy 1 analyzes a frequency of the sound detected by the microphone 49. Based on the detected frequency, the toy 1 moves to a predetermined position. In certain embodiments, a first sound producing accessory creates a sound having a first frequency. In certain embodiments, a second sound producing accessory creates a sound having a second frequency. In certain embodiments, the toy 1 moves to a first predetermined position in response to a sound of the first frequency and to a second predetermined position in response to a sound of the second frequency. The number of positions and frequencies are only exemplary.

In certain embodiments, the features/inputs of the toy 1 include volume detection. In certain embodiments, in response to the user yelling, the toy whimpers. Eventually the toy can poop and then deflate. In certain embodiments, in response to the user talking softly, the toy acts happy and playful.

In certain embodiments, the features/inputs of the toy 1 include to call out to instigate play. In certain embodiments, when the user calls to the toy 1, the toy 1 performs a random animation to make it appear intelligent.

In certain embodiments, the features/inputs of the toy 1 include playing tug of war with the user. For example, in certain embodiments, a rope accessory is plugged on to the snout 42 triggering the hall sensor 41. In response, the toy 1 makes a growling sound and performs a pull type animation with at least its head.

In certain embodiments, the features/inputs of the toy 1 includes a Tamagotchi style. For example, in certain embodiments, the user interacts with the toy 1 to achieve a desired mood of the toy 1. The desired mood can be to keep the toy 1 happy based on certain input, neglect the toy 1 to cause the toy 1 to be depressed and eventually deflate, or maintain regular interaction with the toy 1 to keep it happy.

Figure 35:
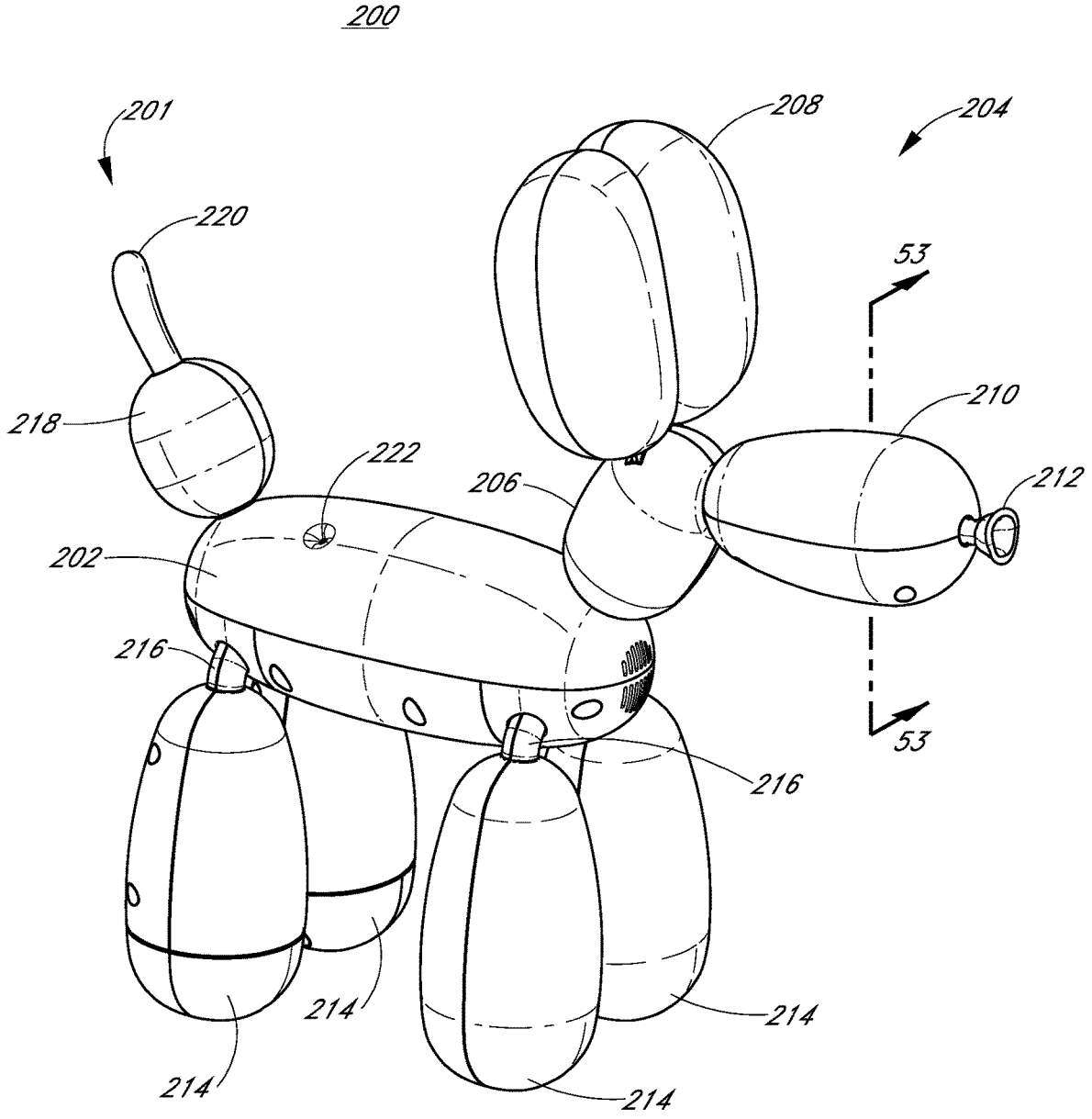
FIG. 35 is a front perspective view of the toy according to a second embodiment of the present invention.

FIG. 35 is a front perspective view of a toy 200 according to a second embodiment of the present invention. In certain embodiments, the toy 200 comprises a body 201 in the shape of a balloon toy. In certain embodiments, the body 201 is in the shape of a balloon dog. Of course, the toy 200 is not limited to the shape of a balloon dog. In certain embodiments, the body 201 has the appearance of an animal. In certain embodiments, the body 201 has the appearance of a giraffe. Accordingly, the toy 200 can have other shapes.

Figure 36:
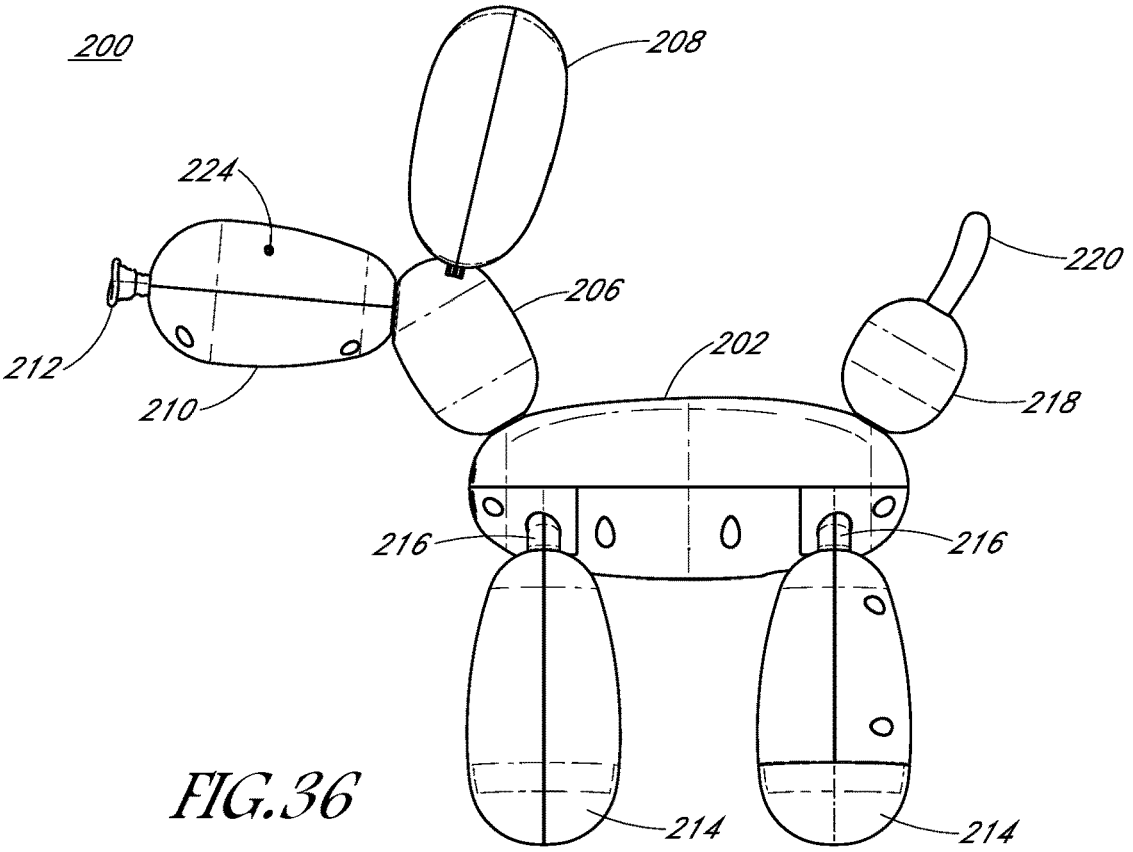
FIG. 36 is a side view of the toy in FIG. 34.

FIG. 36 is a side view of the toy 200 in FIG. 34. In certain embodiments, the body 201 comprises a torso 202, a head 204, limbs or front and rear legs 214, and a tail 218. In certain embodiments, one or more of the head 204, the tail 218, and the legs 214 are movable relative to the torso 202. In certain embodiments, one or more of the head 204, the tail 218, and the legs 214 are driven by one or more motors 336. In certain embodiments, one or more of the head 204, the tail 218, and the legs 214 are movable by a user relative to the torso 202. In the illustrated embodiment, the head 204 and the tail 218 are movable by the user while the front and rear legs 214 are driven by the one or more motors 336. In certain embodiments, each of the legs 214 is independently movable by the one or more motors 336 relative to the torso 202. In certain embodiments, the one or more motors 336 drives each of the legs 214 to move in all directions (e.g., forward, backward, up, down, and rotate) relative to the torso 202. In certain embodiments, each of the legs 214 can be rotated about a longitudinal axis of the leg 214. In the illustrated embodiment, a first motor 336 drives the front legs 214 and a second motor 336 drives the rear legs 214. For example, in the illustrated embodiment, the first motor 336 via a front gearbox 314 drives the front legs 214 so that movement of the left front leg 214 mirrors movement of the right front leg 214. For example, in the illustrated embodiment, the second motor 336 via a rear gearbox 316 drives the rear legs 214 so that movement of the left rear leg 214 mirrors movement of the right rear leg 214.

Figure 57:
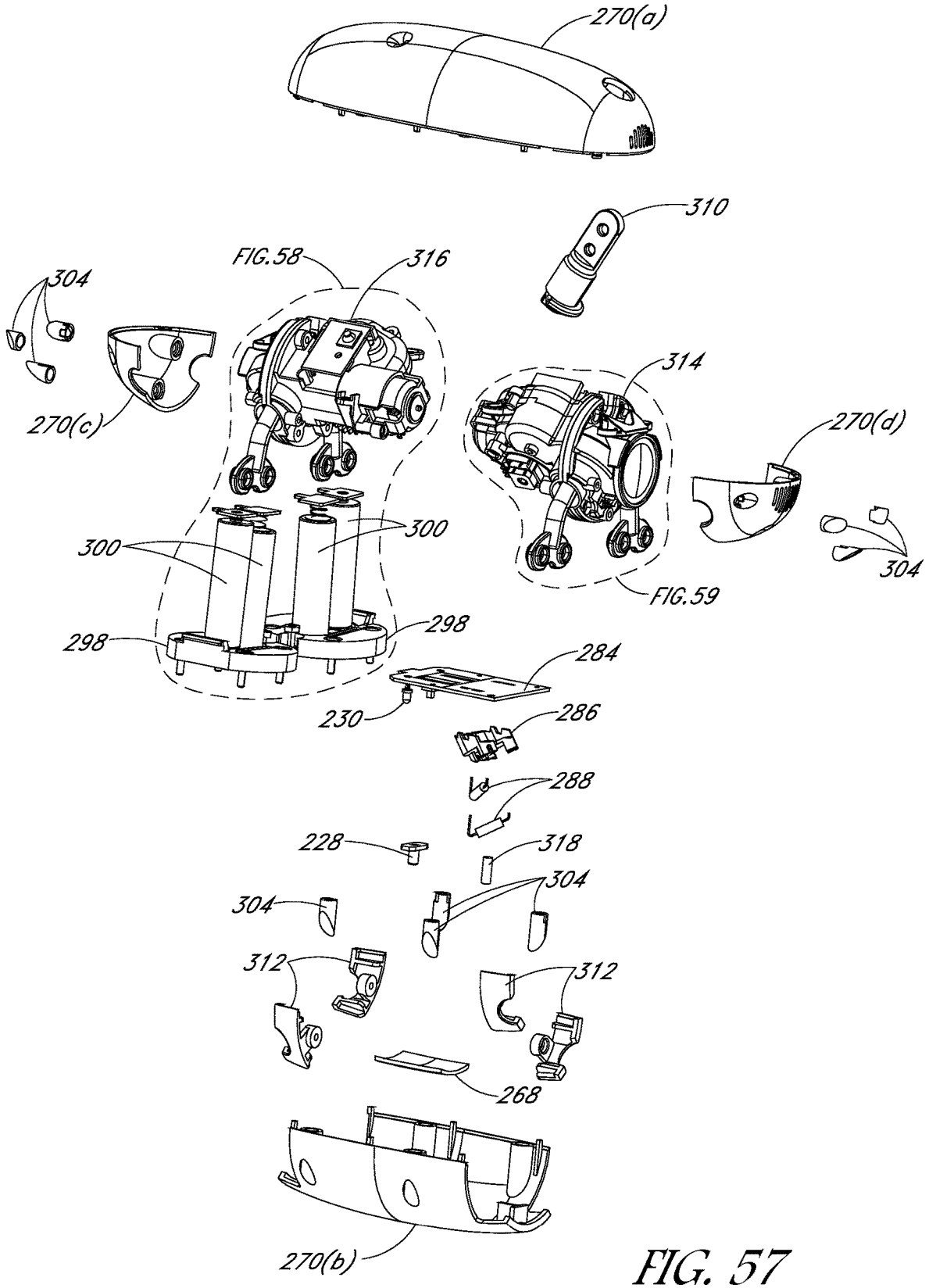
FIG. 57 is an exploded view of a body of the toy of FIG. 56.
Figure 58:
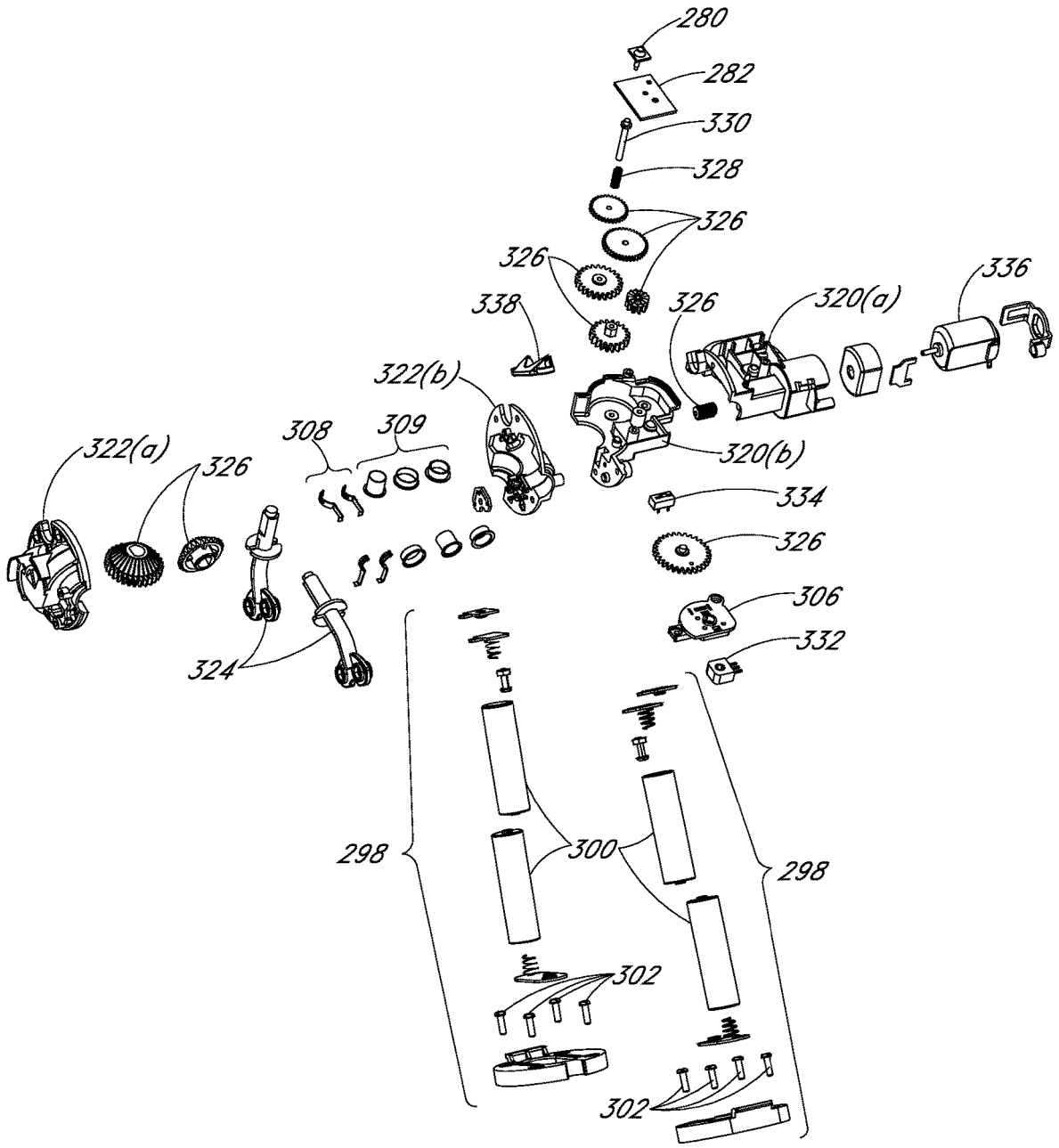
FIG. 58 is an exploded view of a rear subassembly from FIG. 57.
Figure 59:
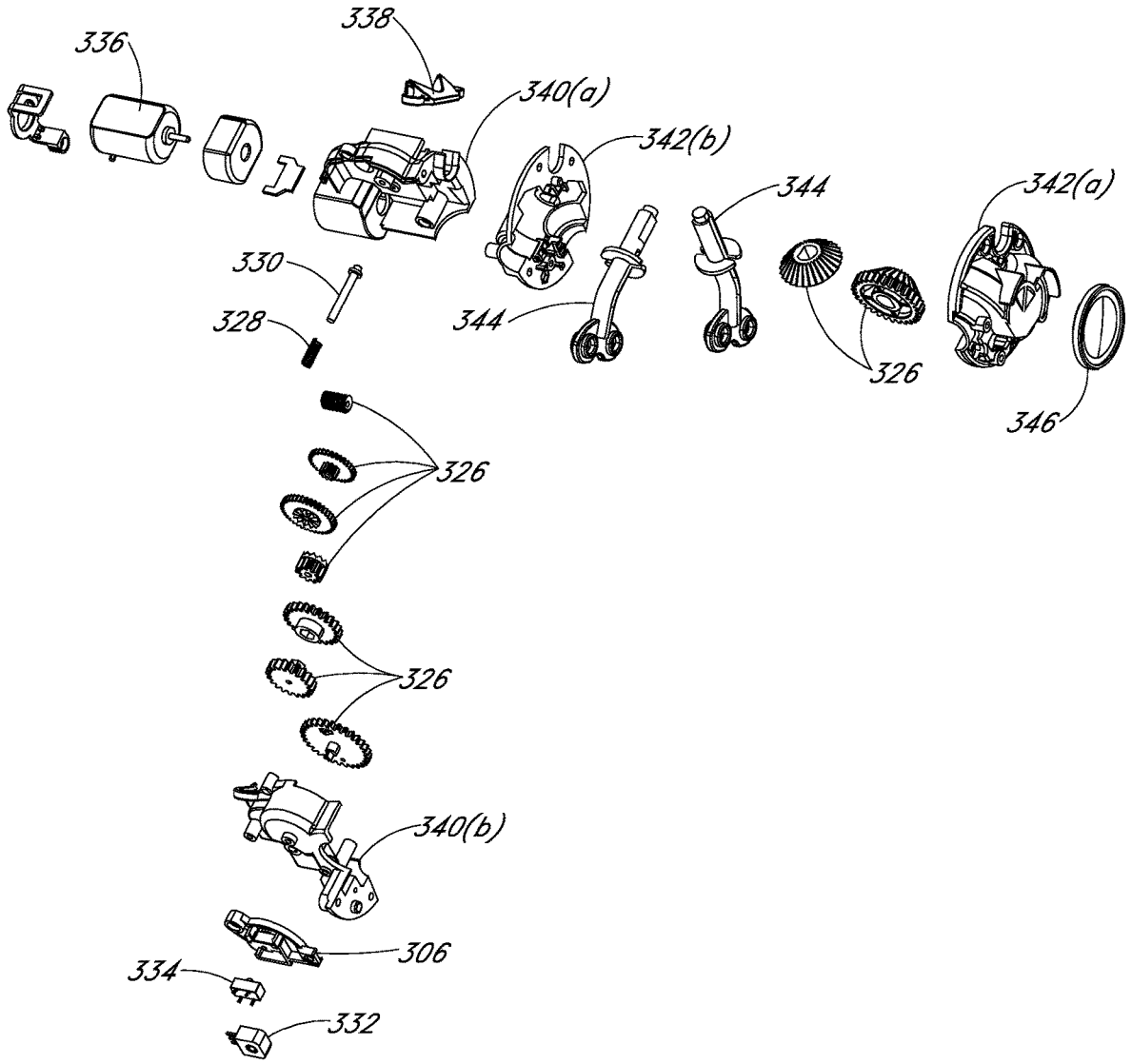
FIG. 59 is an exploded view of a front subassembly from FIG. 57.

In certain embodiments, the legs 214 comprise covers 216. In certain embodiments, the covers 216 extend from an upper end of the legs 214 and into the torso 202. In certain embodiments, a portion of the cover 216 is disposed in the torso 202 and covers a leg joint 324, 344 (FIGS. 58 and 59). The leg joints 324, 344 directly or indirectly couple between each leg 214 and the one or more gearboxes 314, 316 (FIG. 57) disposed in the torso 202.

Figure 37:
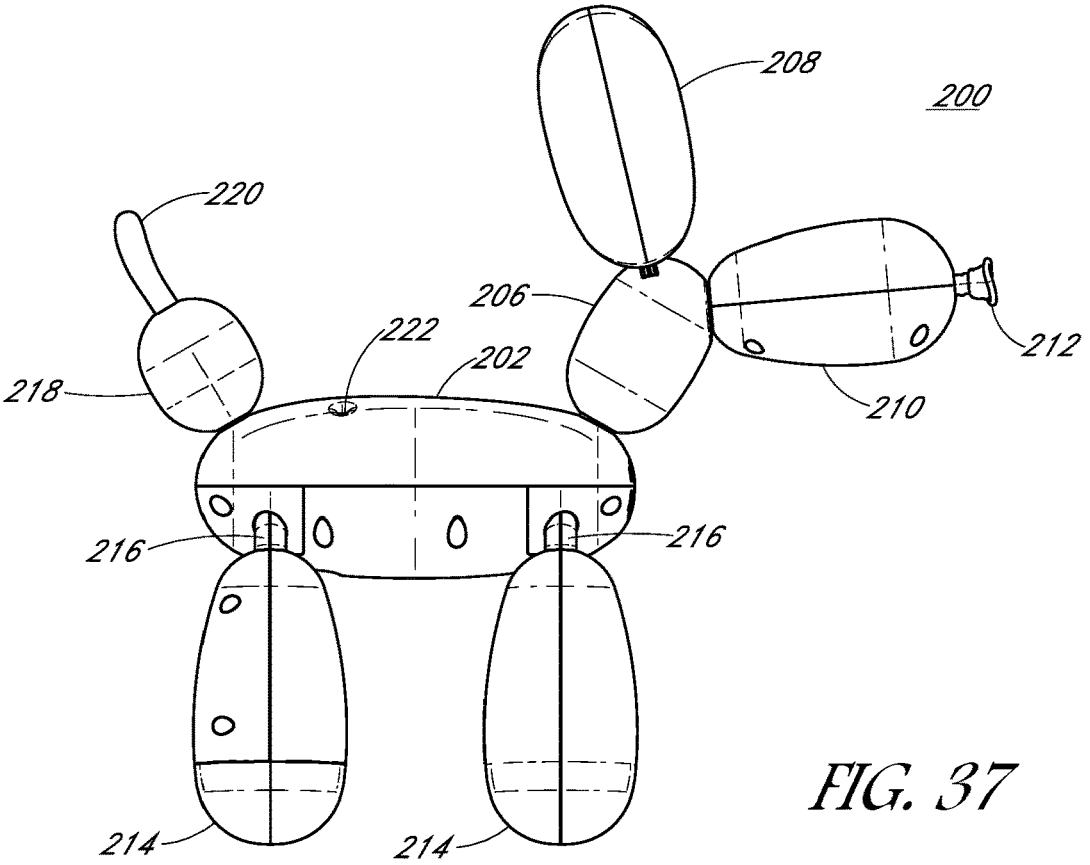
FIG. 37 is a side view of the toy opposite to the side view in FIG. 36.

FIG. 37 is a side view of the toy 200 opposite to the side view in FIG. 36. In certain embodiments, the toy 200 comprises one or more electric motors 336 (FIGS. 58 and 59). In certain embodiments, the one or more electric motors 336 are configured to convert electrical energy into mechanical energy. In certain embodiments, the mechanical energy is one or more of kinetic energy and potential energy. In certain embodiments, the kinetic energy includes translational energy and/or rotational energy. In certain embodiments, the one or more electric motors 336 are disposed in the torso 202. In other embodiments, the one or more electric motors 336 are disposed in, for example, the legs 214 and/or the head 204. In certain embodiments, the motors 336 and the one or more gearboxes 314, 316 are controlled by processor 348.

Figure 38:
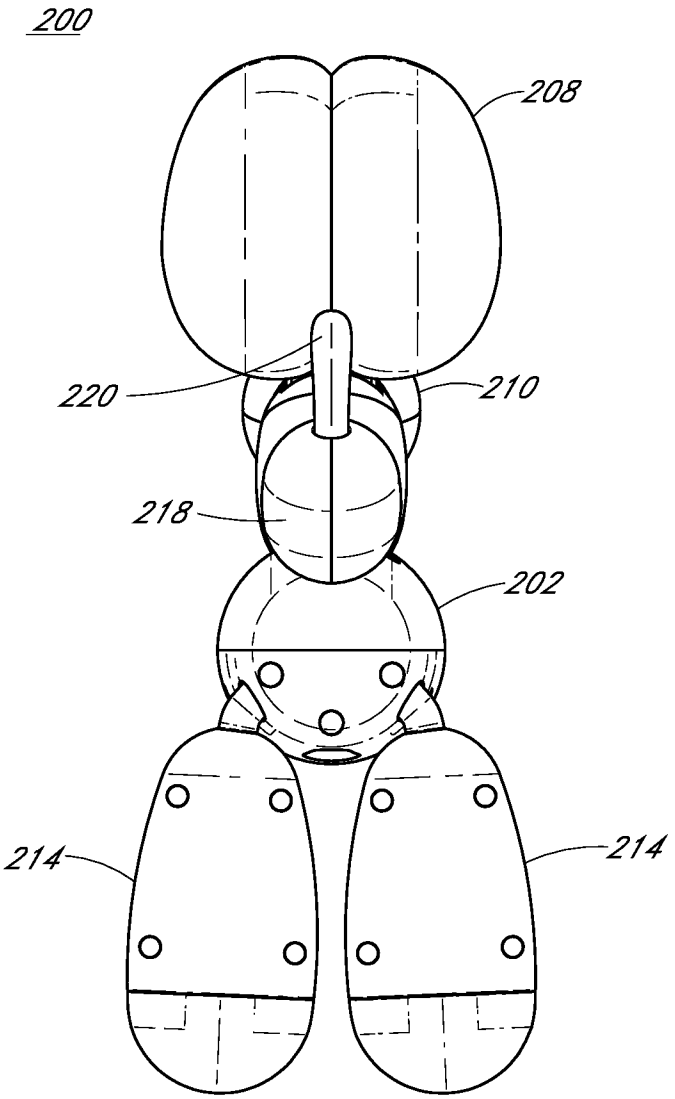
FIG. 38 is a rear plan view of the toy from FIG. 34.

FIG. 38 is a rear plan view of the toy 200 from FIG. 34. In certain embodiments, the toy 200 comprises the one or more gearboxes 314, 316 (FIG. 57). In certain embodiments, the one or more gearboxes 314, 316 are driven by the one or more electric motors 336 to move one or more of the head 204, the tail 218, and the legs 214. In certain embodiments, the one or more gearboxes 314, 316 are disposed in the torso 202. In other embodiment, the one or more gearboxes 314, 316 are disposed in, for example, the legs 214 and/or the head 204. In certain embodiments, the gearboxes 314, 316 can move the front and rear legs 214 to animate the legs 214. For example, the gearboxes 314, 316 can move the front legs 214 and rear legs 214 independently. In certain embodiments, both front legs 214 can be locked together. In certain embodiments, both rear legs 214 can be locked together to create numerous motions. In the illustrated embodiment, the front gearbox 314 moves the front legs 214 and the rear gearbox 316 moves the rear legs 214.

In certain embodiments, the tail 218 comprises a tip 220. In certain embodiments, the tip 220 extends from the tail 218. In certain embodiments, the tip 220 is made from a flexible material while the tail 218 is made from a plastic. In certain embodiments, the tip 220 is solid. In the illustrated embodiment, a diameter of the tip 220 is less than a maximum diameter of the tail 218. In the illustrated embodiment, the user can slight bend the tail 218 relative to the torso 202.

Figure 39:
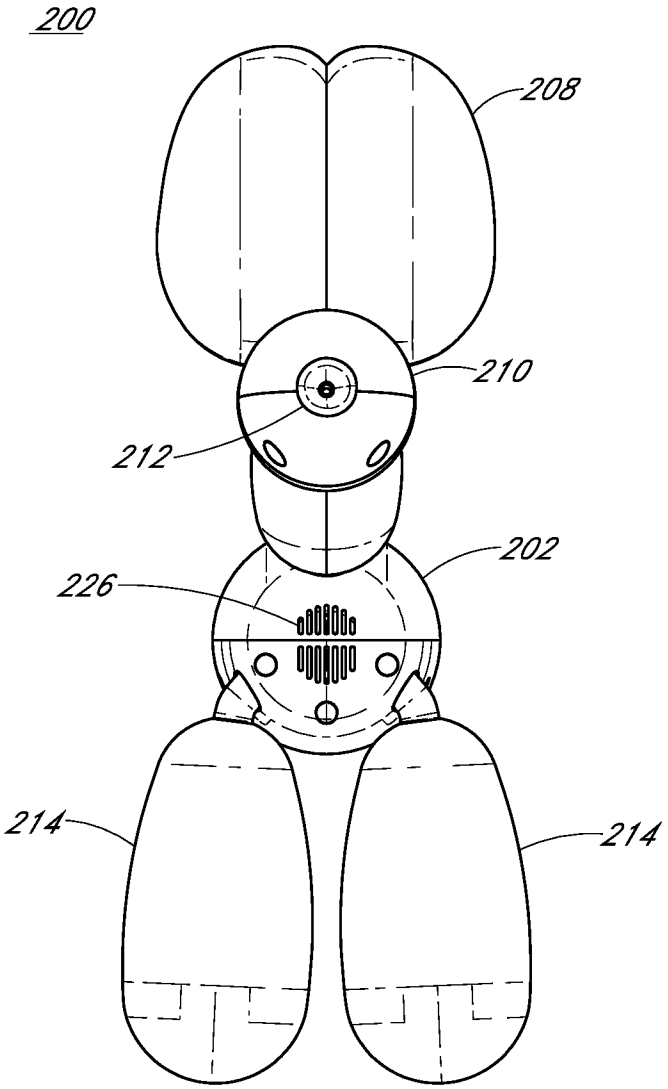
FIG. 39 is a front plan view of the toy from FIG. 34.
Figure 40:
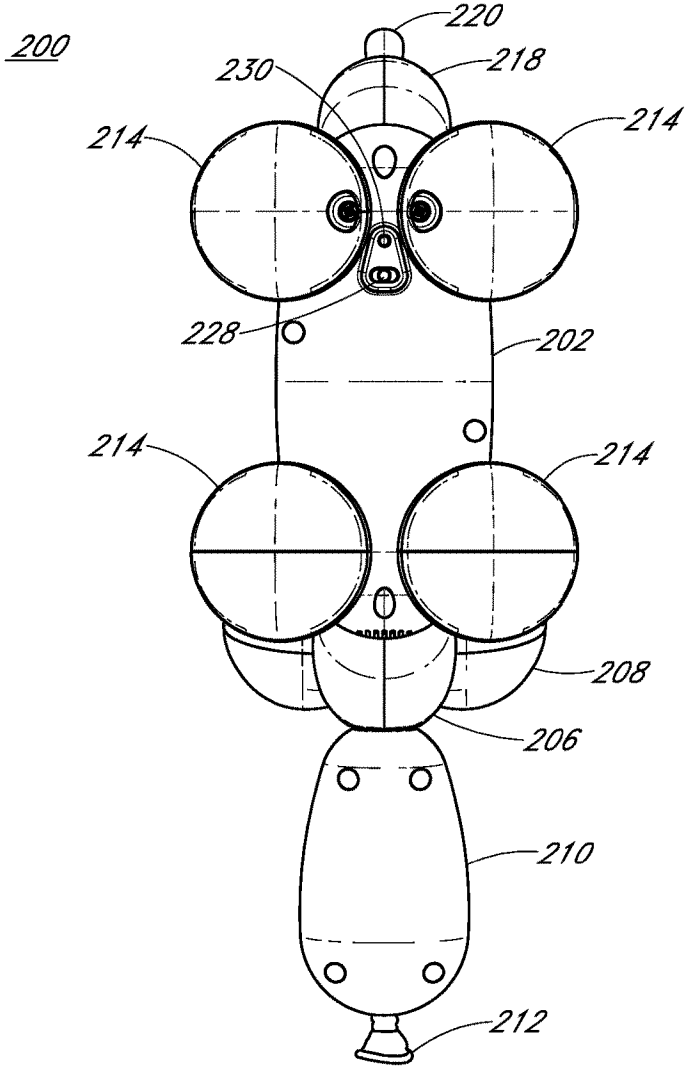
FIG. 40 is a bottom plan view of the toy from FIG. 34.

FIG. 39 is a front plan view of the toy 200 from FIG. 34. FIG. 40 is a bottom plan view of the toy 200 from FIG. 34. In certain embodiments, the head 204 comprises a neck 206, ears 208, and a snout 210. In certain embodiments, the ears 208 and the snout 210 are both coupled to the neck 206. In certain embodiments, one or more of the ears 208 and the snout 210 are movable relative to the neck 206. In the illustrated embodiment, the ears 208 are connected together to form a unitary structure. In other embodiments, each ear 208 is a separate member coupled separately to the neck 206.

In certain embodiments, the torso 202 comprises a speaker opening 226. In the illustrated embodiment, the speaker opening 226 comprises a plurality of slits in the torso 202 arranged in a circular pattern. The speaker opening 226 allows sound from an internal speaker 346 (FIG. 59) to reach the user at a desirable volume.

In certain embodiments, the snout 210 comprises a mouth 212. In the illustrated embodiment, at least a portion of the mouth 212 has a conical shape. In the illustrated embodiment, the mouth 212 is located on a distal end of the snout 210 opposite from the neck 206. In certain embodiments, the mouth 212 is movable relative to the snout 210. For example, in certain embodiments, movement of the mouth 212 triggers a switch 244. In certain embodiments, activation of the switch 244 causes the toy 200 to perform a play pattern. In certain embodiments, the play pattern is selected from a plurality of play patterns by the processor 348 and/or the memory 350. In certain embodiments, the selected play pattern depends at least in part on the orientation of the toy 200 when the switch 244 is activated. For example, in certain embodiments, a feeding sequence is selected if the toy 200 is in a standing position and an inflate sequence is selected if the toy 200 is in a lying position when the switch 244 is activated. In certain embodiments, the processor 348 and/or the memory 350 select the play pattern. Of course, the toy 200 is not limited to selecting between feeding and inflating sequences and can perform any other play pattern. Further, the selection of the sequence can further depend on, for example, how many times the switch 244 has been activated within a predetermined period of time.

In certain embodiments, pressing the mouth 212 of the toy 200 into the snout 210 when the toy 200 is standing will cause the toy 200 to 'electronically' perform the feeding sequence with animation/sound effects. In certain embodiments, after feeding the toy 200 will either pee (FIG. 64B) or fart (FIG. 64C). In certain embodiments, the processor 348 and/or the memory 350 select whether the feeding sequence includes the pee or the fart. In certain embodiments, prior to peeing the speaker 346 can emit a 'wimper' sound and scoot about. In certain embodiments, during peeing the rear legs 214 rotate to drop the rear torso 202 and a light 230 illuminates. In certain embodiments, the speaker 346 further emits matching sound effects to simulate peeing. In certain embodiments, the light 230 is a yellow LED. Of course, the light 230 is not limited to an LED type light and can be any other type of light. In other embodiments, the light 230 is a different color than yellow.

In certain embodiments, when the toy 200 is to fart, the toy 200 drops the front torso 202 by rotating the front legs 214 while the speaker 346 emits a farting sound. In certain embodiments, afterwards the toy 200 falls over before standing up again.

In certain embodiments, pressing the mouth 212 of the toy 200 into the snout 210 when the toy 200 is in the laying position will cause the toy 200 to 'electronically' perform the inflate sequence with animation/sound effects. In certain embodiments, the inflate sequence includes the toy 200 moving the legs 214 to reach the standing position (FIG. 66B). In certain embodiments, the processor 348 and/or the memory 350 provide instructions to the motors 336 and gearboxes 314, 316 for moving the legs 214. In certain embodiments, the toy 200 initially moves the rear legs 214, then moves the front legs 214, and then moves both the front and rear legs 214 to complete the inflate sequence and reach the standing position. In certain embodiments, the speaker 346 further emits matching sound effects to simulate inflating.

In certain embodiments, an accessory in the form of a pump 238 (FIG. 43), for example, is pressed against the mouth 212 to push the mouth 212 into the snout 210. The pump 238 provides a way for the user to active the feeding sequence and/or the inflate sequence. Of course, the user can also activate the feeding and inflate sequence without the pump 238 by pressing the mouth 212 into the snout 210 with their hand. In certain embodiments, the pump 238 includes no moving parts.

In certain embodiments, the toy 200 comprises an on/off switch 228. In certain embodiments, the on/off switch 228 includes an on position which activates the toy 200 and an off position which deactivates the toy 200. In certain embodiments, the on/off switch 228 is located on the bottom of the torso 202. In certain embodiments, the on/off switch 228 is at least partially recessed below the surface of the torso 202.

Figure 41:
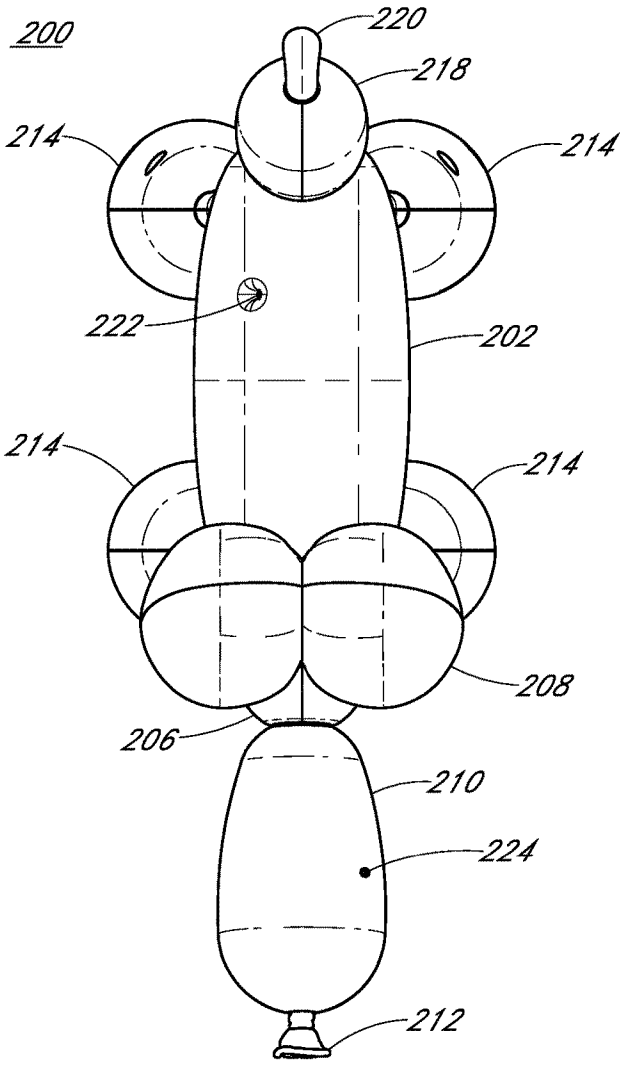
FIG. 41 is a top plan view of the toy from FIG. 34.
Figure 54:
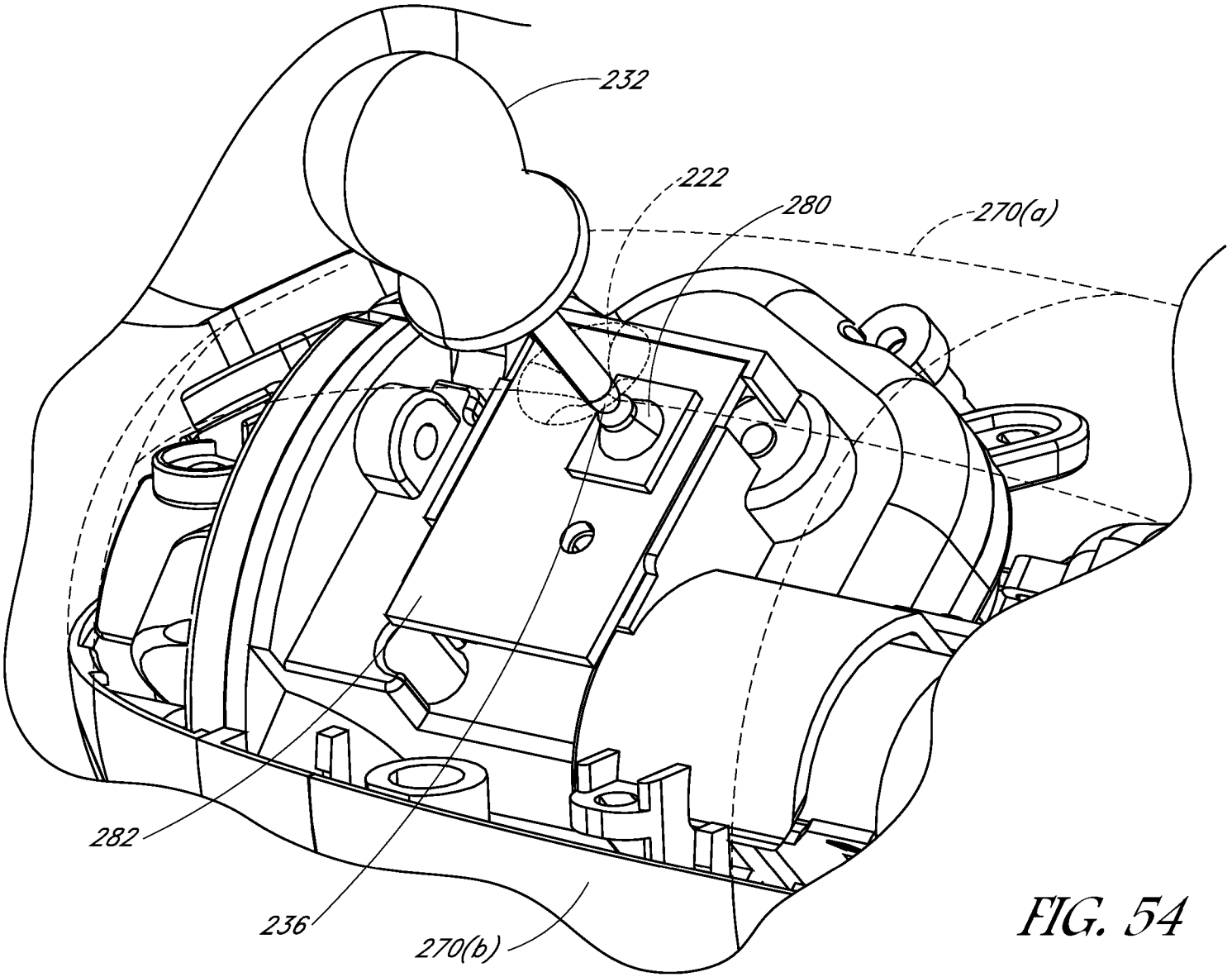
FIG. 54 is a perspective top view of the body of the toy from FIG. 42 showing an accessory, in the form of a pin, pressed into a pinhole.

FIG. 41 is a top plan view of the toy from FIG. 34. In certain embodiments, the toy 200 comprises a pinhole 222 to allow access to a switch 280 (FIG. 54). In certain embodiments, activation of the switch 280 causes the toy 200 to perform a play pattern. In certain embodiments, pressing the switch 280 of the toy 200 will cause the toy 200 to 'electronically' perform a pop or deflate sequence with animation/sound effects. In certain embodiments, after activating the switch 280 the toy 200 suddenly moves from a standing position to a lying position. In certain embodiments, once the switch 280 is activated, the front legs 214 quickly spread apart causing the head 204 to fall to the ground. In certain embodiments, after the head 204 falls to the ground, the front legs 214 further move causing the toy 200 to roll onto its side. In certain embodiments, prior to the front legs 214 spreading apart, the speaker 346 can emit a 'balloon pop' sound.

In certain embodiments, the toy 200 comprises a microphone opening 224. In the illustrated embodiment, the microphone opening 224 is disposed in the snout 210. In certain embodiments, a microphone 272 (FIG. 53) is disposed in the snout 210 in close proximity to the microphone opening 224. The microphone 272 is configured to sense sound. For example, in certain embodiments, the sound sensed by the microphone 272 causes the toy 200 to perform a play pattern. In certain embodiments, the microphone 272 is mounted on a PCB 274. Sound travels from the microphone opening 272 into the snout 210 above the microphone 272. The toy 200 can react in various ways to sounds detected by the microphone 272.

Figure 42:
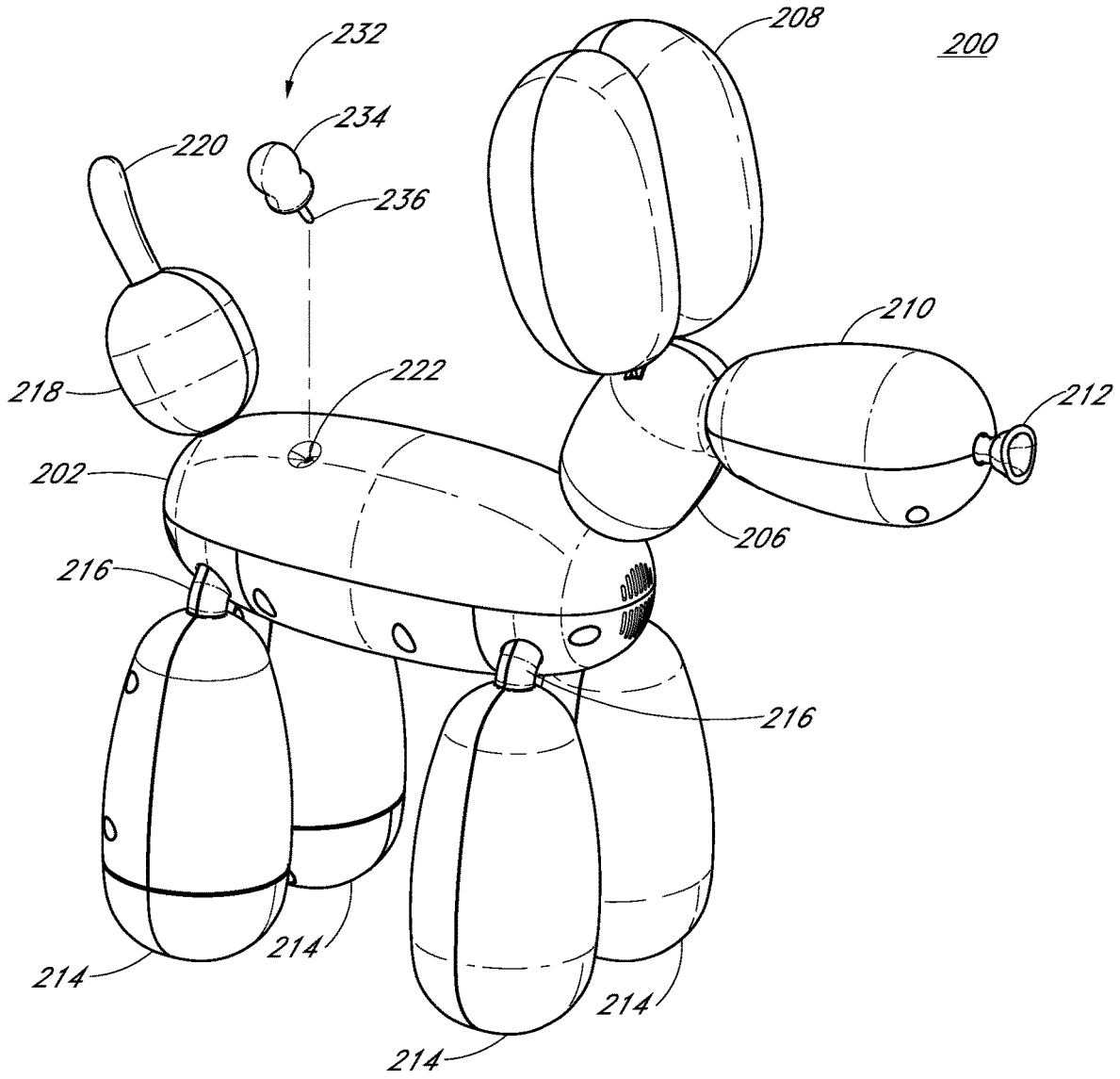
FIG. 42 is a front perspective view of the toy from FIG. 34.

FIG. 42 is a front perspective view of the toy 200 from FIG. 34. In certain embodiments, an accessory in the form of a pin 232, activates the toy 200. In certain embodiments, the pin 232 comprises a handle 234 and a distal end 236. In certain embodiments, the distal end 236 of the pin 232 is pressed into the pinhole 222 and against the switch 280 to activate the switch 280. The pin 232 provides a way for the user to active the pop or deflate sequence. Of course, the user can also activate the pop or deflate sequence without the pin 232 by pressing the switch 280 with a pointy object such as a ball point pen.

Figure 45:
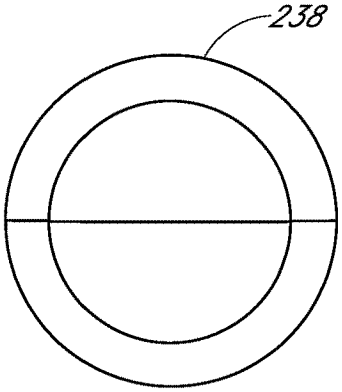
FIG. 45 is a back end view of the pump from FIG. 43.
Figure 44:
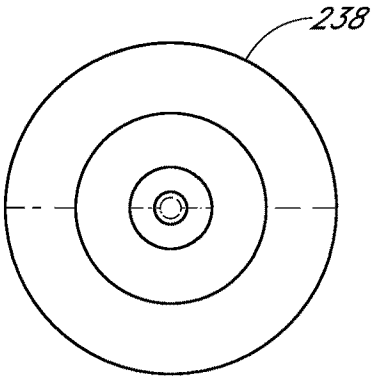
FIG. 44 is a front end view of the pump from FIG. 43.
Figure 43:
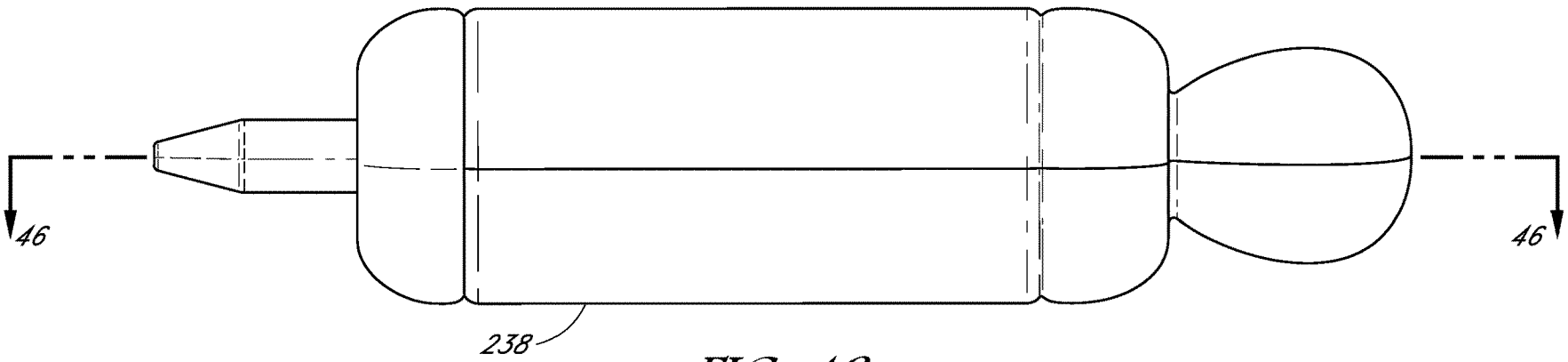
FIG. 43 is a side view of an accessory, in the form of a pump, that can be used to provide input to the toy.

FIG. 43 is a side view of an accessory, in the form of a pump 238, that can be used to provide input to the toy 200. FIG. 44 is a front end view of the pump 238 from FIG. 43. FIG. 45 is a back end view of the pump 238 from FIG. 43. In certain embodiments, the user presses the pump 238 against the mouth 212 to push the mouth 212 into the snout 210. The pump 238 provides a way for the user to active the feeding sequence and the inflate sequence. Of course, the user can also activate the feeding and inflate sequence without the pump 238 by pressing the mouth 212 into the snout 210 with their hand. In certain embodiments, the pump 238 includes no moving parts.

Figure 46:
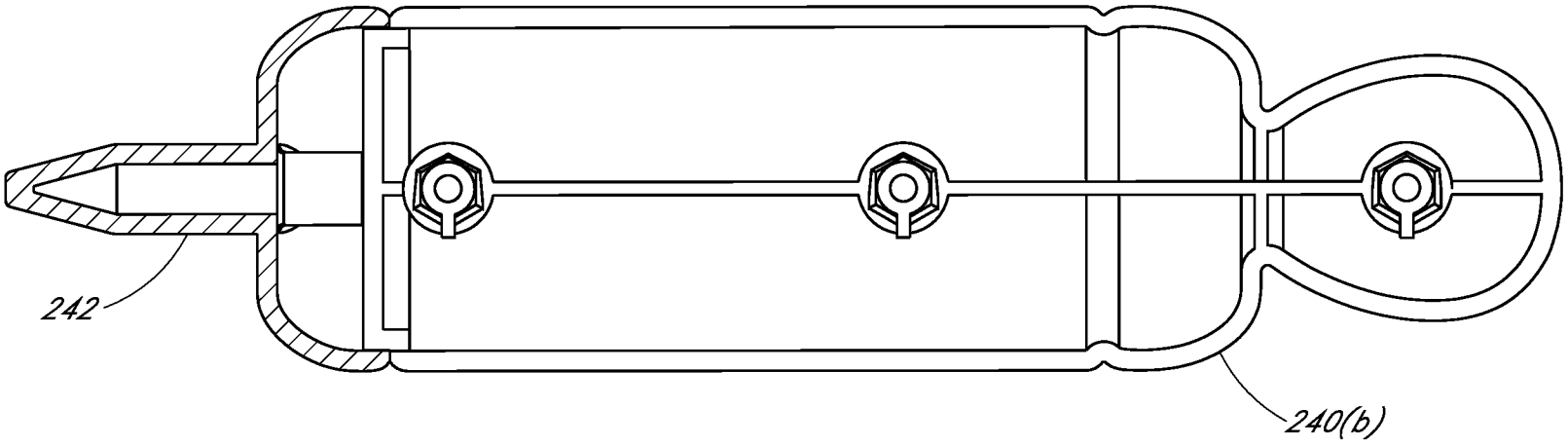
FIG. 46 is a cross-section view through the pump of FIG. 43 taken along lines 46-46.
Figure 47:
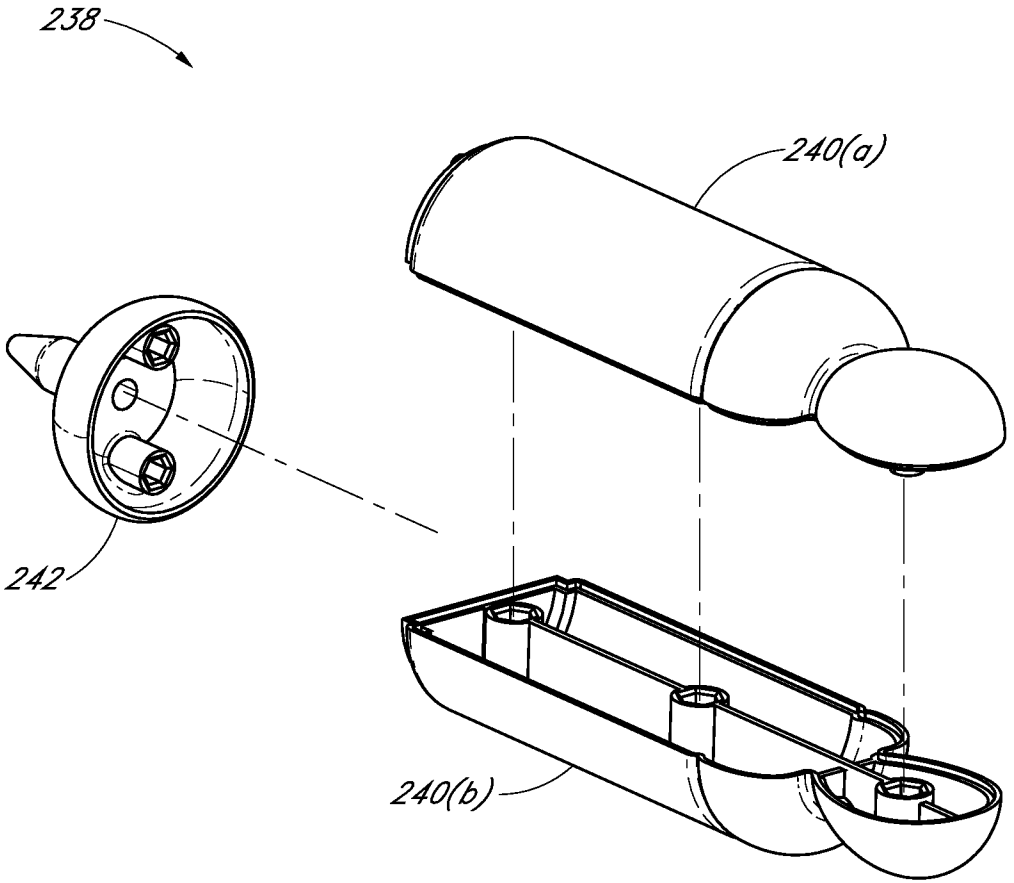
FIG. 47 is an exploded view of the pump from FIG. 43.

FIG. 46 is a cross-section view through the pump 238 of FIG. 43 taken along lines 46-46. FIG. 47 is an exploded view of the pump 238 from FIG. 43. In certain embodiments, the pump 238 comprises pump shells 240(*a*), 240(*b*) and a nozzle 242. In certain embodiment, the pump shell 240(*a*) secures to the pump shell 240(*b*). The nozzle 242 secures to an end of the assembled pump shells 240(*a*), 240(*b*).

Figure 48:
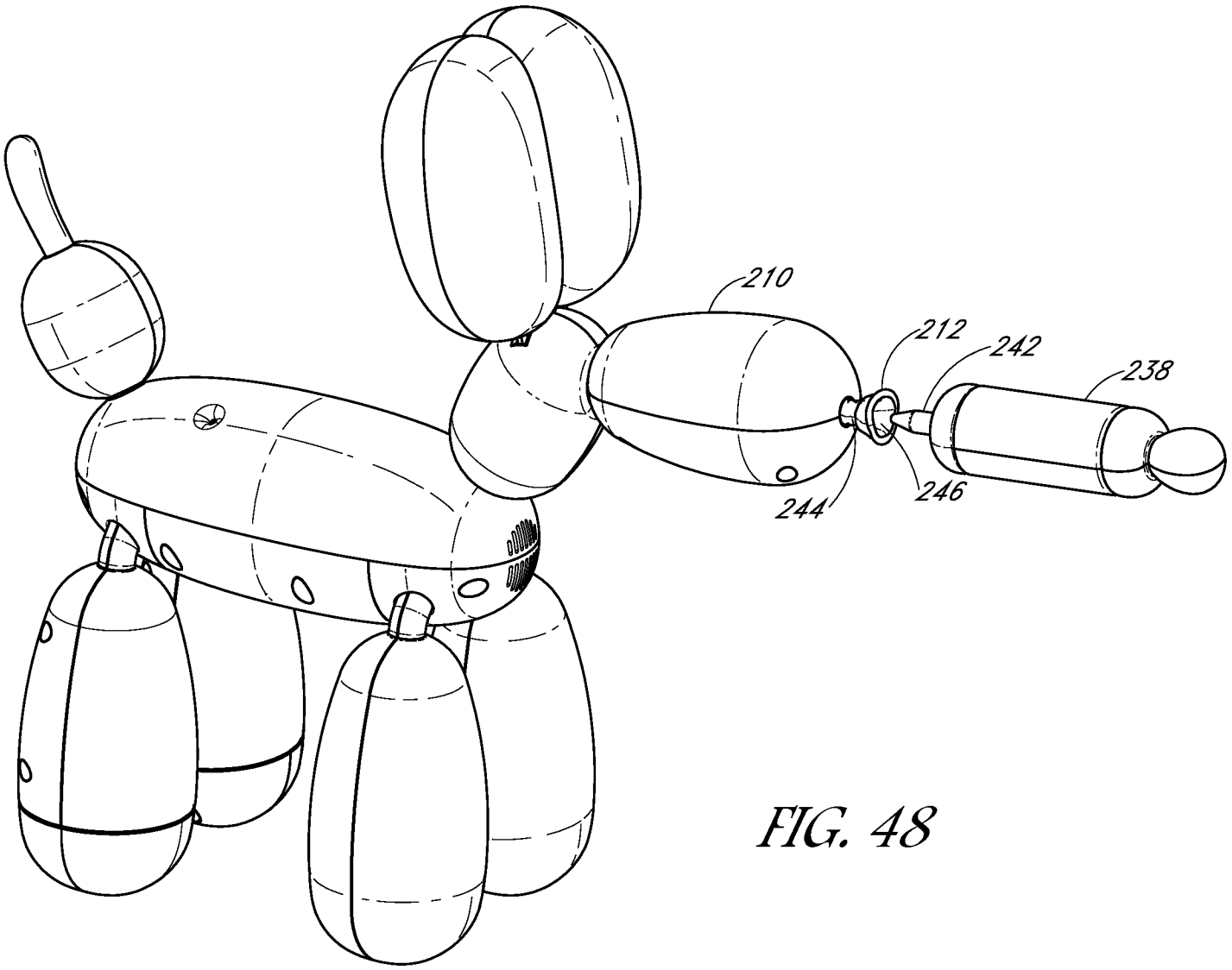
FIG. 48 is an exemplary overview of the toy of FIG. 35 with the pump from FIG. 43 in contact with the mouth of the toy.

FIG. 48 is an exemplary overview of the toy 200 of FIG. 35 with the nozzle 242 of the pump 238 from FIG. 43 in contact with the mouth 212 of the toy 200. In certain embodiments, the mouth 212 forms a cone 246. In other embodiments, the mouth 212 forms a different shape than the cone 246. In certain embodiments, the mouth 212 is movable relative to the snout 210. For example, in certain embodiments, movement of the mouth 212 triggers the switch 244. In certain embodiments, activation of the switch 244 causes the toy 200 to perform a play pattern. In certain embodiments, the play pattern is selected from a plurality of play patterns. In certain embodiments, the selected play pattern depends at least in part on the orientation of the toy 200 when the switch 244 is activated.

Figure 50:
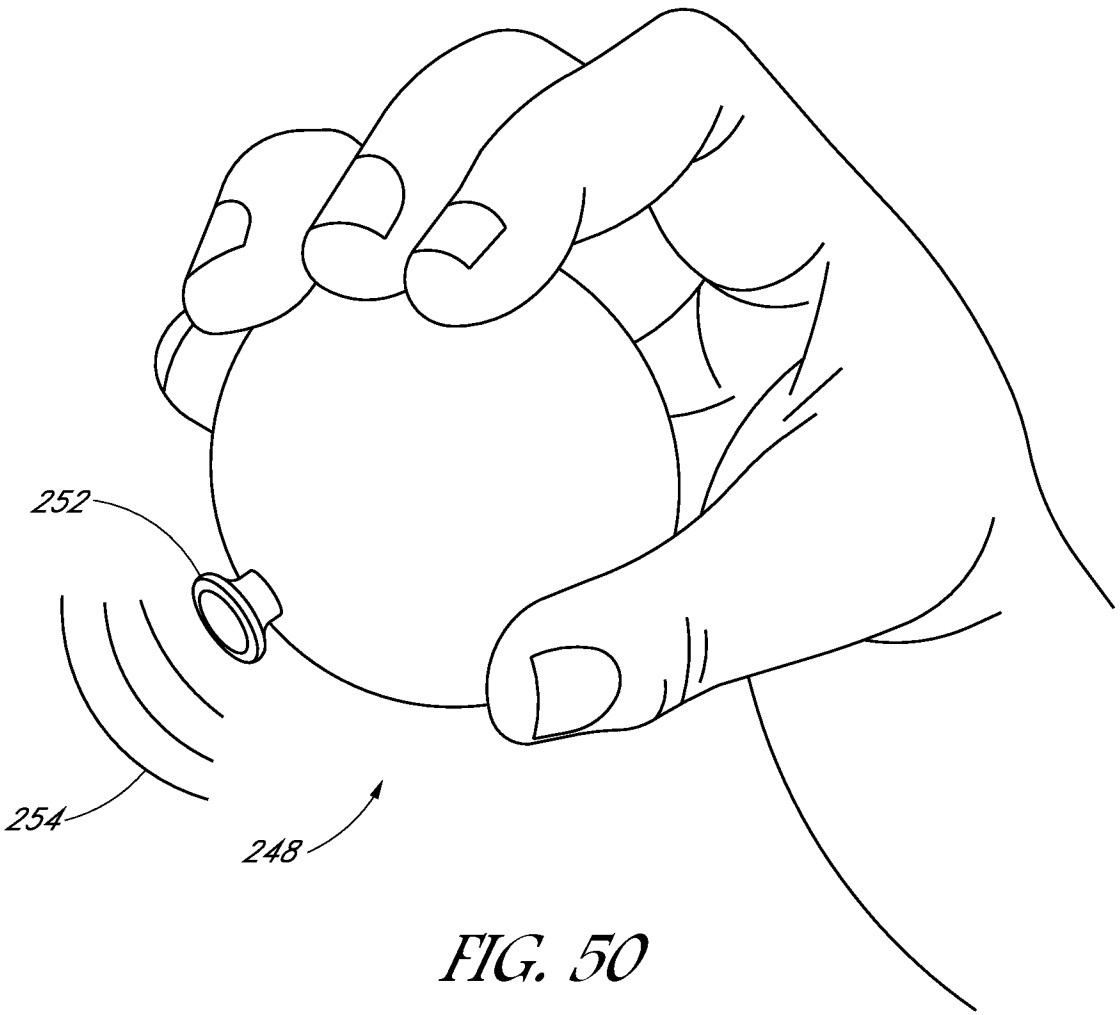
FIG. 50 is a view of the squeaker toy from FIG. 49 being squeezed by a hand of a user to provide audible input to the toy.
Figure 49:
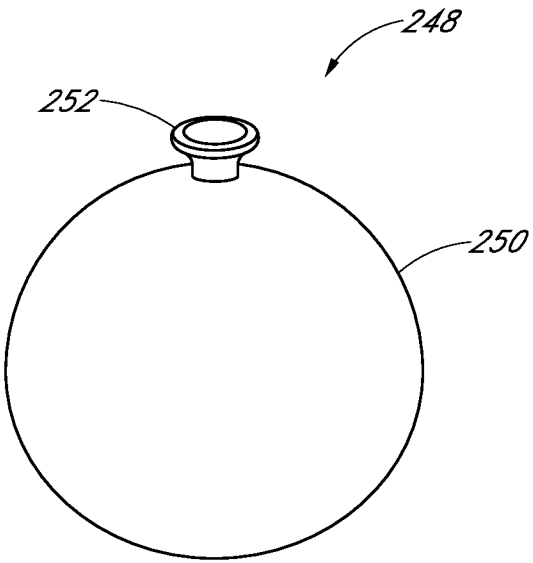
FIG. 49 is a perspective view of an accessory, in the form of a squeaker toy, that can be used to provide audible input to the toy.

FIG. 49 is a perspective view of an accessory, in the form of a squeaker toy 248, that can be used to provide audible input to the toy 200. FIG. 50 is a view of the squeaker toy 248 from FIG. 49 being squeezed by a hand of a user to provide audible input to the toy 200. In certain embodiments, the squeaker toy 248 comprise a body 250 and a lip 252. When squeezed by the user, air from inside the body 250 escapes through a squeaker in the lip 252. The squeaker is configured to create sound 254 by the air rapidly passing through the squeaker in the lip 252. In certain embodiments, the sound 254 created by the squeaker toy 248 passes through the microphone opening 224 and is sensed by the microphone 272. In certain embodiments, the interval and/or frequency of the sensed sound causes the toy 200 to perform a specific play pattern. For example, in certain embodiments, the toy 200 performs different play patterns depending on the interval between a series of sounds emitted by the squeaker toy 248.

Figure 51:
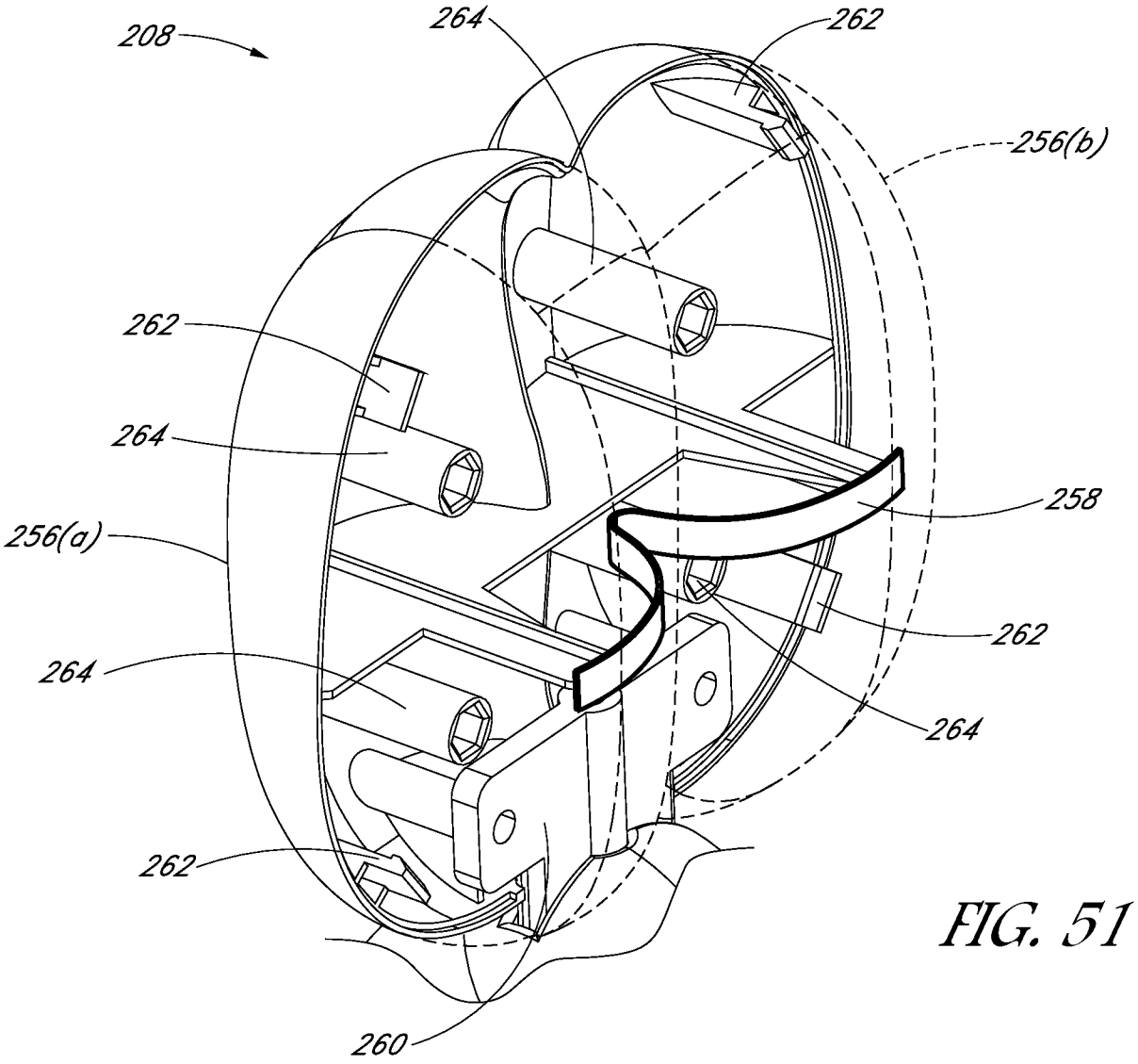
FIG. 51 is a view of a capacitive touch sensor located on a front side of the ears of the toy from FIG. 42.

FIG. 51 is a view of a capacitive touch sensor 258 located on a front side of the ears 208 of the toy 200 from FIG. 42. In the illustrated embodiment, the ears 208 comprise ear shells 256(*a*), 256(*b*). In certain embodiments, an ear joint 260 couples the ears 208 to the neck 206. In the illustrated embodiment, a portion of the ear joint 260 is secured between the ear shells 256(*a*), 256(*b*). In certain embodiments, the ears 208 include one or more clips 262 configured to secure the ear shells 256(*a*), 256(*b*) together. In certain embodiments, the ear shells 256(*a*), 256(*b*) include one or more bosses 264 configured to engage together when the ear shells 256(*a*), 256(*b*) are assembled to form the ears 208.

In the illustrated embodiment, the capacitive touch sensor 258 senses the user patting the ears 208 of the toy 200. In certain embodiments, the capacitive touch sensor 258 is configured as a metal plate. In certain embodiments, the metal plate is disposed behind the front surface of the ears 208 to detect hand patting on the outer surface of the ears 208. In certain embodiments, in response to the capacitive touch sensor 258 sensing hand patting of the ears 208, the toy 200 performs a play pattern. In certain embodiments, the toy 200 reacts to the capacitive touch sensor 258 sensing the user's hand by moving from a first position to a second position and/or making one or more sounds. For example, in certain embodiments, the toy 200 moves from a standing position to a sitting position in response to petting. For example, in certain embodiments, the toy 200 moves from a sitting position to a standing position in response to petting of the ears 208. For example, in certain embodiments, prior to, during, or after the toy 200 moves between the first and second positions, the toy 200 can emit one or sounds from the speaker 346. In certain embodiments, the sound is a triumphant sound.

Figure 52A:
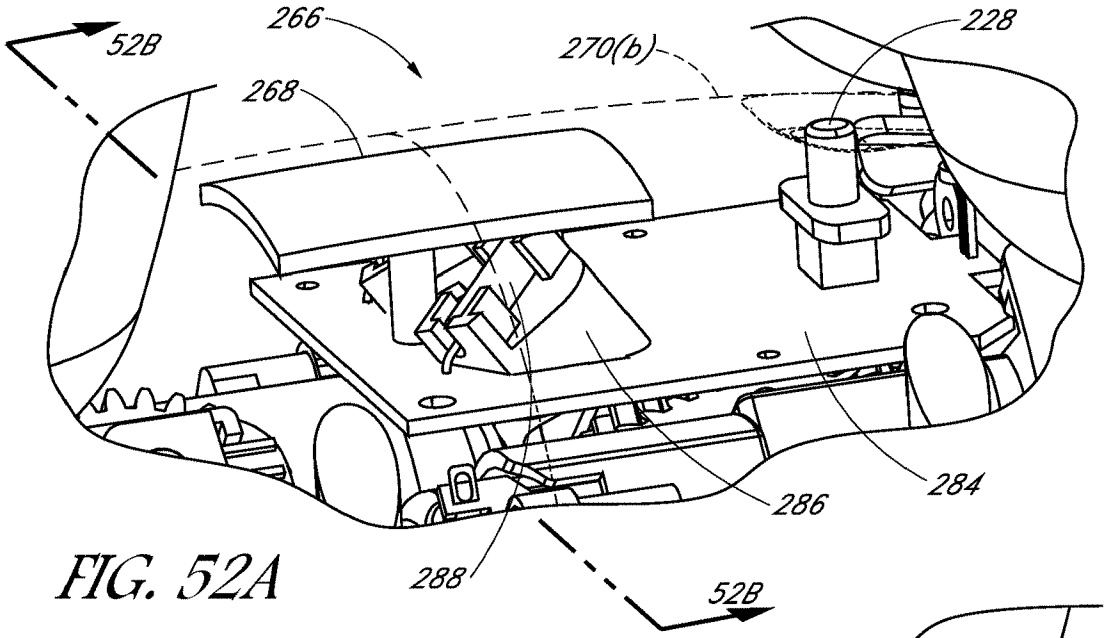
FIGS. 52A and 52B are views of a capacitive touch sensor located on a tummy of the toy from FIG. 42.
Figure 52B:
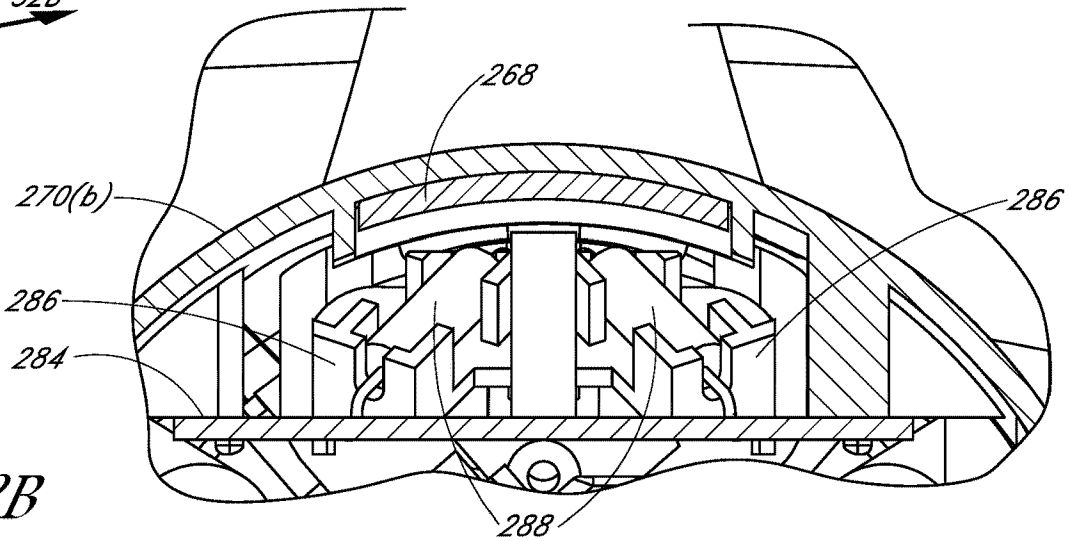

FIGS. 52A and 52B are views of a capacitive touch sensor 268 located in a tummy region 266 of the torso 202 from FIG. 42. In the illustrated embodiment, the torso 202 comprises torso shells 270(*a*), 270(*b*), 270(*c*), 270(*d*). In certain embodiments, the capacitive touch sensor 268 is disposed in a recess in the torso shell 270(*b*). In certain embodiments, the capacitive touch sensor 268 is disposed in other components of the toy 202 that are accessible to the user. In certain embodiments, the capacitive touch sensor 268 is configured as a metal plate.

In the illustrated embodiment, the capacitive touch sensor 268 senses the user ticking the tummy 266 of the toy 200. In certain embodiments, in response to the capacitive touch sensor 268 sensing hand tickling of the tummy 266, the toy 200 performs a play pattern. In certain embodiments, the toy 200 reacts to the capacitive touch sensor 268 sensing the user's hand by moving from a first position to a second position and/or making one or more sounds. For example, in certain embodiments, the toy 200 moves from a standing position to a lying position in response to tickling. For example, in certain embodiments, prior to, during, or after the toy 200 moves between the first and second positions, the toy 200 can emit one or sounds from the speaker 346. In certain embodiments, the sound is a laughing sound.

Figure 53:
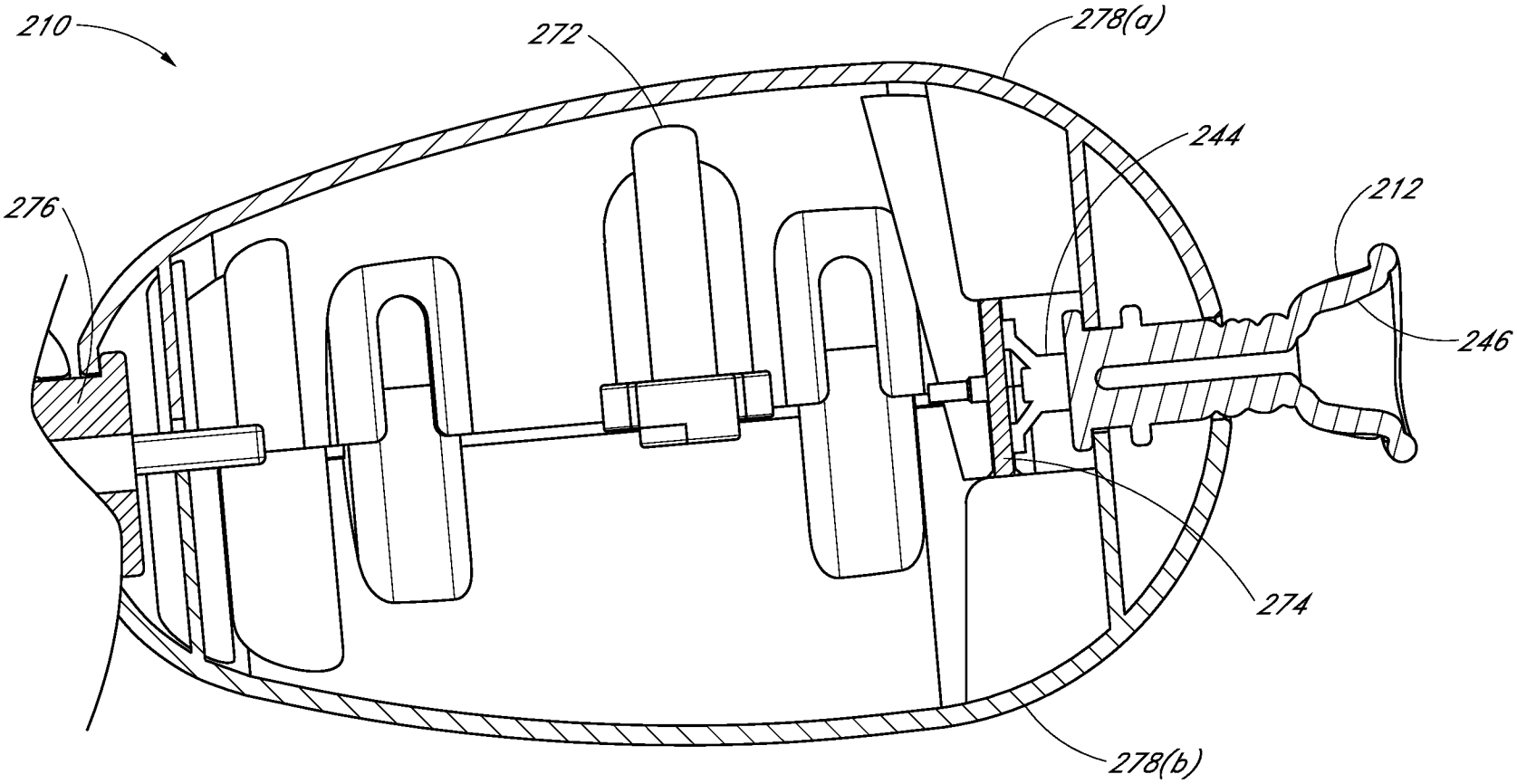
FIG. 53 is a cross-section view through the snout of the toy from FIG. 42.

FIG. 53 is a cross-section view through the snout 210 of the toy 200 from FIG. 42. In the illustrated embodiment, the snout 210 comprises snout shells 278(*a*), 278(*b*). In certain embodiments, the microphone 272 is disposed in the snout 210. In certain embodiments, the snout 210 comprises a microphone clamp 273 and a microphone isolator 271. In certain embodiments, the microphone 272 is disposed in close proximity to the microphone opening 224 (FIG. 36). The microphone 272 is configured to sense sound. For example, in certain embodiments, the sound sensed by the microphone 272 causes the toy 200 to perform a play pattern. Sound travels from the microphone opening 272 into the snout 210 above the microphone 272. The toy 200 can react in various ways to sounds detected by the microphone 272.

In certain embodiments, the mouth 212 is movable relative to the snout 210. For example, in certain embodiments, movement of the mouth 212 triggers the switch 244. In certain embodiments, activation of the switch 244 causes the toy 200 to perform a play pattern. In certain embodiments, the play pattern is selected from a plurality of play patterns. In certain embodiments, the selected play pattern depends at least in part on the orientation of the toy 200 when the switch 244 is activated. For example, in certain embodiments, a feeding sequence is selected if the toy 200 is in a standing position and an inflate sequence is selected if the toy 200 is in a laying position when the switch 244 is activated. In the illustrated embodiment, the snout 210 is coupled to the neck 206 via a snout joint 276.

FIG. 54 is a perspective top view of the body 201 of the toy 200 from FIG. 42 showing an accessory, in the form of the pin 232, pressed into the pinhole 222. In certain embodiments, the toy 200 comprises the pinhole 222 to allow access to the switch 280. In certain embodiments, the distal end 236 of the pin 232 is pressed into the pinhole 222 and against the switch 280 to activate the switch 280. In certain embodiments, activation of the internal switch 280 causes the toy 200 to perform a play pattern. In certain embodiments, pressing the switch 280 of the toy 200 will cause the toy 200 to 'electronically' perform a pop or deflate sequence with animation/sound effects. The pin 232 provides a way for the user to active the pop or deflate sequence.

Figure 55:
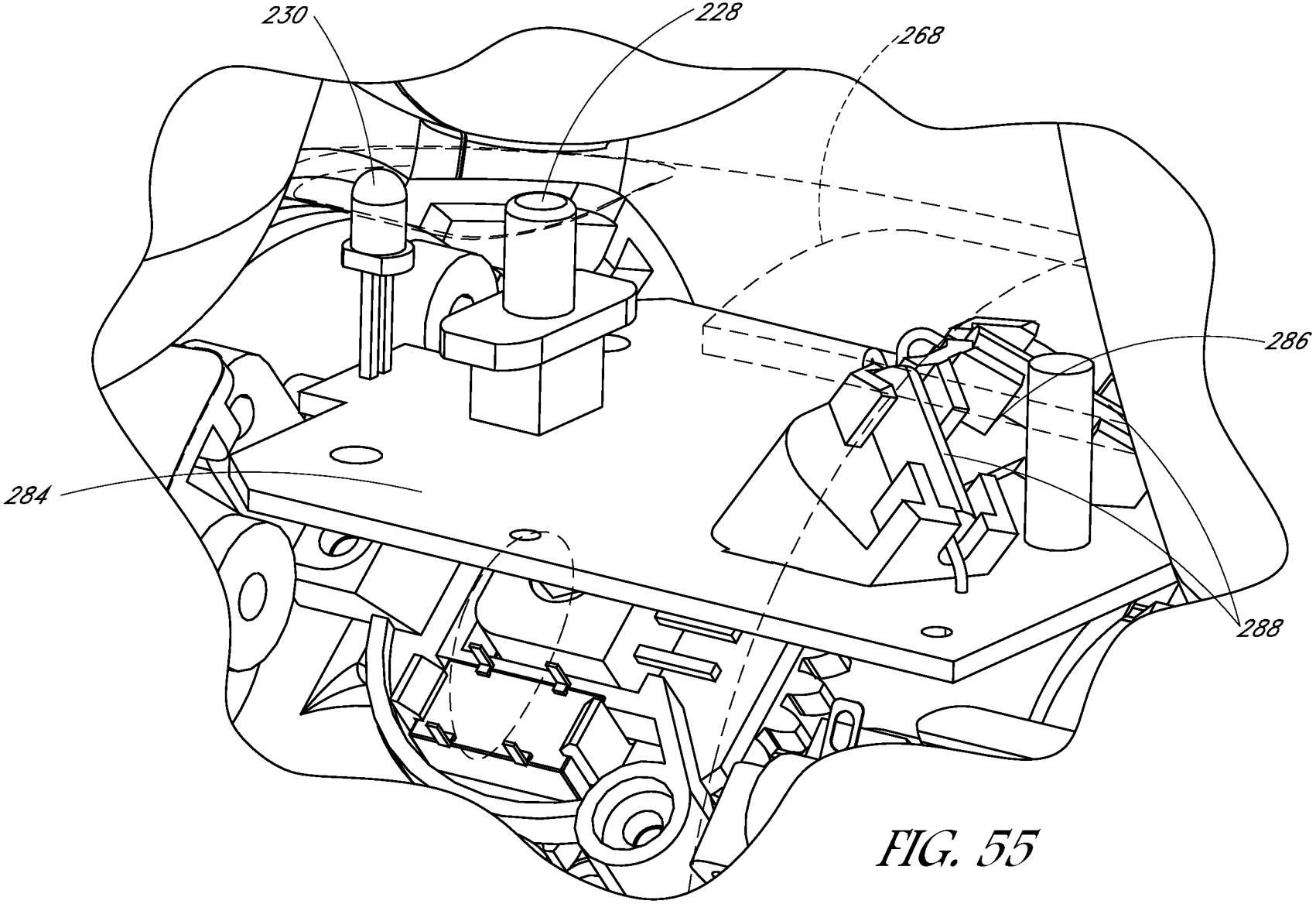
FIG. 55 is a perspective bottom view of the body of the toy from FIG. 42 showing a light and an on/off switch.

FIG. 55 is a perspective bottom view of the body 201 of the toy 200 from FIG. 42 showing a light 230 and an on/off switch 228. In certain embodiments, during the peeing play pattern the rear legs 214 rotate to drop a rear torso 202 portion and the light 230 illuminates. In certain embodiments, the light 230 is a yellow LED. Of course, the light 230 is not limited to an LED type light and can be any other type of light. In other embodiments, the light 230 is a different color than yellow. In certain embodiments, the on/off switch 228 includes an on position which activates the toy 200 and an off position which deactivates the toy 200. In certain embodiments, the on/off switch 228 is located on the bottom of the torso 202. In certain embodiments, the on/off switch 228 is at least partially recessed below the surface of the torso 202.

In certain embodiments, the toy 200 comprises one or more tilt sensors 288. In certain embodiments, the one or more tilt sensors 288 sense one or more of yaw, pitch, or roll of the body 202. In certain embodiments, the output from the one or more tilt sensors 288 is provided to the processor 348 and/or memory 350. In certain embodiments, the one or more tilt sensors 288 are disposed in a holder 286. In certain embodiments, the holder 286 is support by the printed circuit board (PCB) 284.

In certain embodiments, the holder 286 includes receiving slots configured to receive the one or more tilt sensors 288. In certain embodiments, the receiving slots hold one of the tilt sensors 288 at a different orientation than another one of the tilt sensors 288. In certain embodiments, the one or more tilt sensors 288 identify when changes occur to the orientation of the toy 200. In certain embodiments, the one or more tilt sensors 288 identify the orientation of the toy 200. In certain embodiments, the one or more tilt sensors 288 identify when the toy 200 is in any position. For example, in certain embodiments, the one or more tilt sensors 288 identify when the toy 200 is in one or more of the standing, sitting, or lying positions. In certain embodiments, the one or more tilt sensors 288 work together to identify the current position of the toy 200. In certain embodiments, the orientation sensed by the one or more tilt sensors 288 is provided to the processor 348 and/or memory 350 to activate and/or change play patterns including interactions/sounds/animations.

Figure 56:
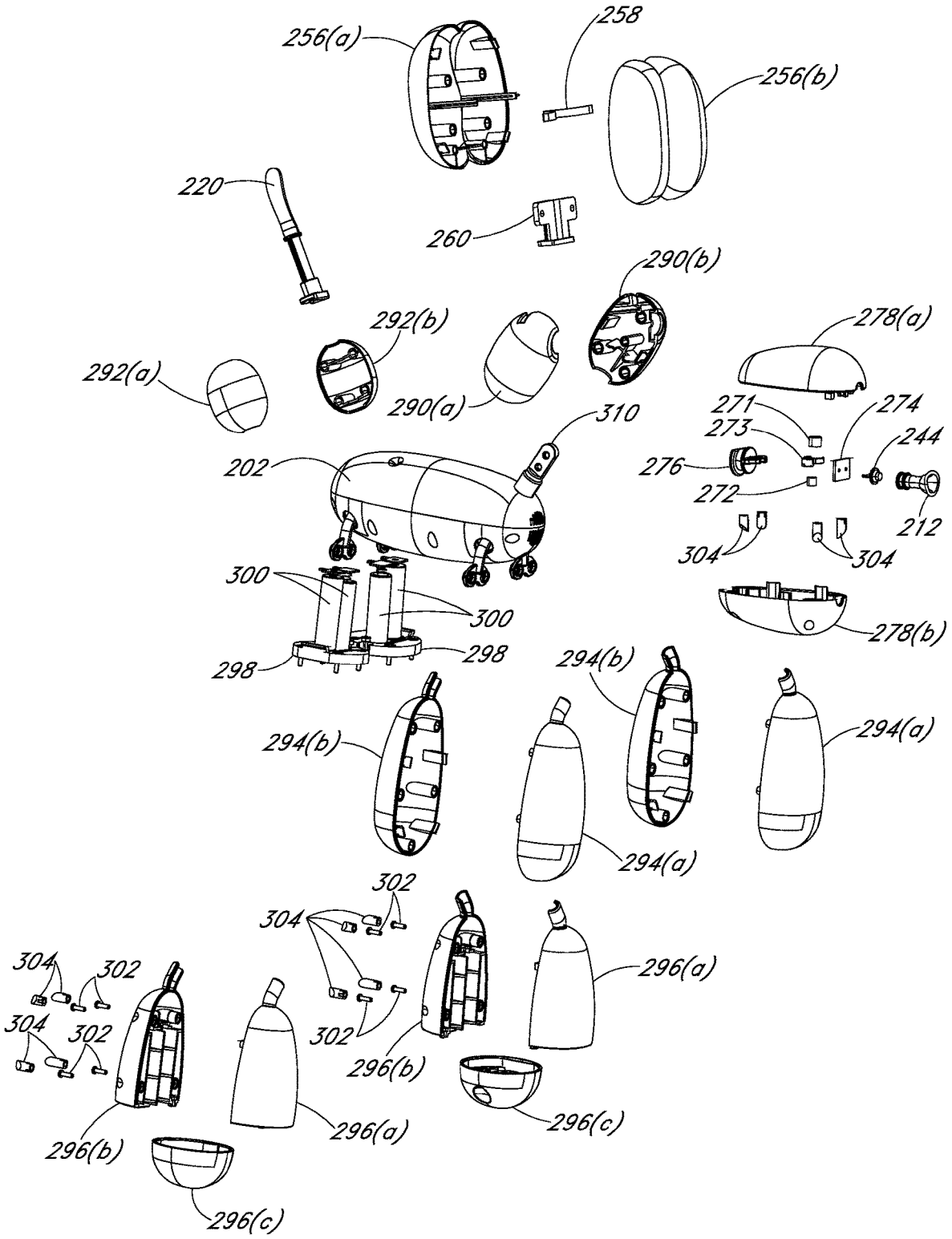
FIG. 56 is an exploded view of the toy of FIG. 42.

FIG. 56 is an exploded view of the toy 200 of FIG. 42. In the illustrated embodiment, the toy 200 comprises the torso 202. In certain embodiments, the tail 218 comprises tail shells 292(*a*), 292(*b*) which when assembled together form the tail 218. In certain embodiments, the tail 218 comprises the tip 220. In certain embodiments, a base portion of the tip 220 fits within the tail 218. A distal portion of the tip 220 extends from the tail 218. In certain embodiments, the tip 220 is made from a flexible material while the tail 218 is made from a plastic. In certain embodiments, the tip 220 is solid. In the illustrated embodiment, a diameter of the tip 220 is less than a maximum diameter of the tail 218.

In certain embodiments, the neck 206 comprises neck shells 290(*a*), 290(*b*) which when assembled together form the neck 206. In certain embodiments, the neck 206 is coupled to the torso via a neck joint 310. In certain embodiments, the neck joint 310 comprises a channel for wires to pass between the torso 202 and the neck 206.

In the illustrated embodiment, the ears 208 comprise ear shells 256(*a*), 256(*b*). In certain embodiments, the ear joint 260 couples the ear 208 to the neck 206. In the illustrated embodiment, a portion of the ear joint 260 is secured between the ear shells 256(*a*), 256(*b*). In certain embodiments, the toy 200 comprises the capacitive touch sensor 258 located on a front side of the ears 208. In certain embodiments, the ears 208 are movable relative to the neck 206. In the illustrated embodiment, the ears 208 are fixed relative to the neck 206. In the illustrated embodiment, the ears 208 are connected to form a unitary structure. In other embodiments, each ear 208 is a separate member coupled separately to the neck 206.

In the illustrated embodiment, the snout 210 comprises the snout shells 278(*a*), 278(*b*). In certain embodiments, the microphone 272 is disposed in the snout 210 in close proximity to the microphone opening 224 (FIG. 36). The microphone 272 is configured to sense sound. For example, in certain embodiments, the sound sensed by the microphone 272 causes the toy 200 to perform a play pattern. In certain embodiments, the microphone 272 is mounted on the PCB 274. Sound travels from the microphone opening 272 into the snout 210 above the microphone 272. The toy 200 can react in various ways to sounds detected by the microphone 272. In certain embodiments, the snout 210 is movable relative to the neck 206. In the illustrated embodiment, the snout 210 is fixed relative to the neck 206.

In certain embodiments, the snout 210 comprises the mouth 212. In the illustrated embodiment, at least a portion of the mouth 212 has a conical shape. In the illustrated embodiment, the mouth 212 is located on a distal end of the snout 210 opposite from the neck 206. In certain embodiments, the mouth 212 is movable relative to the snout 210. For example, in certain embodiments, movement of the mouth 212 triggers the switch 244. In certain embodiments, activation of the switch 244 causes the toy 200 to perform a play pattern. In the illustrated embodiment, the snout 210 is coupled to the neck 206 via a snout joint 276. In certain embodiments, the snout joint 276 comprises a channel for wires to pass between the snout 210 and the neck 206.

In certain embodiments, the toy 200 comprises one or more fasteners 302. The one or more fasteners 302 can be used to assemble the toy 200. For example, in certain embodiments, the one or more fasteners 302 secure shell components together. In certain embodiments, the toy 200 comprises one or more covers 304. In certain embodiments, the one or more covers 304 are press fit into the toy 200 and sized and shaped to cover the heads of the fasteners 302.

In certain embodiments, each of the front legs 214 comprises leg shells 294(*a*), 294(*b*). Each of the front legs 214 couple to a leg joint 324 of the front gearbox 314. In the illustrated embodiment, an end of the leg joints 324 is secured between the leg shells 294(*a*), 294(*b*) of each front leg 214.

In certain embodiments, each of the rear legs 214 comprises leg shells 296(*a*), 296(*b*), 296(*c*). Each of the rear legs 214 couple to a leg joint 344 of rear gearbox 316. In the illustrated embodiment, an end of the leg joints 344 is secured between the leg shells 296(*a*), 296(*b*) of each rear leg 214.

In certain embodiments, the legs 214 attach to the gearboxes 314, 316 via the leg joints 324, 344. In certain embodiments, the leg joints 324, 344 are solid plastic with steel inserts. In certain embodiments, the leg joints 324, 344 are molded from PVC. In certain embodiments, the leg joints 324, 344 are springy to allow the toy 200 to bounce during animation movements. In certain embodiments, the wall thickness of the leg joints 324, 344 can be designed to prevent accidental damage. In certain embodiments, the leg joints 324, 344 include a pass through passage to allow wires to travel through the toy 200.

In the illustrated embodiment, the leg shell 296(*c*) covers a battery compartment within the rear leg 214. In this way, the battery compartment of each rear leg 214 receives a battery assembly 298. In certain embodiments, each battery assembly 298 includes two AA batteries 300. In this way, in certain embodiments, the toy 200 is powered by a total of four AA batteries 300. Each battery assembly 298 provides electrical connections between electronics of the toy 200 and batteries 300.

FIG. 57 is an exploded view of a body 201 of the toy 200 of FIG. 56. In the illustrated embodiment, the torso 202 comprises torso shells 270(*a*), 270(*b*), 270(*c*), 270(*d*). In certain embodiments, a lower half of the torso 202 comprises the torso shells 270(*b*), 270(*c*), 270(*d*). In certain embodiments, the gearboxes 314, 316 are disposed in the torso 202. The torso shells 270(*c*), 270(*d*) and the torso shell 270(*a*) form rear and front ends of the torso 202. In certain embodiments, the neck joint 310 couples the neck 206 to the torso 202.

In certain embodiments, the toy 200 comprises the printed circuit board (PCB) 284. In certain embodiments, the PCB 284 is disposed in the torso shell 270(*b*). In certain embodiments, the holder 286, the light 230, and the on/off switch 228 are support by the PCB 284. In certain embodiments, the holder 286 includes receiving slots configured to receive the one or more tilt sensors 288. In certain embodiments, the receiving slots hold the one or more tilt sensors 288 at different orientations. In certain embodiments, the one or more tilt sensors 288 identify when changes occur to the orientation of the toy 200. In certain embodiments, the one or more tilt sensors 288 identify the orientation of the toy 200. In certain embodiments, the one or more tilt sensors 288 identify when the toy 200 is in the standing, sitting, or lying positions. In certain embodiments, the one or more tilt sensors 288 work together to identify the current position of the toy 200. In certain embodiments, the orientation sensed by the one or more tilt sensors 288 is used to activate and/or change play patterns including interactions/sounds/animations.

In certain embodiments, during the peeing play pattern the rear legs 214 rotate to drop a rear portion of the torso 202 and the light 230 illuminates. In certain embodiments, the light 230 is a yellow LED. Of course, the light 230 is not limited to an LED type light and can be any other type of light. In other embodiments, the light 230 is a different color than yellow.

In certain embodiments, the on/off switch 228 includes an on position which activates the toy 200 and an off position which deactivates the toy 200. In certain embodiments, the on/off switch 228 is located on the bottom of the torso 202. In certain embodiments, the on/off switch 228 is at least partially recessed below the surface of the torso 202.

In certain embodiments, the toy 200 comprises a support 318 disposed in the torso 202. In certain embodiments, the support 318 supports the PCB 284 relative to the torso 202. In certain embodiments, the toy 200 comprises gearbox supports 312 disposed in the torso 202. In certain embodiments, the gearbox supports 312 support the gearboxes 314, 316 relative to the torso 202.

In certain embodiments, the capacitive touch sensor 268 is disposed in a recess in the torso shell 270(*b*). In certain embodiments, the capacitive touch sensor 268 is configured as a metal plate.

In certain embodiments, the toy 200 comprises one or more fasteners 302. The one or more fasteners 302 can be used to assemble the toy 200. For example, in certain embodiments, the one or more fasteners 302 secure shell components together. In certain embodiments, the toy 200 comprises one or more covers 304. In certain embodiments, the one or more covers 304 are press fit into the toy 200 and sized and shaped to cover the heads of the fasteners 302.

FIG. 58 is an exploded view of a rear subassembly from FIG. 57. In certain embodiments, the rear subassembly comprises the rear gearbox 316 and the battery assemblies 298. In certain embodiments, the rear gearbox 316 is designed to be sub assembled and modular. In certain embodiments, the rear gearbox 316 and the front gearbox 314 are identical. Of course, the rear gearbox 316 and the front gearbox 314 need not be identical and can comprise components that are present in only one of the gearboxes 314, 316. In certain embodiments, the two rear legs 214 are permanently linked to the rear gearbox 316 via one or more gears 326. In certain embodiments, the rear legs 214 are permanently linked to the rear gearbox 316 via a large bevel gear 326. In certain embodiments, a ratio is achieved through a combination of the gears 326 including one or more worm gears and spur gears. In certain embodiments, the rear gearbox 316 simultaneously moves both of the rear legs 214. For example, movement of the left rear leg 214 can mirror the movement of the right rear leg 214. For example, when the left rear leg moves in an outward left direction from the torso 202, the right rear leg moves in an outward right direction from the torso 202.

In certain embodiments, the rear gearbox 316 comprises a clutch. In certain embodiments, the clutch comprises one or more gears 326. In certain embodiments, the clutch is disposed between the motor 336 and the leg joints 324 to prevent damage to the gears 326 during rough play. In certain embodiments, the rear gearbox 316 comprises gearbox shells 320(*a*), 320(*b*). In certain embodiments, the gearbox shells 320(*a*), 320(*b*) are aligned with the drive axis of the rear legs 214.

In certain embodiment, the rear gearbox 316 comprises one or more springs 328 and one or more shafts 330 configured to support one or more of the gears 326. In certain embodiment, the rear gearbox 316 comprises one or more springs 308 and one or more bushings 309 configured to support the leg joints 324.

In certain embodiments, the rear subassembly further comprises two end plates 322(*a*), 322(*b*) configured to support the leg joints 324 of the rear legs 214. In certain embodiments, the two end plates 322(*a*), 322(*b*) attach to the gearbox shells 320(*a*), 320(*b*).

In certain embodiments, the rear subassembly further supports the PCB 282 and the switch 280. In certain embodiments, activation of the switch 280 causes the toy 200 to perform a play pattern. In certain embodiments, pressing the switch 280 of the toy 200 will cause the toy 200 to 'electronically' perform a pop or deflate sequence with animation/sound effects.

In certain embodiments, the toy 200 comprises one or more gearbox sensors. In certain embodiments, the sensors can include a potentiometer/encoder 332. Exemplary methods for detection of the position of the pair of rear legs 214 include 1) digital encoder 332 with a home microswitch 334 and 2) a continuous rotation potentiometer 332. For example, the encoder method can use a standard mechanical encoder 332 in certain embodiments. In certain embodiments, the encoder 332 is absolute and is geared to the output of the rear legs 214 with a 1:1 relationship. In certain embodiments, the toy 200 includes a separate 'home' microswitch 334 to address component and build tolerances. The rear gearbox 316 can home each time the toy 200 is switched ON. For example, the potentiometer method can use a continuous rotation potentiometer 332. A voltage can be read to determine the current position. In certain embodiments, a pot frame 306 supports the potentiometer/encoded 332. In certain embodiments, the position sensor(s) work directly on the output, so are not impacted by the clutch being activated.

In certain embodiments, the toy 200 comprises one or more joint retainers 338. The one or more joint retainers 338 can be configured to support the tail 218.

In certain embodiments, the toy 200 comprises one or more fasteners 302. The one or more fasteners 302 can be used to assemble the toy 200. For example, in certain embodiments, the one or more fasteners 302 secure battery assembly 298 components together.

FIG. 59 is an exploded view of a front subassembly from FIG. 57. In certain embodiments, the front subassembly comprises the front gearbox 314. In certain embodiments, the front gearbox 314 is designed to be sub assembled and modular. In certain embodiments, the front gearbox 314 and the rear gearbox 316 are identical. Of course, the front gearbox 314 and the rear gearbox 316 need not be identical and can comprise components that are present in only one of the gearboxes 314, 316. In certain embodiments, the front legs 214 are permanently linked to the front gearbox 314 via one or more gears 326. In certain embodiments, the front legs 214 are permanently linked to the front gearbox 314 via a large bevel gear 326. In certain embodiments, a ratio is achieved through a combination of gears 326 including one or more worm gears and spur gears. In certain embodiments, the front gearbox 314 simultaneously moves both of the front legs 214. For example, movement of the left front leg 214 can mirror the movement of the right front leg 214. For example, when the left front leg moves in an outward left direction from the torso 202, the right front leg moves in an outward right direction from the torso 202.

In certain embodiments, the front gearbox 314 comprises a clutch. In certain embodiments, the clutch comprises one or more gears 326. In certain embodiments, the clutch is disposed between a motor 336 and the leg joints 344 to prevent damage to the gears 326 during rough play. In certain embodiments, the front gearbox 314 comprises gearbox shells 340(*a*), 340(*b*). In certain embodiments, the gearbox shells 340(*a*), 340(*b*) are aligned with the drive axis of the front legs 214.

In certain embodiment, the front gearbox 314 comprises one or more springs 328 and one or more shafts 330 configured to support one or more of the gears 326.

In certain embodiments, the front subassembly further comprises two end plates 342(*a*), 342(*b*) configured to support the leg joints 344 of the front legs 214. In certain embodiments, the two end plates 342(*a*), 342(*b*) attach to the gearbox shells 340(*a*), 340(*b*).

In certain embodiments, the front subassembly further supports the speaker 346. In certain embodiments, the speaker 346 emits sounds as part of the play patterns.

In certain embodiments, the toy 200 comprises one or more gearbox sensors. In certain embodiments, the sensors can include a potentiometer/encoder 332. Exemplary methods for detection of the position of the pair of front legs 214 include 1) digital encoder 332 with a home microswitch 334 and 2) a continuous rotation potentiometer 332. For example, the encoder method can use a standard mechanical encoder 332 in certain embodiments. In certain embodiments, the encoder 332 is absolute and is geared to the output of the front legs 214 with a 1:1 relationship. In certain embodiments, the toy 200 includes a separate 'home' microswitch 334 to address component and build tolerances. The front gearbox 314 can home each time the toy 200 is switched ON. For example, the potentiometer method can use a continuous rotation potentiometer 332. A voltage can be read to determine the current position. In certain embodiments, a pot frame 306 supports the potentiometer/encoded 332. In certain embodiments, the position sensor(s) work directly on the output, so are not impacted by the clutch being activated.

In certain embodiments, the toy 200 comprises one or more joint retainers 338. The one or more joint retainers 338 can be configured to support the neck 206.

Figure 60B:
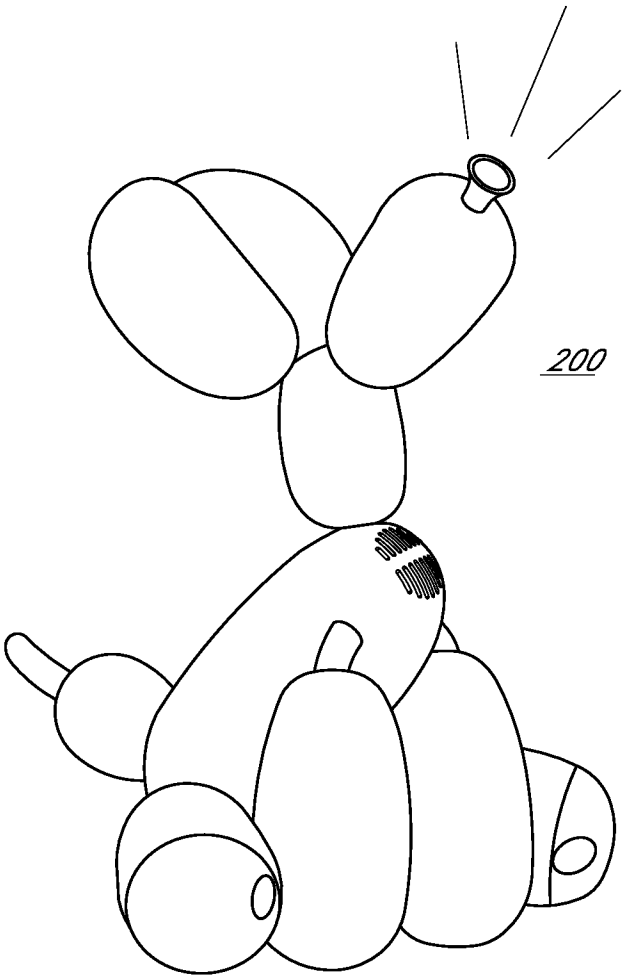
FIGS. 60A and 60B are views of a petting play pattern performed by the toy of FIG. 42.
Figure 60A:
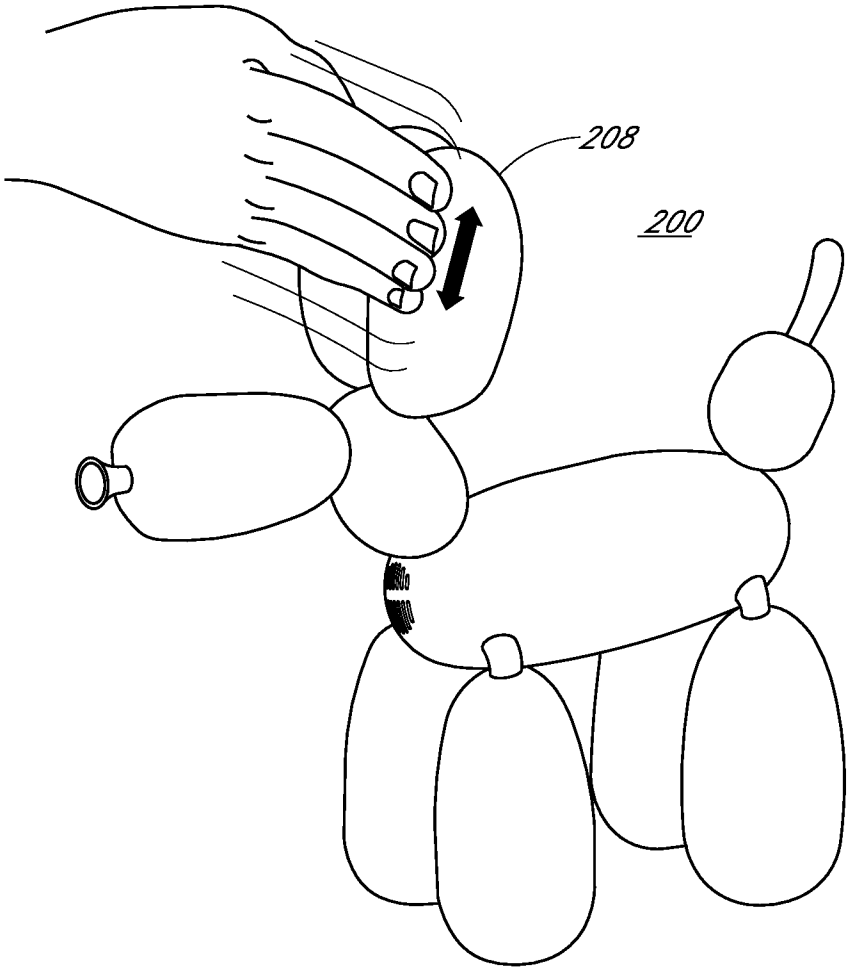

FIGS. 60A and 60B are views of a petting play pattern performed by the toy 200 of FIG. 42. In certain embodiments, the features/inputs of the toy 200 include petting the head. In certain embodiments, petting the head (FIG. 60A) causes the toy 200 to alternate between a sitting position (FIG. 60B) and an inflating position (FIG. 60A) (for example, stands up from any position). In the illustrated embodiment, the capacitive touch sensor 258 senses the user patting the ears 208 of the toy 200. In certain embodiments, in response to the capacitive touch sensor 258 sensing hand patting of the ears 208, the toy 200 performs the petting play pattern.

In certain embodiments, the toy 200 reacts to the capacitive touch sensor 258 sensing the user's hand by moving from a first position to a second position and/or making one or more sounds. For example, in certain embodiments, the toy 200 moves from a standing position (FIG. 60A) to a sitting position (FIG. 60B) in response to petting. For example, in certain embodiments, the toy 200 moves from a sitting position (FIG. 60B) to a standing position (FIG. 60A) in response to petting of the ears 208. For example, in certain embodiments, prior to, during, or after the toy 200 moves between the first and second positions, the toy 200 can emit one or sounds from the speaker 346. In certain embodiments, the sound is a triumphant sound. In certain embodiments, the toy 200 determines its position based on input from the one or more tilt sensors 288.

Figure 61B:
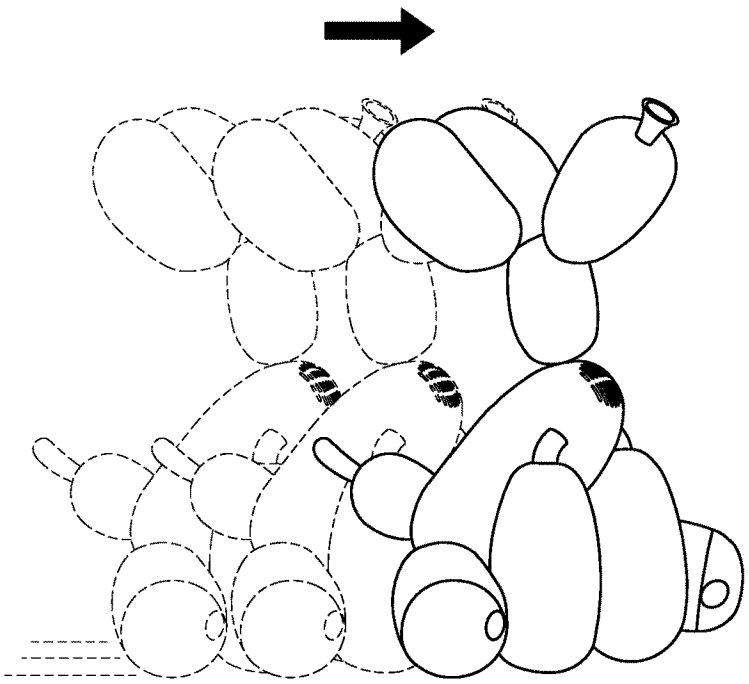
FIGS. 61A and 61B are views of a shake play pattern performed by the toy of FIG. 42.
Figure 61A:
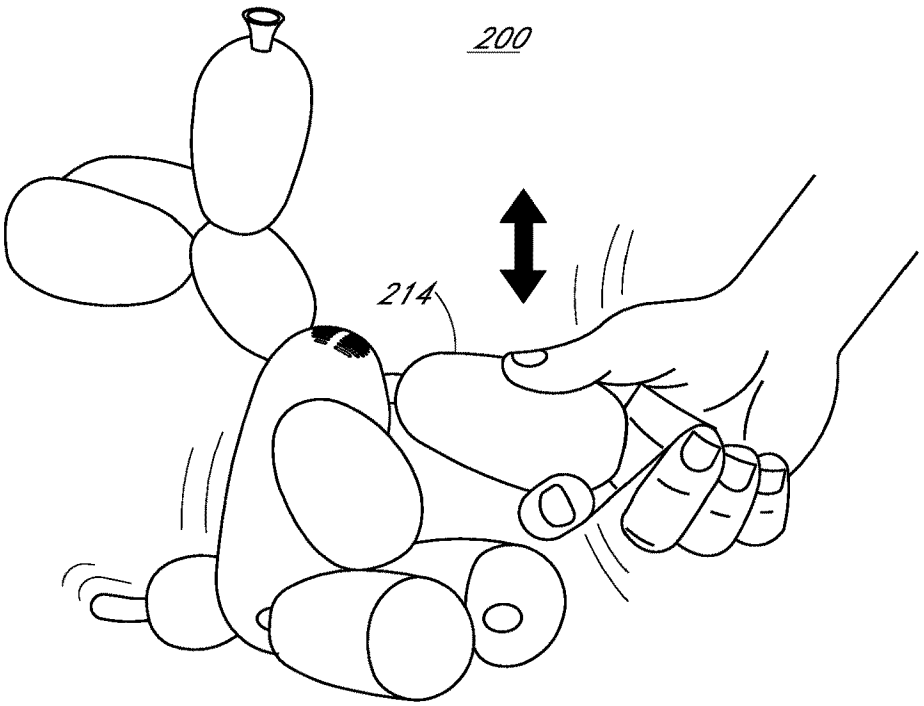

FIGS. 61A and 61B are views of a shake play pattern performed by the toy 200 of FIG. 42. In certain embodiments, the features/inputs of the toy 200 include shaking the front legs 214. In certain embodiments, this feature is only active when the toy 200 is in a sitting position. In certain embodiments, the toy 200 determines its position based on input from the one or more tilt sensors 288. In certain embodiments, in response to the user shaking the front legs 214 (FIG. 61A), the toy 200 moves the front and rear legs 214 to scoot across the floor (FIG. 61B).

Figures 62A, 62B, 62C:
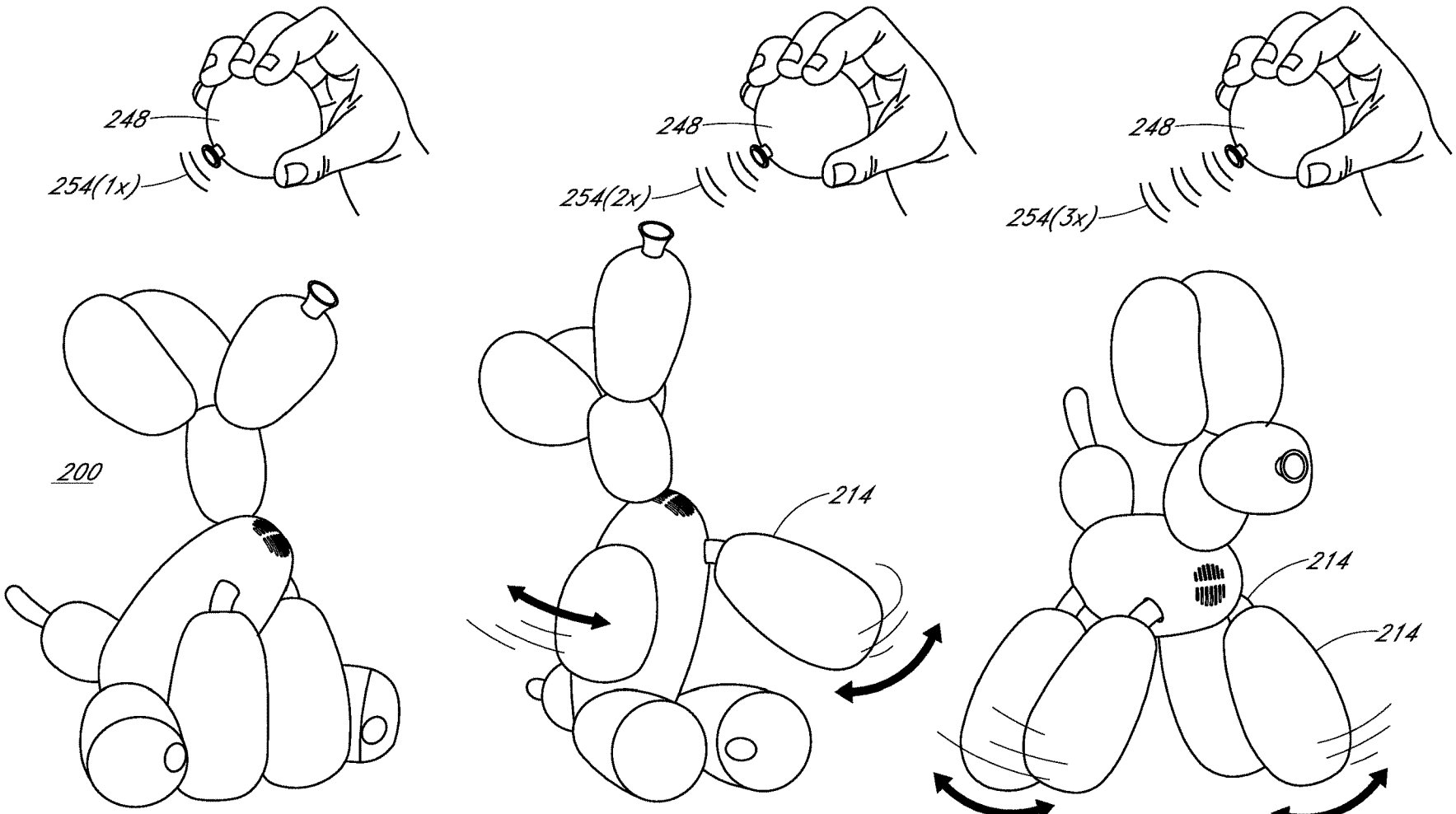
FIGS. 62A-62C are views of a training play pattern performed by the toy of FIG. 42.

FIGS. 62A-62C are views of a training play pattern performed by the toy 200 of FIG. 42. In certain embodiments, the features/inputs of the toy 200 includes a sound producing accessory. Exemplary sound producing accessories include a clicker, a squeaker toy 248, and a whistle. Of course, the sound producing accessory is not limited to the devices listed and further includes other devices known to a person having ordinary skill in the art.

In certain embodiments, the squeaker toy 248 works with the microphone 272 to cause the toy 200 to move to a predetermined position. In certain embodiments, one sound causes the toy 200 to move its legs 214 to sit (FIG. 62A). In certain embodiments, two repetitive sounds cause the toy 200 to move its legs 214 to beg (FIG. 62B). In certain embodiments, three repetitive sounds cause the toy 200 to move the legs 214 to become excited (FIG. 62C). These positions are only exemplary. In certain embodiments, the toy 200 determines its position based on input from the one or more tilt sensors 288.

In certain embodiments, the microphone 272 senses the frequency of the sound created by the sound producing accessory. For example, in certain embodiments, the microphone 272 detects the sound. In certain embodiments, the toy 200 analyzes a frequency of the sound detected by the microphone 272. Based on the detected frequency, the toy 200 moves to a predetermined position. In certain embodiments, a first sound producing accessory creates a sound having a first frequency. In certain embodiments, a second sound producing accessory creates a sound having a second frequency. In certain embodiments, the toy 200 moves to a first predetermined position in response to a sound of the first frequency and to a second predetermined position in response to a sound of the second frequency. The number of positions and frequencies are only exemplary.

Figure 63:
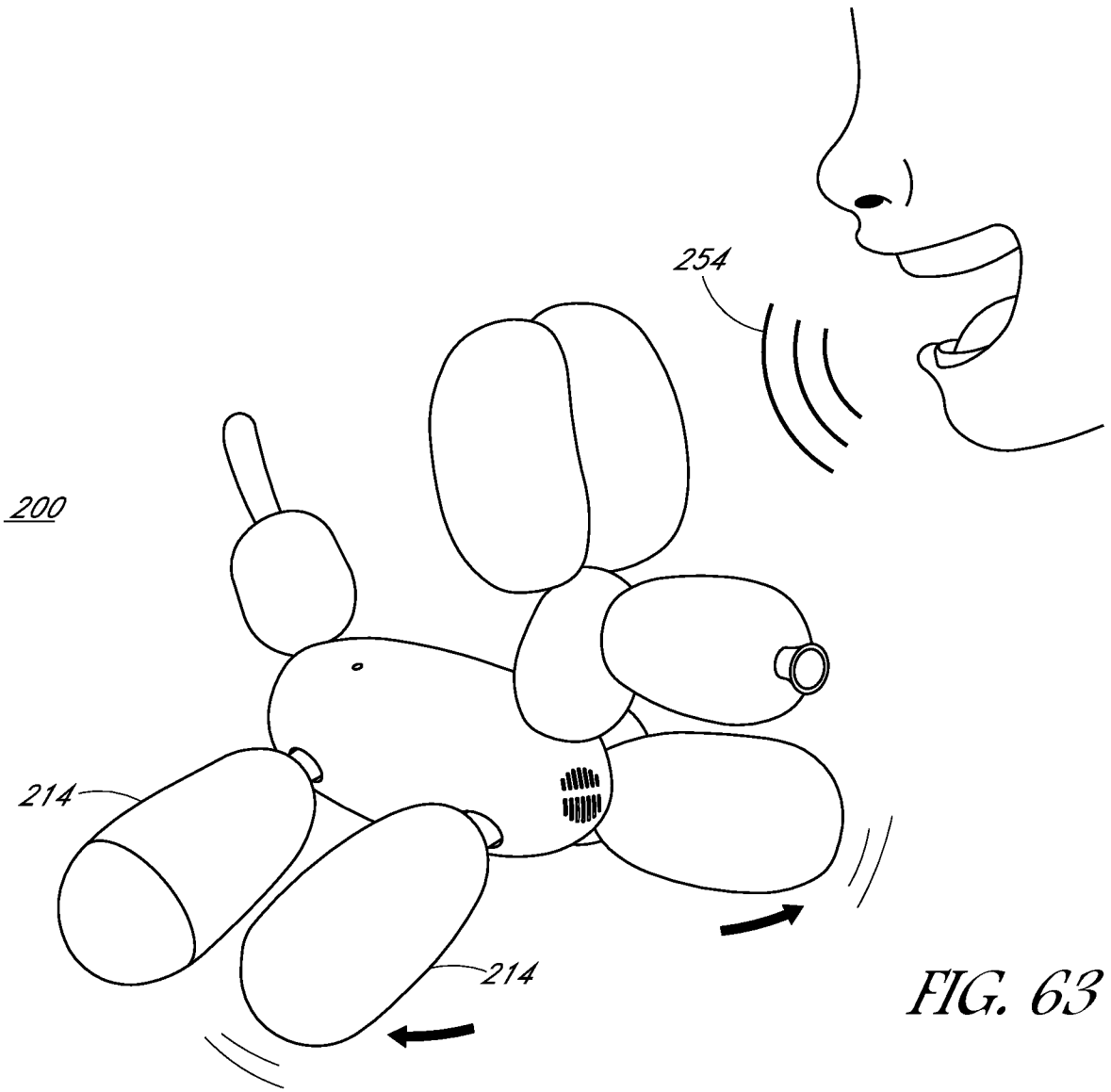
FIG. 63 is a view of an audible sound play pattern performed by the toy of FIG. 42.

FIG. 63 is a view of an audible sound play pattern performed by the toy of FIG. 42. The toy 200 reacts when the user makes sounds. For example, the toy 200 can bark back at you in response to the user making the sound. In certain embodiments, the features/inputs of the toy 200 include volume detection. In certain embodiments, in response to the user yelling, the toy 200 whimpers. Eventually the toy 200 can poop and then deflate. In certain embodiments, in response to the user talking softly, the toy acts happy and playful.

Figure 64A:
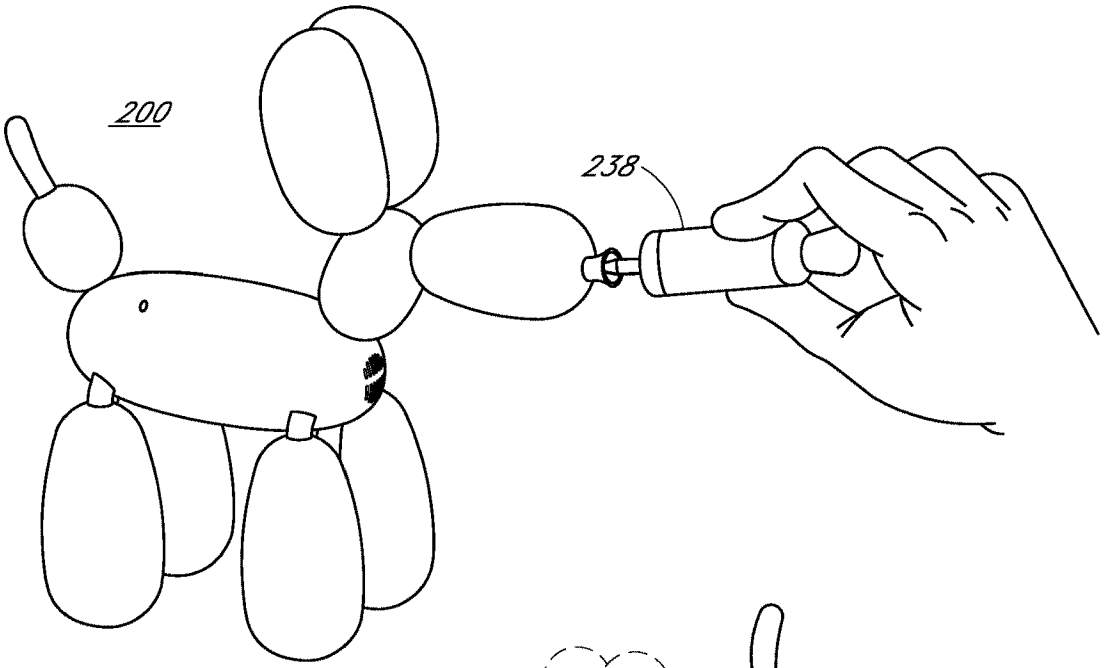
FIGS. 64A-64C are views of a feeding play pattern performed by the toy of FIG. 42.
Figure 64B:
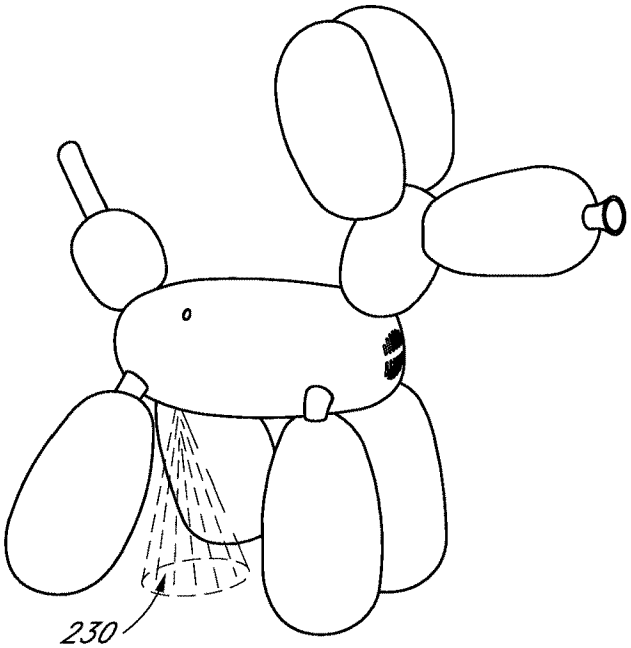
Figure 64C:
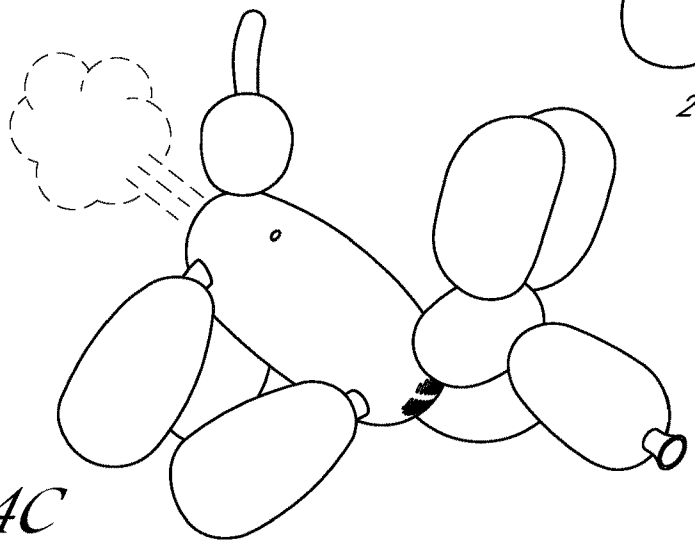

FIGS. 64A-64C are views of a feeding play pattern performed by the toy 200 of FIG. 42. In certain embodiments, the features/inputs of the toy 200 include after feeding to randomly select one of peeing (spreads legs 214 and yellow LED light 230 shines on table) and farting (deflates by face planting, then rolling on to the side of the toy with legs apart).

In certain embodiments, pressing the mouth 212 of the toy 200 into the snout 210 when the toy 200 is standing will cause the toy 200 to 'electronically' perform the feeding sequence with animation/sound effects. In certain embodiments, after feeding the toy 200 (FIG. 64A) will either pee (FIG. 64B) or fart (FIG. 64C). In certain embodiments, the processor 348 and or memory 350 selects whether the feeding sequence includes the pee or the fart. In certain embodiments, prior to peeing the speaker 346 can emit a 'wimper' sound and scoot about. In certain embodiments, during peeing the rear legs 214 rotate to drop his rear and the light 230 illuminates (FIG. 64B). In certain embodiments, the speaker 346 further emits matching sound effects to simulate peeing. In certain embodiments, the light 230 is a yellow LED.

In certain embodiments, when the toy 200 is to fart, the toy 200 drops its front end by rotating the front legs 214 while the speaker 346 emits a farting sound (FIG. 64C). Afterwards the toy 200 falls over before standing up again.

In certain embodiments, an accessory in the form of the pump 238 (FIG. 43), for example, is pressed against the mouth 212 to push the mouth 212 into the snout 210. The pump 238 provides a way for the user to active the feeding sequence. Of course, the user can also activate the feeding sequence without the pump 238 by pressing the mouth 212 into the snout 210 with their hand. In certain embodiments, the pump 238 includes no moving parts. In certain embodiments, the toy 200 determines its position based on input from the one or more tilt sensors 288.

Figure 65B:
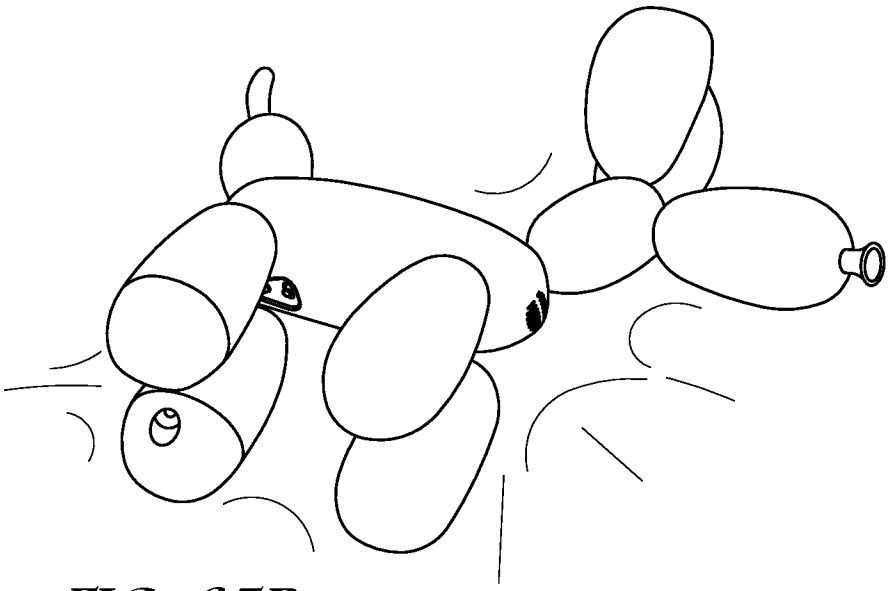
FIGS. 65A and 65B are views of a pop play pattern performed by the toy of FIG. 42.
Figure 65A:
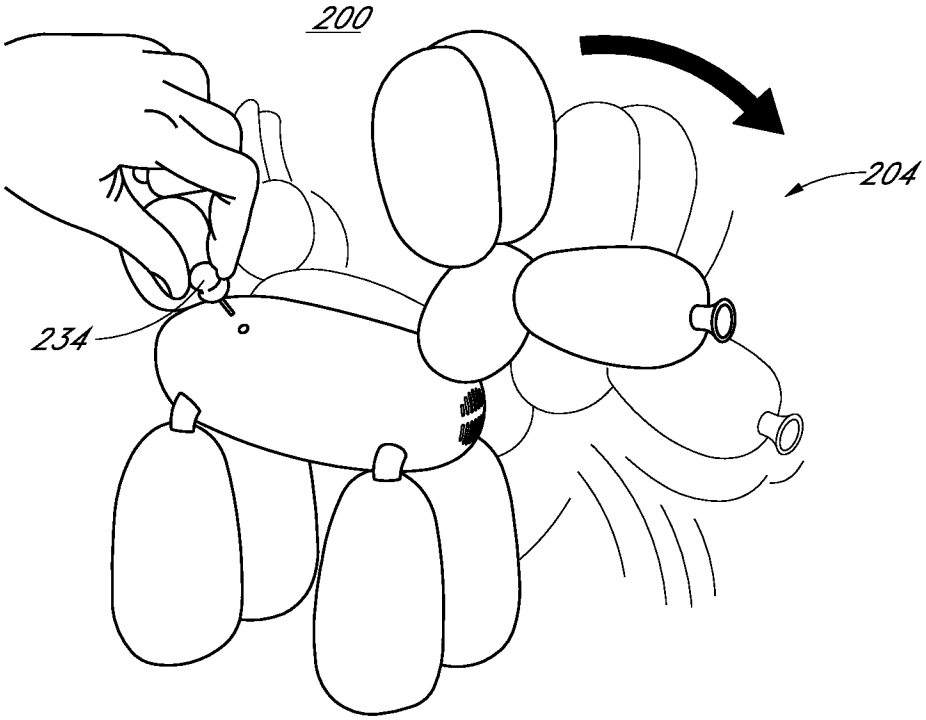

FIGS. 65A and 65B are views of a pop play pattern performed by the toy 200 of FIG. 42. In certain embodiments, pressing the switch 280 of the toy 200 (FIG. 65A) will cause the toy 200 to 'electronically' perform a pop or deflate sequence (FIG. 65B) with animation/sound effects. In certain embodiments, after activating the switch 280 the toy 200 suddenly moves from a standing position (FIG. 65A) to a lying position (FIG. 65B). In certain embodiments, once the switch 280 is activated, the front legs 214 quickly spread apart causing the head 204 to fall to the ground. In certain embodiments, after the head 204 falls to the ground, the front legs 214 further move causing the toy 200 to roll onto its side. In certain embodiments, prior to the front legs 214 spreading apart, the speaker 346 can emit a 'balloon pop' sound. In certain embodiments, the toy 200 determines its position based on input from the one or more tilt sensors 288.

Figure 66A:
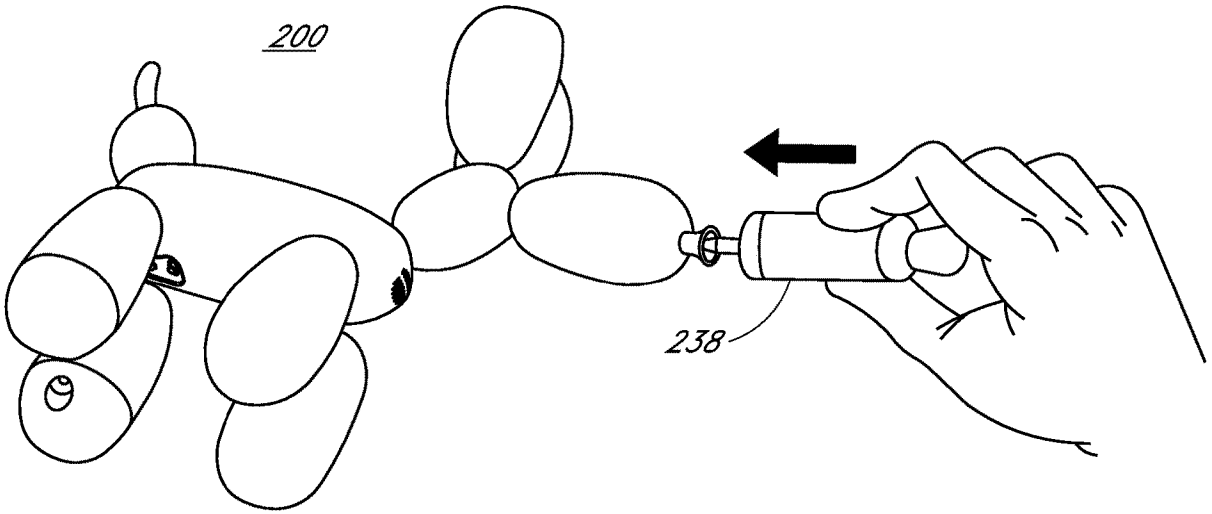
FIGS. 66A and 66B are views of an inflate play pattern performed by the toy of FIG. 42.
Figure 66B:
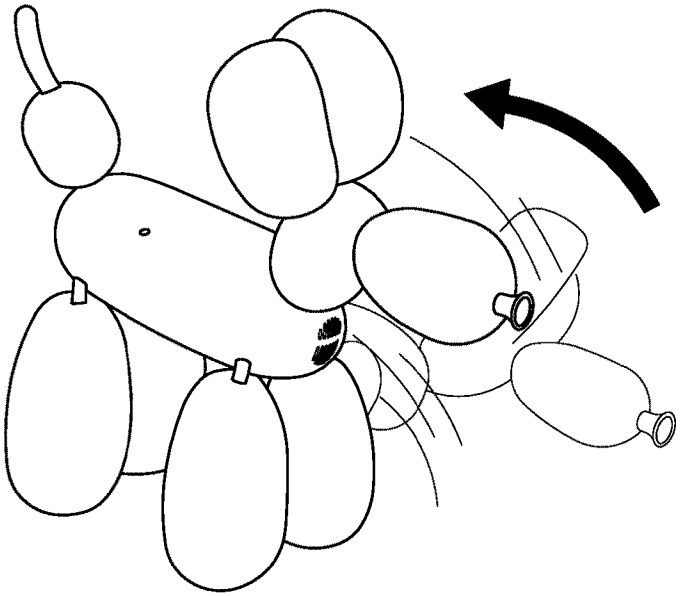

FIGS. 66A and 66B are views of an inflate play pattern performed by the toy 200 of FIG. 42. In certain embodiments, the features/inputs of the toy 200 include placing the pump 238 into the mouth 212 causes the toy 200 to inflate (for example, rolls back and stands). In certain embodiments, pressing the mouth 212 of the toy 200 into the snout 210 when the toy 200 is in the lying position (FIG. 66A) will cause the toy 200 to 'electronically' perform the inflate sequence with animation/sound effects. In certain embodiments, the inflate sequence includes the toy 200 moving the legs 214 to reach the standing position (FIG. 66B). In certain embodiments, the processor 348 and/or memory 350 provide instructions to the motors 336 and the gearboxes 314, 316 for moving the legs 214. In certain embodiments, the toy 200 initially moves the rear legs 214, then moves the front legs 214, and then moves both the front and rear legs 214 to complete the inflate sequence and reach the standing position. In certain embodiments, the speaker 346 further emits matching sound effects to simulate inflating. In certain embodiments, the toy 200 determines its position based on input from the one or more tilt sensors 288.

Figure 67A:
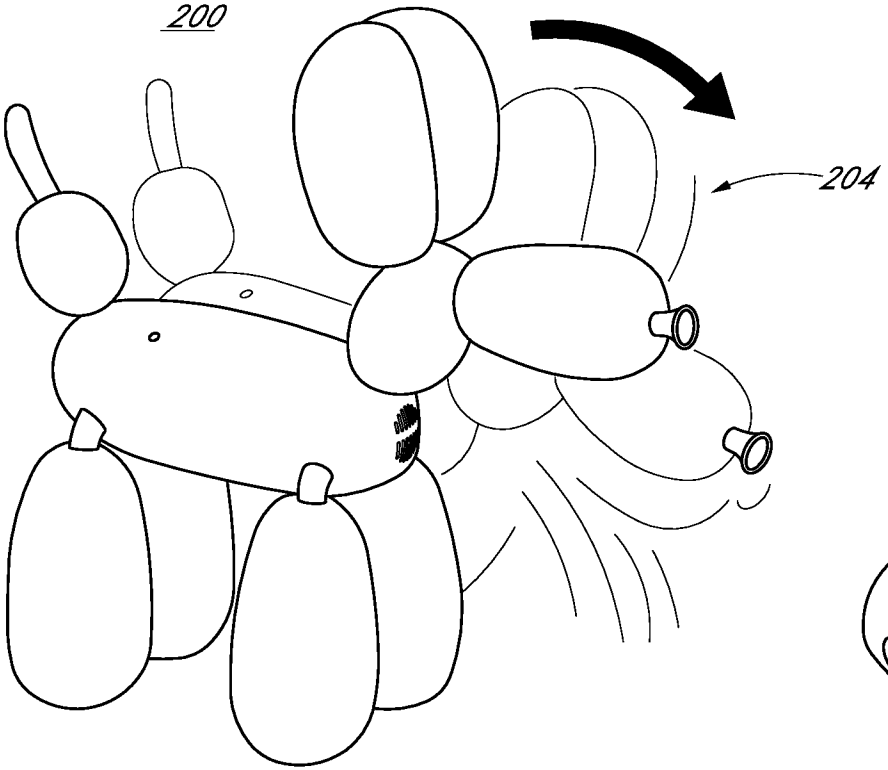
FIGS. 67A and 67B are views of a tickle play pattern performed by the toy of FIG. 42.
Figure 67B:
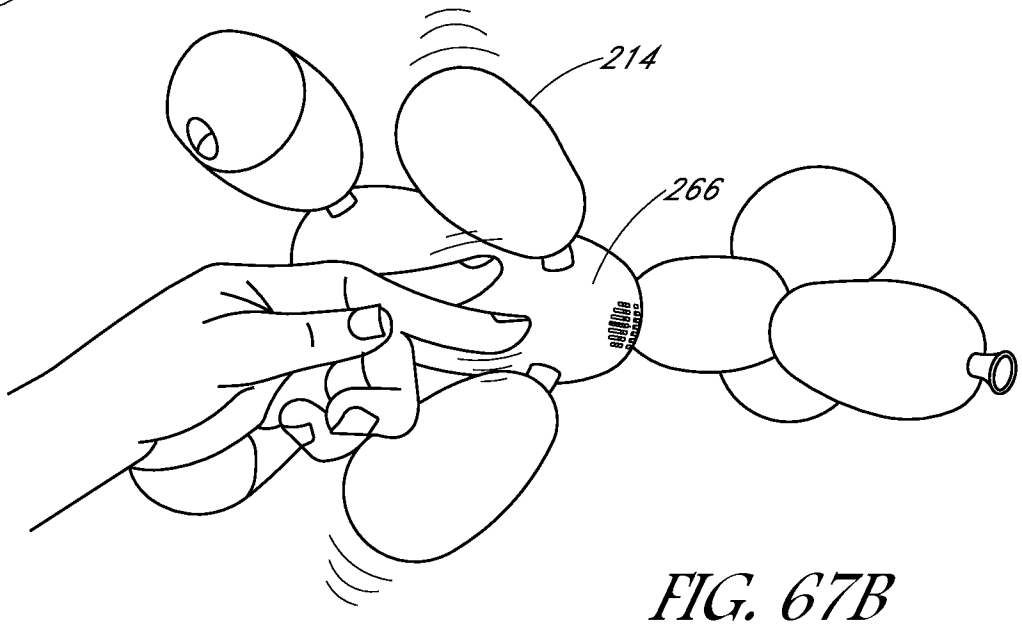

FIGS. 67A and 67B are views of a tickle play pattern performed by the toy 200 of FIG. 42. In certain embodiments, the features/inputs of the toy 200 include when the toy 200 is lying down to cry for the user to tickle the tummy 266 or pick up the toy 200. In certain embodiments, the features/inputs of the toy 200 include to tickle the toy's tummy 266 causing the toy to shake its legs 214. In certain embodiments, this feature is only active when the toy 200 is lying down.

In the illustrated embodiment, the capacitive touch sensor 268 senses the user ticking the tummy 266 of the toy 200 (FIG. 67B). In certain embodiments, in response to the capacitive touch sensor 268 sensing hand tickling of the tummy 266, the toy 200 performs a play pattern. In certain embodiments, the toy 200 reacts to the capacitive touch sensor 268 sensing the user's hand by moving from a first position to a second position and/or making one or more sounds. For example, in certain embodiments, the toy 200 moves from a standing position (FIG. 67A) to a lying position (FIG. 67B) in response to tickling. For example, in certain embodiments, prior to, during, or after the toy 200 moves between the first and second positions, the toy 200 can emit one or sounds from the speaker 346. In certain embodiments, the sound is a laughing sound. In certain embodiments, the toy 200 determines its position based on input from the one or more tilt sensors 288.

Figure 68:
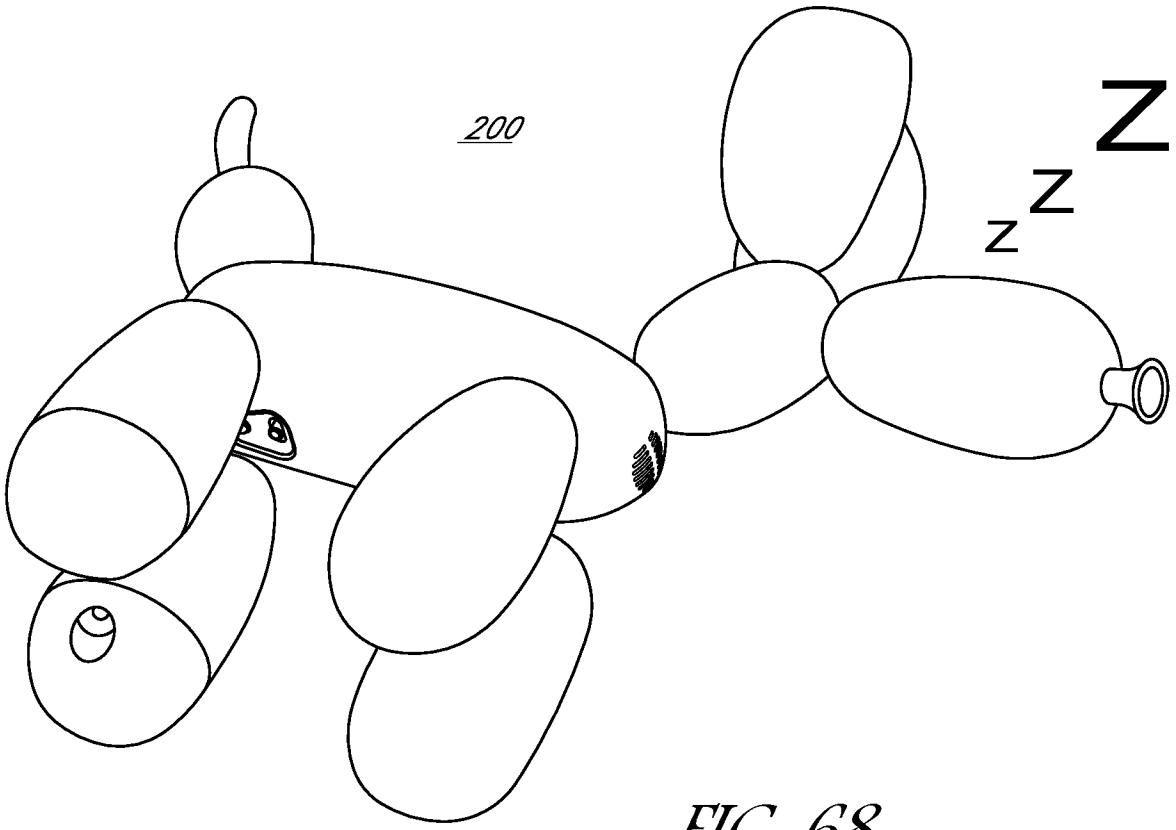
FIG. 68 is a view of a sleeping play pattern performed by the toy of FIG. 42.

FIG. 68 is a view of a sleeping play pattern performed by the toy 200 of FIG. 42. In certain embodiments, the features/inputs of the toy 200 include when there is no input. For example, when the user leaves the toy 200 alone the toy 200 will periodically perform random animations to get the user's attention. For example, if the user does not interact with the toy 200 for a long time, the toy 200 will eventually deflate. In certain embodiments, the toy 200 determines its position based on input from the one or more tilt sensors 288.

Figure 69:
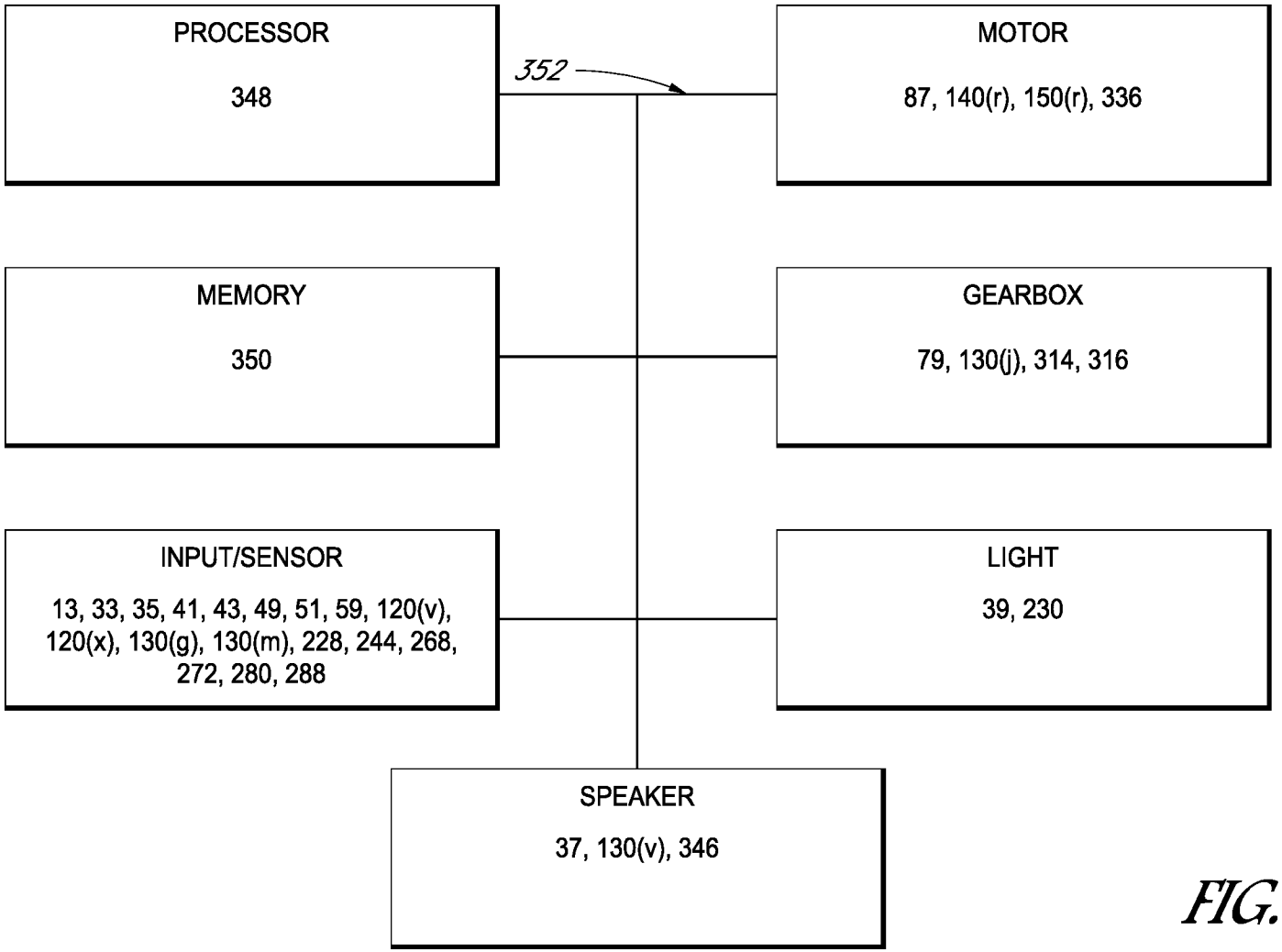
FIG. 69 is a schematic view of certain components from the embodiments of the toy from FIGS. 1-68.

FIG. 69 is a schematic view of certain components from the embodiments of the toy 1, 200 from FIGS. 1-68. In certain embodiments, the toy 1, 200 includes a processor 348, a memory 350, and a toy or system bus 352. In certain embodiments, the processor 348 and memory 350 are implemented as an ASIC.

In certain embodiments, the system bus 352 couples various toy components including, for example, the processor 348, the memory 350, and one or more of the input/sensor(s) 13 (mouth), 33 (cap sensor), 35 (cap sensor), 41 (hall sensor), 43 (push/pull switch), 49 (microphone), 51 (jiggle switch), 53 (tilt switch), 59 (on/off switch), 120(*v*) (Cap Strip), 120(*x*) (Hall Sensor PCBA), 130(*g*) (Switch Cap), 130(*m*) (Cap Sensor Strip), 228 (on/off switch), 244 (switch), 268 (capacitive touch sensor), 272 (microphone), 280 (switch), 288 (tilt sensor). Of course, the toy 1, 200 can include more or less than the listed components. The system bus 352 may be any of several types of bus structures. In certain embodiments, the memory 350 includes read only memory (ROM) and/or random access memory (RAM).

In certain embodiments, stored on the memory 350 are software modules. In certain embodiments, the software modules can include one or more application programs, other program modules, and program data. In certain embodiments, the software modules can include an application program configured to receive user and/or sensor input to one or more of the input/sensor(s) 13 (mouth), 33 (cap sensor), 35 (cap sensor), 41 (hall sensor), 43 (push/pull switch), 49 (microphone), 51 (jiggle switch), 53 (tilt switch), 59 (on/off switch), 120(*v*) (Cap Strip), 120(*x*) (Hall Sensor PCBA), 130(*g*) (Switch Cap), 130(*m*) (Cap Sensor Strip), 228 (on/off switch), 244 (switch), 268 (capacitive touch sensor), 272 (microphone), 280 (switch), 288 (tilt sensor) for the play patterns of the toy 1, 200.

In certain embodiments, one or more of the input/sensor (s) 13 (mouth), 33 (cap sensor), 35 (cap sensor), 41 (hall sensor), 43 (push/pull switch), 49 (microphone), 51 (jiggle switch), 53 (tilt switch), 59 (on/off switch), 120(*v*) (Cap Strip), 120(*x*) (Hall Sensor PCBA), 130(*g*) (Switch Cap), 130(*m*) (Cap Sensor Strip), 228 (on/off switch), 244 (switch), 268 (capacitive touch sensor), 272 (microphone), 280 (switch), 288 (tilt sensor) connect within the system bus 352 via one or more wires (not shown).

In certain embodiments, the processor 348 and/or memory 350 provide instructions to one or more of the motor 87, 140(*r*), 150(*r*), 336, gearbox 79, 130(*j*), 314, 316, light 39, 230, and/or speaker 37, 130(*v*), 346 to perform one or more of the play patterns of the toy 1, 200.

Terminology

Although certain embodiments and examples are disclosed herein, inventive subject matter extends beyond the examples in the specifically disclosed embodiments to other alternative embodiments and/or uses, and to modifications and equivalents thereof. Thus, the scope of the claims appended hereto is not limited by any of the particular embodiments described above. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

For expository purposes, the term "horizontal" as used herein is defined as a plane parallel to the plane or surface of the floor or ground of the area in which the device being described is used or the method being described is performed, regardless of its orientation. The term "floor" floor can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

Although the balloon animal has been disclosed in the context of certain embodiments and examples, it will be understood by those skilled in the art that the balloon animal and subassemblies extends beyond the specifically disclosed embodiments to other alternative embodiments and/or uses of the embodiments and certain modifications and equivalents thereof.

What is claimed is:

1. An interactive toy comprising:

a body;

one or more sensors disposed within the body and configured to receive input from a user;

a first electric motor and a second electric motor disposed in the body;

a plurality of limbs, each limb coupled to the body via a joint, each joint configured to adopt a plurality of positions relative to the body depending at least in part on the input;

a first bevel gear coupled to first and second front legs of the plurality of limbs and the first electric motor so as to transfer motion from the first electric motor to the first and second front legs;

a second bevel gear coupled to first and second rear legs of the plurality of limbs and the second electric motor so as to transfer motion from the second electric motor to the first and second rear legs;

a first gearbox disposed in the body and driven by the first electric motor, the first gearbox providing output to the first and second front legs via the first bevel gear so that movement of the first front leg mirrors movement of the second front leg;

a second gearbox disposed in the body and driven by the second electric motor, the second gearbox providing output to the first and second rear legs via the second bevel gear so that movement of the first rear leg mirrors movement of the second rear leg; and a processor configured to control at least one of the first gearbox or the second gearbox based on the one or more sensors.

2. An interactive toy as in claim 1, wherein the plurality of positions include at least one of a standing position, a sitting position, a feeding position, a farting position, a peeing position, or a flat position.

3. An interactive toy as in claim 2, further comprising a light, wherein the plurality of positions includes the peeing position, and wherein the light is configured to emit light when the interactive toy is in the peeing position, and wherein the peeing position is when a rear of the body is dropped below a front of the body.

4. An interactive toy as in claim 2, further comprising a speaker, wherein the plurality of positions includes the farting position, and wherein the speaker emits a fart sound when the body is in the farting position, and wherein the farting position is when a front of the body is dropped below a rear of the body.

5. An interactive toy as in claim 1, wherein the one or more sensors comprises a microphone, and wherein the input is audible input.

6. An interactive toy as in claim 5, wherein the audible input has a sound level, and wherein the interactive toy adopts the at least one of the plurality of positions based on the sound level.

7. An interactive toy as in claim 1, wherein the one or more sensors comprises a tilt sensor, and wherein the input is yaw, pitch, or roll of the body caused by the user.

8. An interactive toy as in claim 1, further comprising a head coupled to the body, wherein the one or more sensors comprises a capacitive sensor, wherein the capacitive sensor is disposed in the head, and wherein the input is contact with the capacitive sensor.

9. An interactive toy as in claim 1, wherein the one or more sensors comprises a capacitive sensor, the capacitive sensor being disposed on an underside of the body, and wherein the input is contact with the capacitive sensor.

10. An interactive toy as in claim 1, further comprising a head coupled to the body, the head having a snout, wherein the one or more sensors comprises a push/pull switch, the push/pull switch being disposed in the snout, and wherein the input is changing a position of the push/pull switch.

11. An interactive toy as in claim 10, wherein the at least one of the plurality of positions includes a standing position, and wherein the interactive toy moves to the standing position in response to activation of the push/pull switch.

12. An interactive toy as in claim 1, wherein the one or more sensors comprises a jiggle switch, the jiggle switch being disposed in the body, and wherein the input is shaking the plurality of limbs.

13. An interactive toy as in claim 1, wherein each limb comprises an outer shell disposed about a leg frame, an end of the leg frame being coupled to the joint.

14. An interactive toy as in claim 1, further comprising a clutch configured to transfer rotational power from the first electric motor to the first gearbox.

15. An interactive toy comprising:

a body having a torso, a head, first front leg, a second front leg, a first rear leg, and a second rear leg, the head being coupled to the torso, each of the first front leg, the second front leg, the first rear leg, and the second rear leg being coupled to the torso via a joint, each joint configured to adopt a plurality of positions relative to the torso;

a first bevel gear coupled to the first front leg and the second front leg, the first bevel gear being configured to transfer motion between the first front leg and the second front leg;

a second bevel gear coupled to the first rear leg and the second rear leg, the second bevel gear being configured to transfer motion between the first rear leg and the second rear leg;

one or more tilt sensors configured to determine a position of the body;

one or more sensors configured to receive input from a user;

a first electric motor and a second electric motor disposed in the torso;

a front gearbox disposed in the torso and driven by the first electric motor, the front gearbox providing output to the first front leg and the second front leg via the first bevel gear so that movement of the first front leg mirrors movement of the second front leg;

a rear gearbox disposed in the torso and driven by the second electric motor, the rear gearbox providing output to the first rear leg and the second rear leg via the second bevel gear so that movement of the first rear leg mirrors movement of the second rear leg; and a processor configured to control at least the front and rear gearboxes to move the first front leg, the second front leg, the first rear leg, and the second rear leg between the plurality of positions based on the position determined by the one or more tilt sensors and the user input received by the one or more sensors.

16. An interactive toy as in claim 15, further comprising a speaker, the speaker being configured to emit a sound based at least in part on a position of the plurality of positions.

17. An interactive toy as in claim 15, wherein each of the front and rear gearboxes comprises a position sensor configured to detect a position of the first front leg and the second front leg, and the first rear leg and the second rear leg, respectively.

18. An interactive toy as in claim 15, wherein the position sensor is a digital encoder or a potentiometer.

* * * * *